US011394095B2

(12) United States Patent
Yoshioka et al.

(10) Patent No.: US 11,394,095 B2
(45) Date of Patent: Jul. 19, 2022

(54) DIELECTRIC FILTER, ARRAY ANTENNA DEVICE

(71) Applicant: MITSUBISHI ELECTRIC CORPORATION, Tokyo (JP)

(72) Inventors: Hideharu Yoshioka, Tokyo (JP); Akimichi Hirota, Tokyo (JP); Takeshi Yuasa, Tokyo (JP); Tomokazu Hamada, Tokyo (JP); Yasuo Morimoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 320 days.

(21) Appl. No.: 16/629,691

(22) PCT Filed: Jun. 7, 2018

(86) PCT No.: PCT/JP2018/021853
§ 371 (c)(1),
(2) Date: Jan. 9, 2020

(87) PCT Pub. No.: WO2019/053972
PCT Pub. Date: Mar. 21, 2019

(65) Prior Publication Data

US 2021/0083353 A1 Mar. 18, 2021

(30) Foreign Application Priority Data

Sep. 13, 2017 (WO) ..... PCT/JP2017/033097

(51) Int. Cl.
*H01Q 13/00* (2006.01)
*H01P 1/20* (2006.01)
(Continued)

(52) U.S. Cl.
CPC ..... *H01P 1/2002* (2013.01); *H01P 3/08* (2013.01); *H01P 3/16* (2013.01); *H01P 5/087* (2013.01); *H01Q 1/50* (2013.01)

(58) Field of Classification Search
CPC .. H01P 1/2002; H01P 3/08; H01P 3/12; H01P 3/121; H01P 3/16; H01P 5/08;
(Continued)

(56) References Cited

U.S. PATENT DOCUMENTS 6,359,590 B2 * 3/2002 Takenoshita ..... H01Q 21/0068 343/785
7,064,633 B2 * 6/2006 Wu ..... H01P 5/082 333/230
(Continued)

FOREIGN PATENT DOCUMENTS

JP 7-105645 B2 11/1995
JP 3996879 B2 10/2007
JP 5349196 B2 11/2013

OTHER PUBLICATIONS

Extended European Search Report, dated Oct. 28, 2020, for European Application No. 18855754.0.
(Continued)

*Primary Examiner* — Tho G Phan
(74) *Attorney, Agent, or Firm* — Birch, Stewart, Kolasch & Birch, LLP

(57) ABSTRACT

To obtain a downsized dielectric filter suitable for a laminating structure, a dielectric filter is configured with use of a dielectric waveguide formed of a conductor pattern and vias in a laminating direction within a multilayer dielectric substrate, two strip lines formed in a planar direction of the multilayer dielectric substrate, and two strip line-waveguide converters each configured to perform transmission line conversion between the dielectric waveguide and each strip line. In this manner, it is possible to provide a dielectric filter for which an area to be occupied in the planar direction of the multilayer dielectric substrate is suppressed.

16 Claims, 37 Drawing Sheets

(51) Int. Cl.

| | |
|---|---|
| ***H01P 5/10*** | (2006.01) |
| ***H01P 3/08*** | (2006.01) |
| ***H01P 3/16*** | (2006.01) |
| ***H01P 5/08*** | (2006.01) |
| ***H01Q 1/50*** | (2006.01) |

(58) Field of Classification Search
CPC .. H01P 5/087; H01P 5/10; H01P 5/107; H01P 1/20; H01P 1/207; H01Q 1/50; H01Q 13/06
See application file for complete search history.

(56) References Cited

U.S. PATENT DOCUMENTS

| | | | | |
|---|---|---|---|---|
| 7,102,458 | B2 * | 9/2006 | Koriyama | H01L 23/66 333/33 |
| 7,253,698 | B2 * | 8/2007 | Saitoh | H01P 5/107 333/248 |
| 7,554,418 | B2 * | 6/2009 | Fujita | H01P 5/107 333/33 |
| 8,970,440 | B2 * | 3/2015 | Miyata | H01P 5/107 343/700 MS |
| 9,893,399 | B2 * | 2/2018 | Cheng | H01P 5/022 |
| 2006/0152307 | A1 | 7/2006 | Fukunaga et al. | |
| 2011/0140810 | A1 | 6/2011 | Leiba et al. | |
| 2011/0248891 | A1 | 10/2011 | Han et al. | |
| 2013/0088396 | A1 | 4/2013 | Han | |

OTHER PUBLICATIONS

Partial Supplementary European Search Report, dated Jul. 29, 2020, for European Application No. 18855754.0.

Chinese Office Action and Search Report for Chinese Application No. 201880058015.X, dated Mar. 3, 2021, with an English translation.

* cited by examiner

DIELECTRIC FILTER, ARRAY ANTENNA DEVICE

TECHNICAL FIELD

The present invention relates to a dielectric filter having a waveguide structure, which is to be mainly used as a high-frequency component for a microwave band and a millimeter-wave band, and to an array antenna device including the dielectric filters.

BACKGROUND ART

Hitherto, there has been known a band pass filter (BPF) configured by using a dielectric waveguide integrated in a dielectric substrate. Such a BPF includes two conductor layers provided so as to sandwich a dielectric layer in the dielectric substrate, and conductor posts (vias) formed to pass through the dielectric layer so as to connect those two conductor layers to each other. Further, there has been proposed a structure in which, as a wall surface of the BPF, vias are inserted as signal input/output probes into a dielectric waveguide (substrate integrated waveguide: SIW), which is formed so as to be arrayed along a planar direction of the dielectric substrate, from cutouts formed in any one of the two conductor layers forming the dielectric waveguide (for example, see Patent Literature 1).

Further, hitherto, there has been proposed a dielectric filter having the following structure to reduce a loss as compared to the related art. A conductor pattern is formed on a leading end of a via inserted as the signal input/output probe into a dielectric waveguide formed in the substrate planar direction. The conductor pattern is formed so as to be larger than a cutout formed for inserting the via into the conductor layer (for example, see Patent Literature 2).

CITATION LIST

Patent Literature

[PTL 1] JP H7-105645 A
[PTL 2] JP 3,996,879 B2

SUMMARY OF INVENTION

Technical Problem

However, the related art has the following problems. In the dielectric filters described in Patent Literature 1 and Patent Literature 2, the dielectric waveguide is formed along the substrate planar direction. Therefore, the dielectric filter occupies a large area in the substrate planar direction. An array antenna device including a plurality of element antennas and a plurality of high-frequency components is required to have a filter for each path connecting between one element antenna and one high-frequency component. Therefore, in a case in which the dielectric filters described in Patent Literature 1 and Patent Literature 2 are applied when the array antenna device is configured with use of the dielectric substrate, an area to be occupied by the plurality of dielectric filters in the substrate planar direction is larger than an antenna aperture area in which the plurality of element antennas are arrayed and an area in which the plurality of high-frequency components are mounted on the substrate. Therefore, the device size is increased depending on the size of the dielectric filter in the substrate planar direction, and high-density wiring becomes difficult. Therefore, the length of each path connecting between the element antenna and the high-frequency component is increased, and there arises a problem of increased signal conversion loss.

Further, in the dielectric filters described in Patent Literature 1 and Patent Literature 2, an interval (gap) between the via inserted in the dielectric waveguide as the signal input/output probe and the conductor layer serving as a waveguide wall facing the via is dependent on a layer structure of the dielectric substrate in view of substrate manufacturing. Further, in the dielectric filter described in Patent Literature 2, the size of the conductor pattern formed on the leading end of the via inserted in the dielectric waveguide as the signal input/output probe is required to be about two times or more as large as the diameter of the via in view of substrate manufacturing. Therefore, in the dielectric filters described in Patent Literature 1 and Patent Literature 2, the degree of design freedom is reduced. Further, the dielectric filters described in Patent Literature 1 and Patent Literature 2 have difficulty in matching at the signal input/output probe portion, and hence there arises a problem of increased signal conversion loss.

The present invention has been made to solve the above-mentioned problems, and has an object to provide a dielectric filter and the like, which can be downsized in a planar direction of a dielectric substrate, are suitable for a laminated structure, have a high degree of design freedom, and have low loss in signal conversion.

Solution to Problem

According to the present invention, there is provided a dielectric filter including: a multilayer dielectric substrate, which includes a plurality of conductor layers formed so as to be separated apart from each other in a laminating direction, and is configured to propagate a high-frequency signal; a first strip line and a second strip line, which are formed so as to extend in a planar direction in conductor layers that are separated away from each other in the laminating direction; a dielectric waveguide formed of the conductor layers extending in the planar direction and conductor posts extending in the laminating direction, between the first strip line and the second strip line in the laminating direction of the multilayer dielectric substrate; a first strip line-waveguide converter, which is formed on an upper side of the first strip line in the laminating direction, and is configured to perform transmission line conversion between the dielectric waveguide and the first strip line; and a second strip line-waveguide converter, which is formed on a lower side of the second strip line in the laminating direction, and is configured to perform transmission line conversion between the dielectric waveguide and the second strip line.

Advantageous Effects of Invention

According to the present invention, there are used a dielectric waveguide formed of a conductor pattern and vias in the laminating direction within the multilayer dielectric substrate, two strip lines formed in the planar direction of the multilayer dielectric substrate, and two strip line-waveguide converters each configured to perform transmission line conversion between the dielectric waveguide and each strip line. In this manner, it is possible to provide a dielectric filter or the like, for which an area to be occupied in the planar direction of the multilayer dielectric substrate is suppressed, and which has a high degree of design freedom and low loss during signal conversion.

DESCRIPTION OF EMBODIMENTS

According to the present invention, there are used a dielectric waveguide formed of a conductor pattern and vias in a laminating direction within a multilayer dielectric substrate, two strip lines formed in a planar direction of the multilayer dielectric substrate, and two waveguide-strip line converters each configured to perform transmission line conversion between the dielectric waveguide and each strip line. In this manner, it is possible to provide a dielectric filter for which an area to be occupied in the planar direction of the multilayer dielectric substrate is suppressed.

Further, in the waveguide-strip line converters, the conductor pattern is inserted in the dielectric waveguide as a signal input/output probe. Therefore, the degree of design freedom can be improved in a shape of the signal input/output probe portion and an interval between the probe and a conductor layer serving as a waveguide wall facing the probe. As a result, a dielectric filter with low loss can be provided.

Now, a dielectric filter and an array antenna device including the dielectric filter according to the present invention are described with reference to the drawings by way of embodiments. In the embodiments, like or corresponding parts are denoted by like symbols, and redundant description is omitted.

First Embodiment

Example 1

Figure 1:
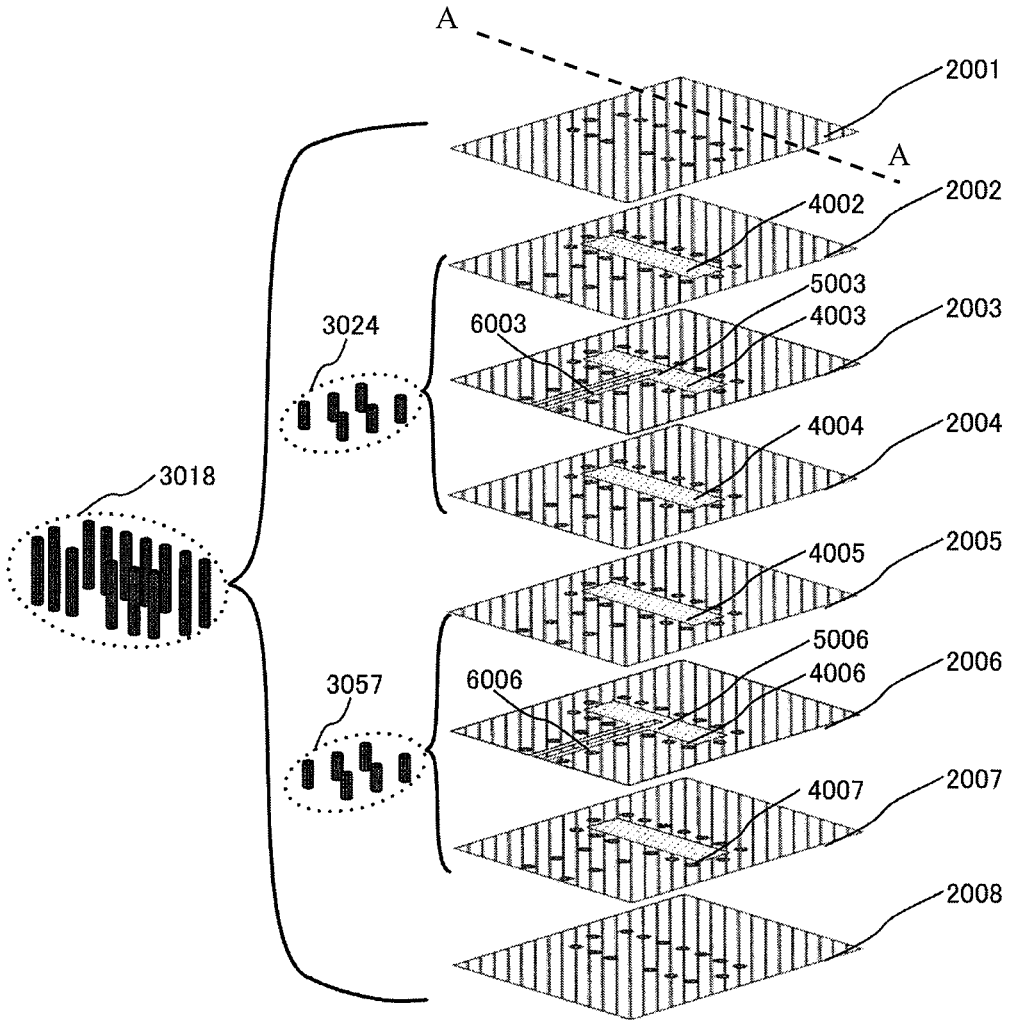
FIG. 1 is an exploded perspective view for illustrating an array of portions of a dielectric filter according to Example 1 of a first embodiment of the present invention.
Figure 2:
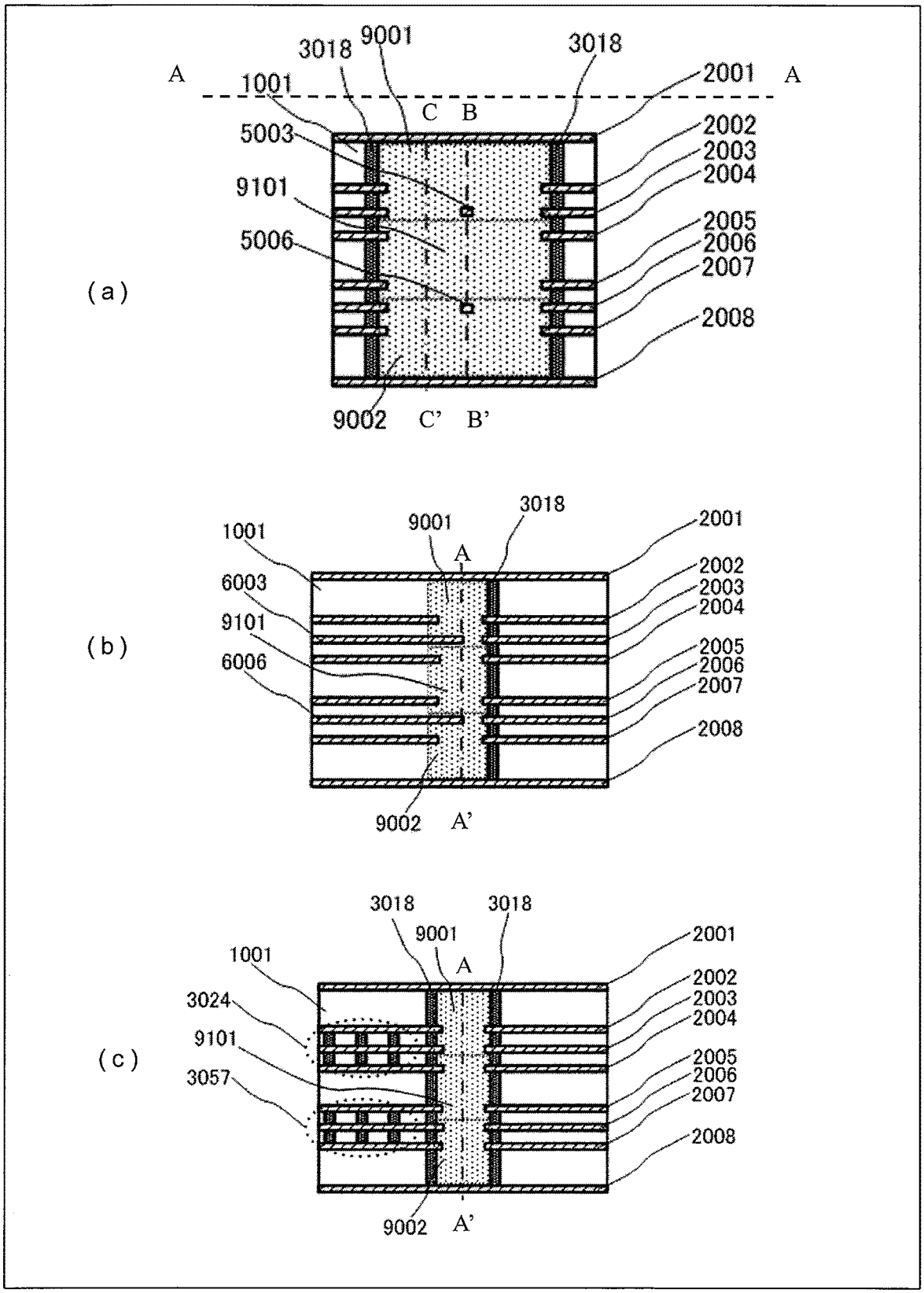
FIG. 2 is a vertical sectional view for illustrating the dielectric filter according to Example 1 of the first embodiment of the present invention.

FIG. 1 and FIG. 2 are views for illustrating a dielectric filter according to a first embodiment of the present invention.

FIG. 1 is an exploded perspective view for illustrating an array of conductor layers, strip lines, probes, vias, apertures, and the like.

Part (a) of FIG. 2 is a vertical sectional view taken along the line A-A of FIG. 1.

Part (b) of FIG. 2 is a vertical sectional view taken along the line B-B' of part (a) of FIG. 2.

Part (c) of FIG. 2 is a vertical sectional view taken along the line C-C' of part (a) of FIG. 2.

In the first embodiment, description is mainly given of a dielectric filter including a dielectric waveguide 9101, two strip lines 6003 and 6006, and two strip line-waveguide converters 9001 and 9002. The dielectric waveguide 9101 is formed of a conductor pattern including conductor layers 2001 to 2008 in a laminating direction of a multilayer dielectric substrate 1001, and vias 3018, 3024, and 3057 serving as conductor posts. The two strip lines 6003 and 6006 are formed in a planar direction of the multilayer dielectric substrate 1001. The two strip line-waveguide converters 9001 are each configured to perform transmission line conversion between the dielectric waveguide 9101 and each of the strip lines 6003 and 6006.

In FIG. 1 and FIG. 2, in the multilayer dielectric substrate 1001, there are provided the conductor layer 2001, the conductor layer 2002, the conductor layer 2003, the conductor layer 2004, the conductor layer 2005, the conductor layer 2006, the conductor layer 2007, the conductor layer 2008, the vias 3018, the vias 3024, the vias 3057, the strip line 6003, the strip line 6006, a probe 5003, and a probe 5006.

The conductor layer 2001 is arranged on a surface layer of the multilayer dielectric substrate 1001.

The conductor layer 2002 is arranged in an inner layer of the multilayer dielectric substrate 1001 so as to face the conductor layer 2001.

The conductor layer 2003 is arranged in the inner layer of the multilayer dielectric substrate 1001 so as to face the conductor layer 2002 facing the conductor layer 2001 on its back surface side.

The conductor layer 2004 is arranged in the inner layer of the multilayer dielectric substrate 1001 so as to face the conductor layer 2003 facing the conductor layer 2002 on its back surface side.

The conductor layer 2005 is arranged in the inner layer of the multilayer dielectric substrate 1001 so as to face the conductor layer 2004 facing the conductor layer 2003 on its back surface side.

The conductor layer 2006 is arranged in the inner layer of the multilayer dielectric substrate 1001 so as to face the conductor layer 2005 facing the conductor layer 2004 on its back surface side.

The conductor layer 2007 is arranged in the inner layer of the multilayer dielectric substrate 1001 so as to face the conductor layer 2006 facing the conductor layer 2005 on its back surface side.

The conductor layer 2008 is arranged on a surface layer of the multilayer dielectric substrate 1001 on a side opposite to the side on which the conductor layer 2001 is arranged, so as to face the conductor layer 2007 facing the conductor layer 2006 on its back surface side.

The conductor layer 2002 to the conductor layer 2007 have an aperture 4002 to an aperture 4007, respectively.

The aperture 4002 to the aperture 4007 are arranged so as to oppose each other. That is, the aperture 4002 to the aperture 4007 are positioned so as to overlap each other in the laminating direction.

The inner side of each of the aperture 4002 to the aperture 4007 is not a hollow cavity. For example, the aperture 4002 to the aperture 4007 are filled with a dielectric body similarly to the multilayer dielectric substrate 1001 on the outer sides of the vias 3018 on both sides in part (a) of FIG. 2. This state is represented in a dot pattern (the same holds true in the following).

The strip line 6003 is formed by eliminating a part of the conductor layer 2003.

The strip line 6006 is formed by eliminating a part of the conductor layer 2006.

The probe 5003 has one end connected to the strip line 6003, and another end arranged in the aperture 4003.

The probe 5006 has one end connected to the strip line 6006, and another end arranged in the aperture 4006.

A plurality of vias 3018 are arranged so as to surround the aperture 4002 to the aperture 4007 except for a part corresponding to the strip line 6003 and the strip line 6006, and to extend from the conductor layer 2001 to the conductor layer 2008 to pass through the multilayer dielectric substrate 1001 and the conductor layer 2002 to the conductor layer 2007.

A plurality of vias 3024 are arranged along both longitudinal side surfaces of the strip line 6003 along the laminating direction, and extend from the conductor layer 2002 to the conductor layer 2004 to pass through the multilayer dielectric substrate 1001 and the conductor layer 2003.

A plurality of vias 3057 are arranged along both longitudinal side surfaces of the strip line 6006 along the laminating direction, and extend from the conductor layer 2005 to the conductor layer 2007 to pass through the multilayer dielectric substrate 1001 and the conductor layer 2006.

From the planar direction to the laminating direction of the multilayer dielectric substrate 1001, the strip line-waveguide converter 9001 is formed of the conductor layer 2001, the conductor layer 2002, the conductor layer 2003, the vias 3018, the probe 5003, the aperture 4002, and the aperture 4003. In the strip line-waveguide converter 9001, a dielectric waveguide part, which is formed of the conductor layer 2001, the conductor layer 2002, the conductor layer 2003, and the vias 3018 in the laminating direction of the multilayer dielectric substrate 1001 to form a back-short waveguide, is formed so that a part from the conductor layer 2001 serving as a short-circuit surface to the probe 5003 has a length corresponding to ¼ wavelength of a guide wavelength of the back-short waveguide.

From the planar direction to the laminating direction of the multilayer dielectric substrate 1001, a strip line-waveguide converter 9002 is formed of the conductor layer 2006, the conductor layer 2007, the conductor layer 2008, the vias 3018, the probe 5006, the aperture 4006, and the aperture 4007. In the strip line-waveguide converter 9002, a dielectric waveguide part, which is formed of the conductor layer 2006, the conductor layer 2007, the conductor layer 2008, and the vias 3018 in the laminating direction of the multilayer dielectric substrate 1001 to form a back-short waveguide, is formed so that a part from the conductor layer 2008 serving as a short-circuit surface to the probe 5006 has a length corresponding to ¼ wavelength of a guide wavelength of the back-short waveguide.

In the laminating direction of the multilayer dielectric substrate 1001, the dielectric waveguide 9101 is formed of the conductor layer 2004, the conductor layer 2005, the vias 3018, the aperture 4004, and the aperture 4005.

The strip line-waveguide converter 9001 and the strip line-waveguide converter 9002 are electromagnetically connected to each other via the dielectric waveguide 9101.

Figure 3:
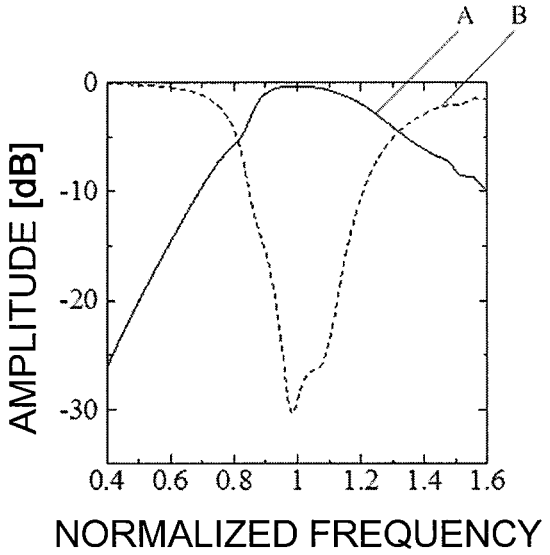
FIG. 3 is an explanatory graph for showing simulation results of a transmission characteristic and a reflection characteristic of the dielectric filter according to the first embodiment of the present invention.

FIG. 3 is a graph for showing simulation results of a transmission characteristic and a reflection characteristic of the dielectric filter according to the first embodiment illustrated in FIG. 1 and FIG. 2.

This simulation represents results of calculating a high-frequency signal propagating from the strip line 6003 to the strip line 6006 in the dielectric filter according to the first embodiment. In this case, in FIG. 3, the transmission characteristic and the reflection characteristic are indicated by the solid line A and the broken line B, respectively, in a range of a fractional bandwidth of 120%.

In FIG. 3, for example, when attention is paid to the reflection characteristic B having a normalized frequency, which is indicated by the horizontal line, of 1, it is found that the simulation results for the dielectric filter according to the first embodiment have values around −29 dB.

Further, when attention is paid to the transmission characteristic A, it is found that a passband fractional bandwidth at which a passband edge attenuation amount becomes −3 dB is 0.4, and a stopband fractional bandwidth at which a stopband edge attenuation amount becomes −10 dB is 0.9.

That is, it is found that the dielectric filter according to the first embodiment operates as a bandpass-type filter (band pass filter).

As is clear from above, according to the dielectric filter of the first embodiment, the strip line-waveguide converter 9001 and the strip line-waveguide converter 9002 are electromagnetically connected to each other via the dielectric waveguide 9101. In this manner, in the dielectric waveguide 9101, propagation of a high-frequency signal in a frequency band that is equal to or lower than a waveguide cutoff frequency can be blocked. In the strip line-waveguide converter 9001 and the strip line-waveguide converter 9002, coupling to the dominant mode ($TE_{10}$: transverse electric wave) of the dielectric waveguide 9101 is mainly performed, and coupling to a higher-order mode for propagating the high-frequency signal in a frequency band that is higher than that of the dominant mode is suppressed.

Therefore, there is provided an effect that a bandpass-type dielectric filter that is downsized in the planar direction of the multilayer dielectric substrate 1001 can be obtained.

Example 2

In the example of FIG. 1 according to Example 1, description has been given of the dielectric filter in which the widths of the probe 5003 and the probe 5006 are the same in dimension as the widths of the strip line 6003 and the strip line 6006. However, the present invention is not limited to such a configuration, and there may be employed a dielectric filter in which the width of the probe 5003 or the probe 5006 is different in dimension from the width of the strip line 6003 or the strip line 6006.

Figure 4:
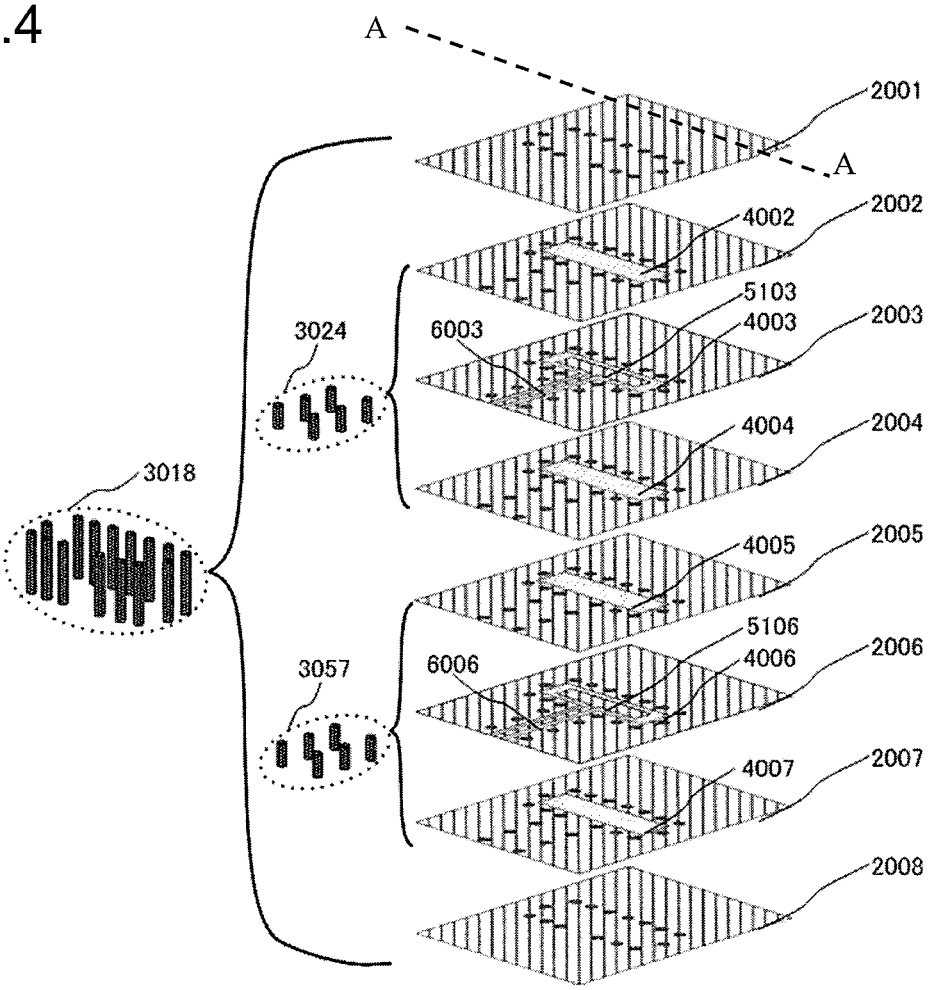
FIG. 4 is an exploded perspective view for illustrating an array of portions of a dielectric filter according to Example 2 of the first embodiment of the present invention.
Figure 5:
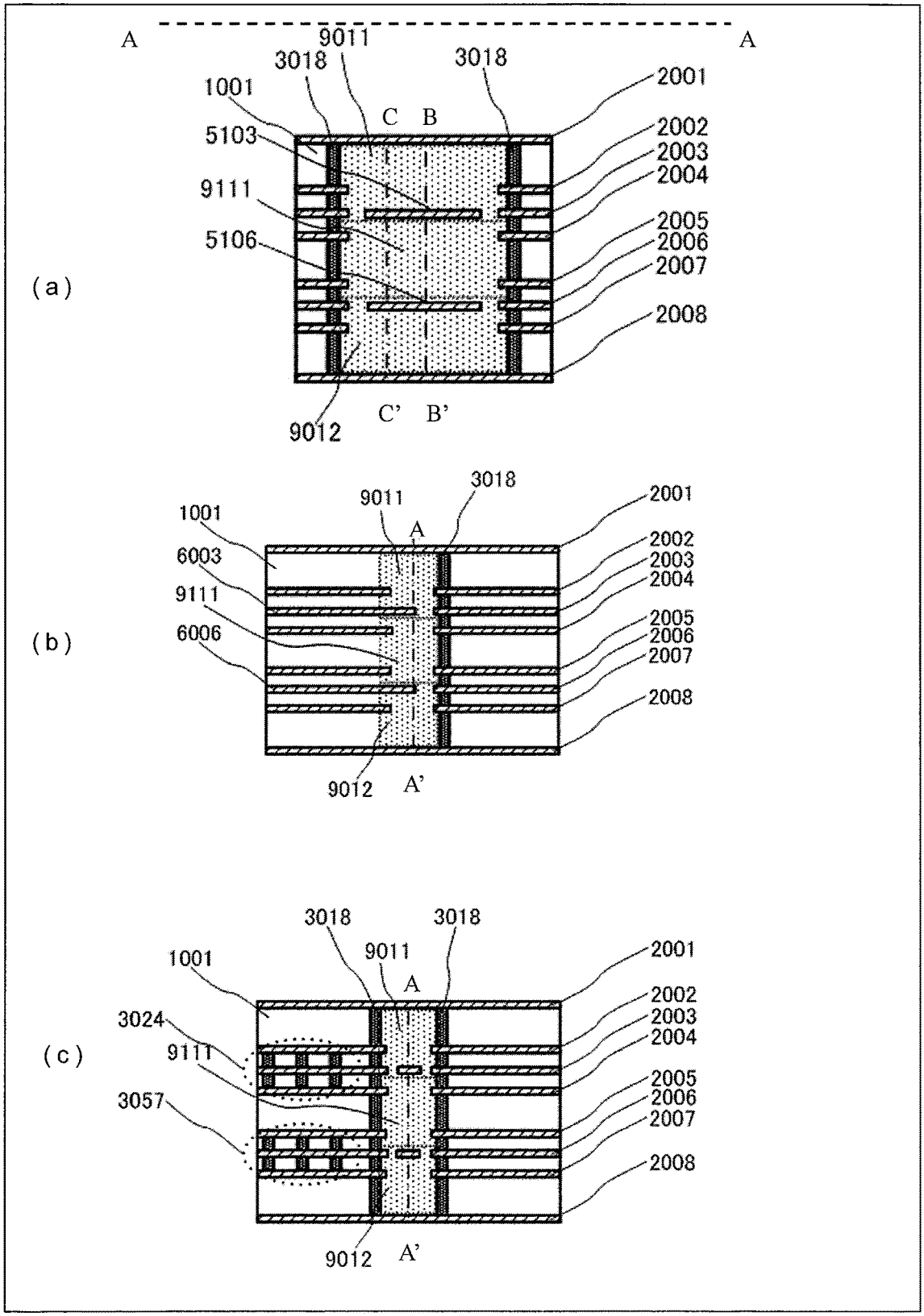
FIG. 5 is a vertical sectional view for illustrating the dielectric filter according to Example 2 of the first embodiment of the present invention.

FIG. 4 and FIG. 5 are views for illustrating the dielectric filter according to the first embodiment of the present invention in which widths of a probe 5103 and a probe 5106 are larger in dimension than the widths of the strip line 6003 and the strip line 6006.

FIG. 4 is an exploded perspective view for illustrating an array of conductor layers, strip lines, probes, vias, apertures, and the like.

Part (a) of FIG. 5 is a vertical sectional view taken along the line A-A of FIG. 4.

Part (b) of FIG. 5 is a vertical sectional view taken along the line B-B' of part (a) of FIG. 5.

Part (c) of FIG. 5 is a vertical sectional view taken along the line C-C' of part (a) of FIG. 5.

In the example of FIG. 4 and FIG. 5, from the planar direction to the laminating direction of the multilayer dielectric substrate 1001, the strip line-waveguide converter 9011 is formed of the conductor layer 2001, the conductor layer 2002, the conductor layer 2003, the vias 3018, the probe 5103, the aperture 4002, and the aperture 4003.

From the planar direction to the laminating direction of the multilayer dielectric substrate 1001, a strip line-waveguide converter 9012 is formed of the conductor layer 2006, the conductor layer 2007, the conductor layer 2008, the vias 3018, the probe 5106, the aperture 4006, and the aperture 4007.

Further, in the example of FIG. 4 and FIG. 5, the strip line-waveguide converter 9011 and the strip line-waveguide converter 9012 are electromagnetically connected to each other via the dielectric waveguide 9111.

In the example of FIG. 4 and FIG. 5 according to Example 2 of the first embodiment, the widths of the probe 5103 and the probe 5106 are larger in dimension than the widths of the strip line 6003 and the strip line 6006. In this manner, the passband width can be adjusted and expanded. Further, an effect similar to that in the example of FIG. 1 and FIG. 2 can be obtained.

Example 3

In the example of FIG. 1 and FIG. 2 according to Example 1 of the first embodiment, description has been given of the dielectric filter in which the probe 5003 and the probe 5006 are arranged toward a waveguide axial direction from the same wall surface side of the waveguide walls of the dielectric waveguide 9101.

However, the present invention is not limited to such a configuration, and there may be employed a dielectric filter in which the probe 5003 and the probe 5006 are arranged toward the waveguide axial direction from different wall surface sides of the waveguide walls of the dielectric waveguide 9101.

Figure 6:
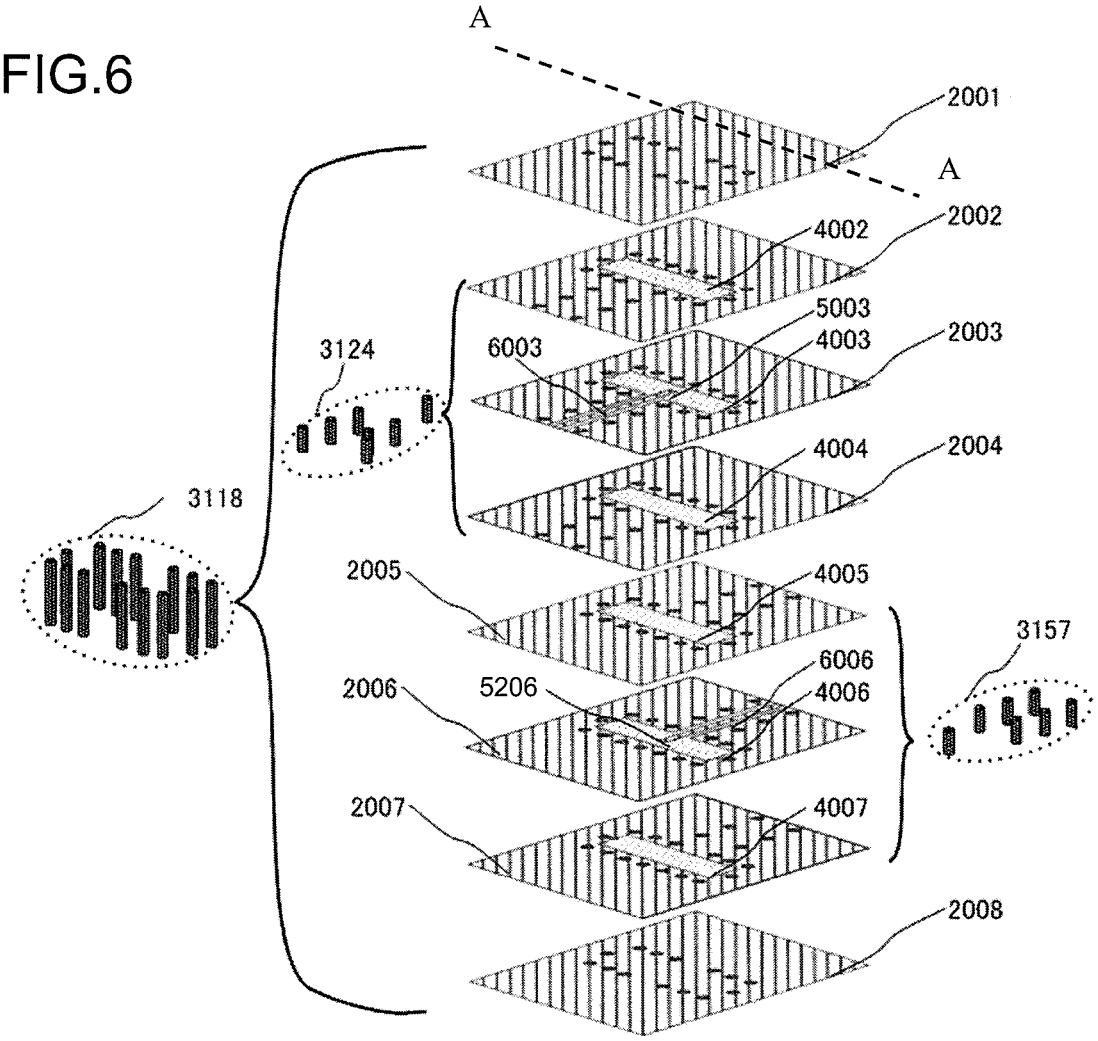
FIG. 6 is an exploded perspective view for illustrating an array of portions of a dielectric filter according to Example 3 of the first embodiment of the present invention.
Figure 7:
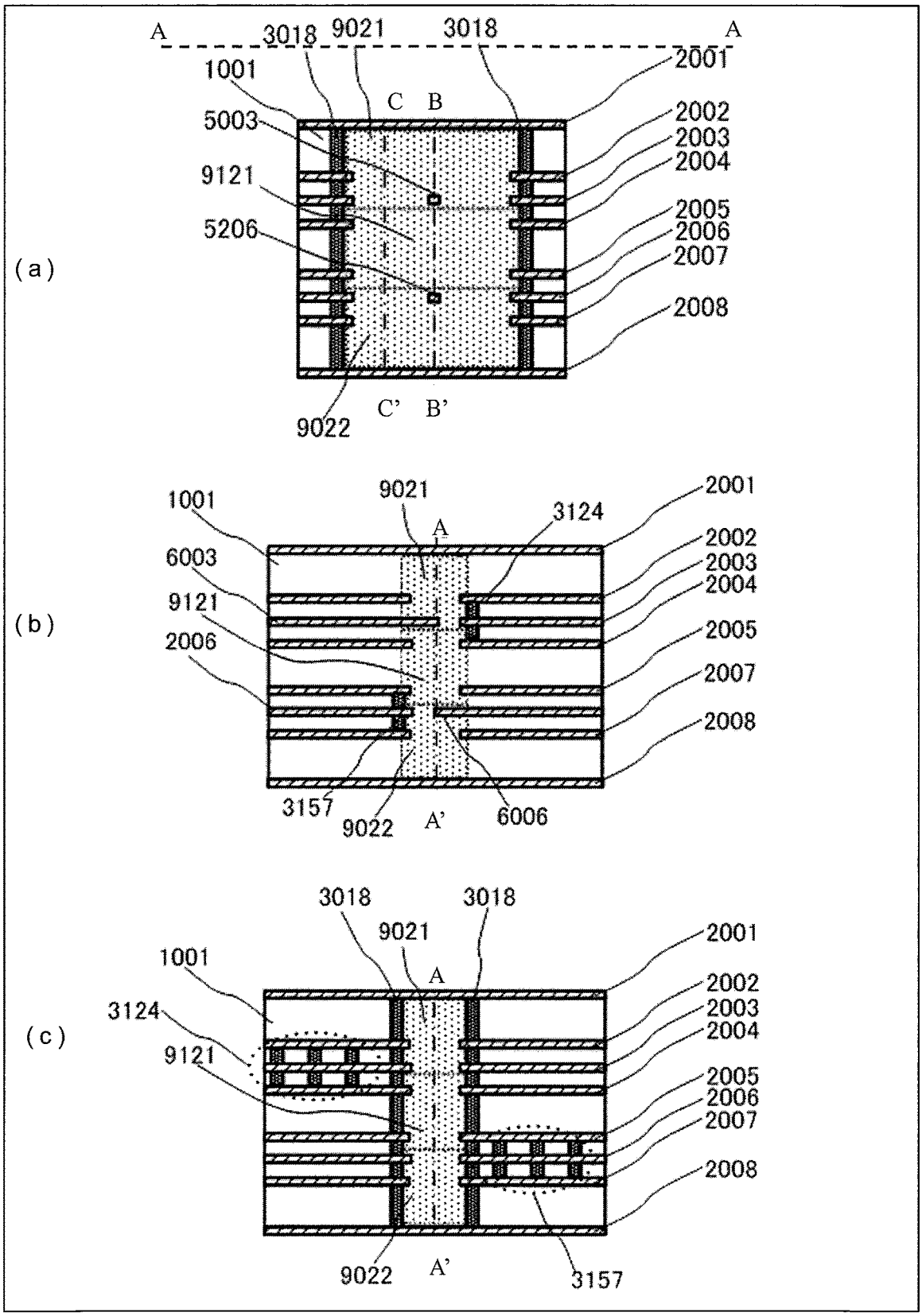
FIG. 7 is a vertical sectional view for illustrating the dielectric filter according to Example 3 of the first embodiment of the present invention.

FIG. 6 and FIG. 7 are views for illustrating the dielectric filter according to the first embodiment of the present invention in which the two probes are provided toward the waveguide axial direction from opposing wall surface sides of the waveguide walls of the dielectric waveguide.

FIG. 6 is an exploded perspective view for illustrating an array of conductor layers, strip lines, probes, vias, apertures, and the like.

Part (a) of FIG. 7 is a vertical sectional view taken along the line A-A of FIG. 6.

Part (b) of FIG. 7 is a vertical sectional view taken along the line B-B' of part (a) of FIG. 7.

Part (c) of FIG. 7 is a vertical sectional view taken along the line C-C' of part (a) of FIG. 7.

In the example of FIG. 6 and FIG. 7, the strip line 6006 is formed by eliminating a part of the conductor layer 2006 at a position at which the strip line 6006 is prevented from being located at the same height as the strip line 6003 in the laminating direction.

In addition, a probe 5206 has one end connected to the strip line 6006, and another end arranged in the aperture 4006.

A plurality of vias 3118 are arranged so as to surround the aperture 4002 to the aperture 4007 except for a part corresponding to the strip line 6003 and the strip line 6006, and to extend from the conductor layer 2001 to the conductor layer 2008 to pass through the multilayer dielectric substrate 1001 and the conductor layer 2002 to the conductor layer 2007.

A plurality of vias 3124 are arranged along both longitudinal side surfaces of the strip line 6003 along the laminating direction and in a part of an edge of each of the aperture 4002, the aperture 4003, and the aperture 4004, and extend from the conductor layer 2002 to the conductor layer 2004 to pass through the multilayer dielectric substrate 1001 and the conductor layer 2003.

A plurality of vias 3157 are arranged along both longitudinal side surfaces of the strip line 6006 along the laminating direction and in a part of an edge of each of the aperture 4005, the aperture 4006, and the aperture 4007, and extend from the conductor layer 2005 to the conductor layer 2007 to pass through the multilayer dielectric substrate 1001 and the conductor layer 2006.

From the planar direction to the laminating direction of the multilayer dielectric substrate 1001, a strip line-waveguide converter 9021 is formed of the conductor layer 2001, the conductor layer 2002, the conductor layer 2003, the vias 3118, the vias 3124, the probe 5003, the aperture 4002, and the aperture 4003.

From the planar direction to the laminating direction of the multilayer dielectric substrate 1001, a strip line-waveguide converter 9022 is formed of the conductor layer 2006, the conductor layer 2007, the conductor layer 2008, the vias 3018, the vias 3157, the probe 5206, the aperture 4006, and the aperture 4007.

In the laminating direction of the multilayer dielectric substrate 1001, a dielectric waveguide 9121 is formed of the conductor layer 2004, the conductor layer 2005, the vias 3118, the aperture 4004, and the aperture 4005.

The strip line-waveguide converter 9021 and the strip line-waveguide converter 9022 are electromagnetically connected to each other via the dielectric waveguide 9121.

In the example of FIG. 6 according to Example 3 of the first embodiment, the probe 5003 and the probe 5206 are formed toward the waveguide axial direction from opposing wall surface sides of the waveguide walls of the dielectric waveguide 9121. In this manner, a transmission phase can be reversed from that in the example of FIG. 1 and FIG. 2 according to Example 1 of the first embodiment, and hence the degree of design freedom can be improved. Further, an effect similar to that in the example of FIG. 1 and FIG. 2 can be obtained.

Example 4

In the example of FIG. 1 and FIG. 2 according to Example 1 of the first embodiment, description has been given of the dielectric filter in which the aperture 4002 to the aperture 4007 have the same aperture diameter. However, the present invention is not limited thereto, and there may be employed a dielectric filter in which the apertures have different aperture diameters.

Figure 8:
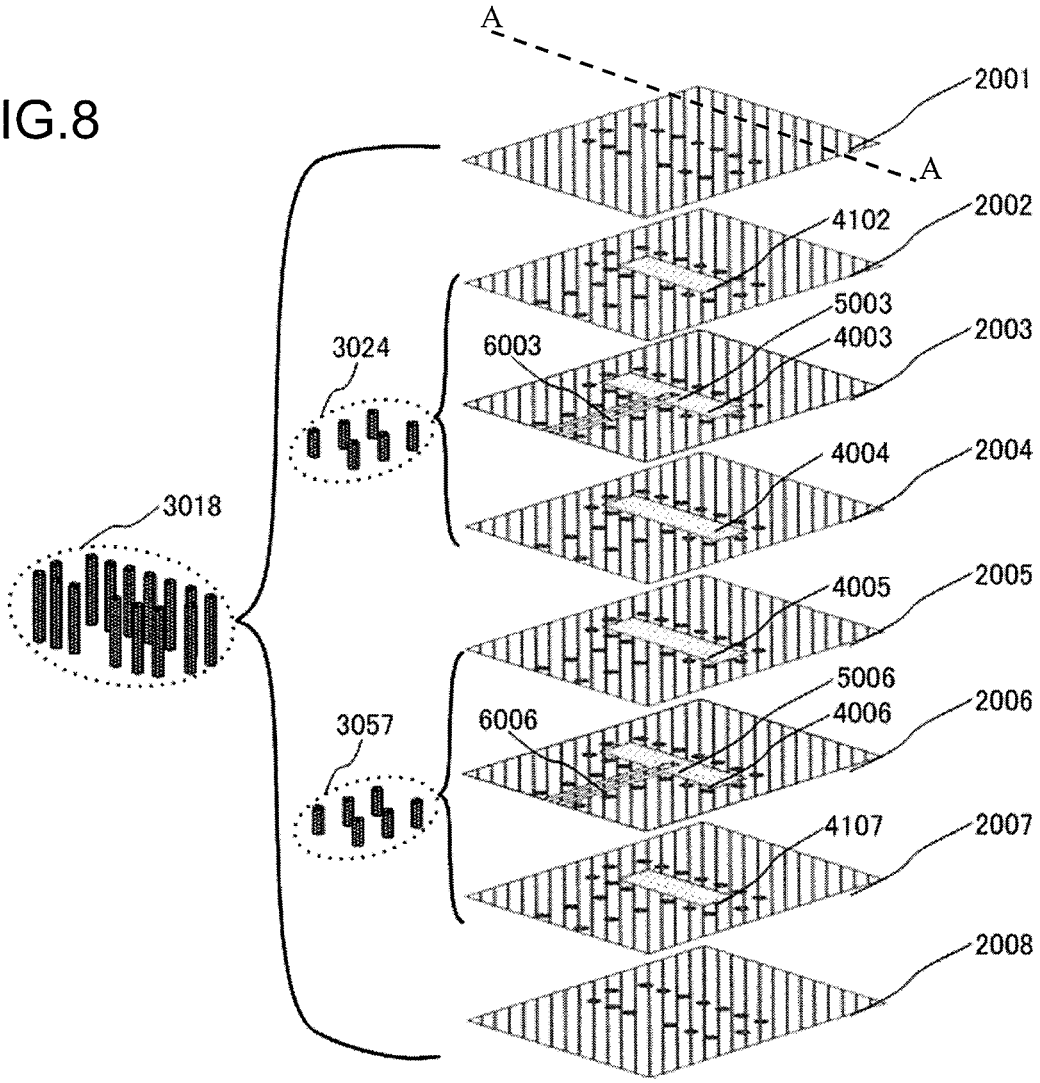
FIG. 8 is an exploded perspective view for illustrating an array of portions of a dielectric filter according to Example 4 of the first embodiment of the present invention.
Figure 9:
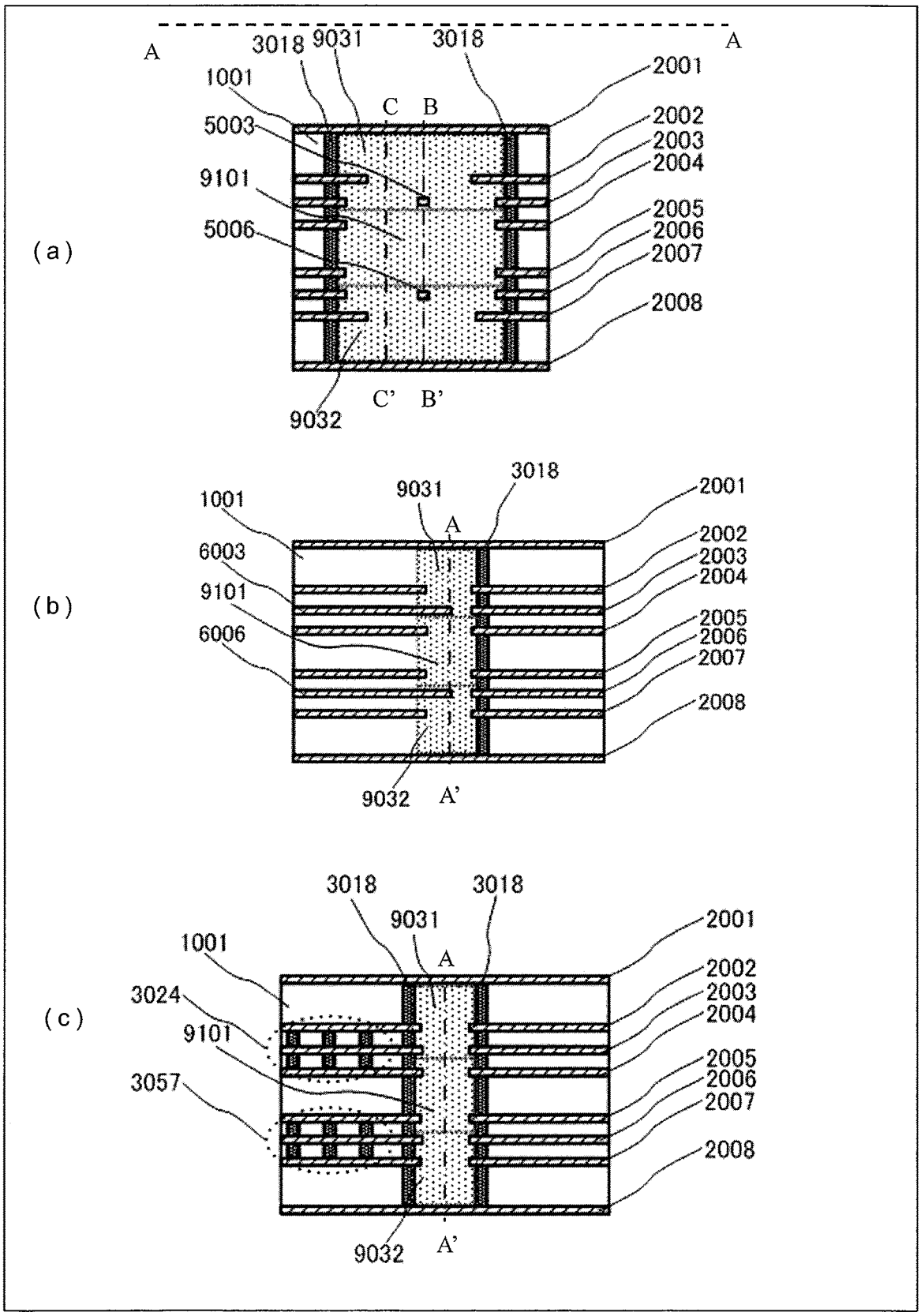
FIG. 9 is a vertical sectional view for illustrating the dielectric filter according to Example 4 of the first embodiment of the present invention.

FIG. 8 and FIG. 9 are views for illustrating a dielectric filter according to the first embodiment of the present invention in which, in the strip line-waveguide converter, a dielectric waveguide part from the probe to the short-circuit surface, that is, the back-short waveguide includes a conductor layer having an aperture whose diameter is smaller than the aperture diameter of the conductor layer in the dielectric waveguide. In a broad sense, the back-short waveguide differs from the dielectric waveguide in a shape inside the waveguide in a cross section orthogonal to the waveguide axis.

FIG. 8 is an exploded perspective view for illustrating an array of conductor layers, strip lines, probes, vias, apertures, and the like.

Part (a) of FIG. 9 is a vertical sectional view taken along the line A-A of FIG. 8.

Part (b) of FIG. 9 is a vertical sectional view taken along the line B-B' of part (a) of FIG. 9.

Part (c) of FIG. 9 is a vertical sectional view taken along the line C-C' of part (a) of FIG. 9.

In the example of FIG. 8 and FIG. 9, an aperture 4102 is formed by eliminating a part of the conductor layer 2002 in a dimension that is smaller than those of the aperture 4004 and the aperture 4005.

Further, an aperture 4107 is formed by eliminating a part of the conductor layer 2007 in a dimension that is smaller than those of the aperture 4004 and the aperture 4005.

From the planar direction to the laminating direction of the multilayer dielectric substrate 1001, a strip line-waveguide converter 9031 is formed of the conductor layer 2001, the conductor layer 2002, the conductor layer 2003, the vias 3018, the probe 5003, the aperture 4102, and the aperture 4003.

From the planar direction to the laminating direction of the multilayer dielectric substrate 1001, a strip line-waveguide converter 9032 is formed of the conductor layer 2006, the conductor layer 2007, the conductor layer 2008, the vias 3018, the probe 5006, the aperture 4006, and the aperture 4107.

The strip line-waveguide converter 9031 and the strip line-waveguide converter 9032 are electromagnetically connected to each other via the dielectric waveguide 9101.

In the example of FIG. 8 and FIG. 9 according to Example 4 of the first embodiment, the aperture diameters of the aperture 4102 and the aperture 4107 are smaller than the aperture diameters of the aperture 4003, the aperture 4004, the aperture 4005, and the aperture 4006. In this manner, as compared to the example of FIG. 1 and FIG. 2 according to Example 1 of the first embodiment, the following guide wavelengths can be increased:

a guide wavelength of a dielectric waveguide part from the probe 5003 to the conductor layer 2001 serving as the short-circuit surface (back-short) in the strip line-waveguide converter 9031; and a guide wavelength of a dielectric waveguide part from the probe 5006 (5003) to the conductor layer 2008 serving as the short-circuit surface in the strip line-waveguide converter 9032. Therefore, the degree of design freedom can be improved. Further, an effect similar to that in the example of FIG. 1 and FIG. 2 can be obtained.

When the aperture diameters of the aperture 4102 and the aperture 4107 are larger than the aperture diameters of the aperture 4003, the aperture 4004, the aperture 4005, and the aperture 4006, as compared to the example of FIG. 1 and FIG. 2, the following guide wavelengths can be decreased:

the guide wavelength of the dielectric waveguide part from the probe 5003 to the conductor layer 2001 serving as the short-circuit surface (back-short) in the strip line-waveguide converter 9031; and the guide wavelength of the dielectric waveguide part from the probe 5006 (5003) to the conductor layer 2008 serving as the short-circuit surface (back-short) in the strip line-waveguide converter 9032. Therefore, the degree of design freedom can be improved. Further, an effect similar to that in the example of FIG. 1 and FIG. 2 can be obtained.

Example 5

Figure 10:
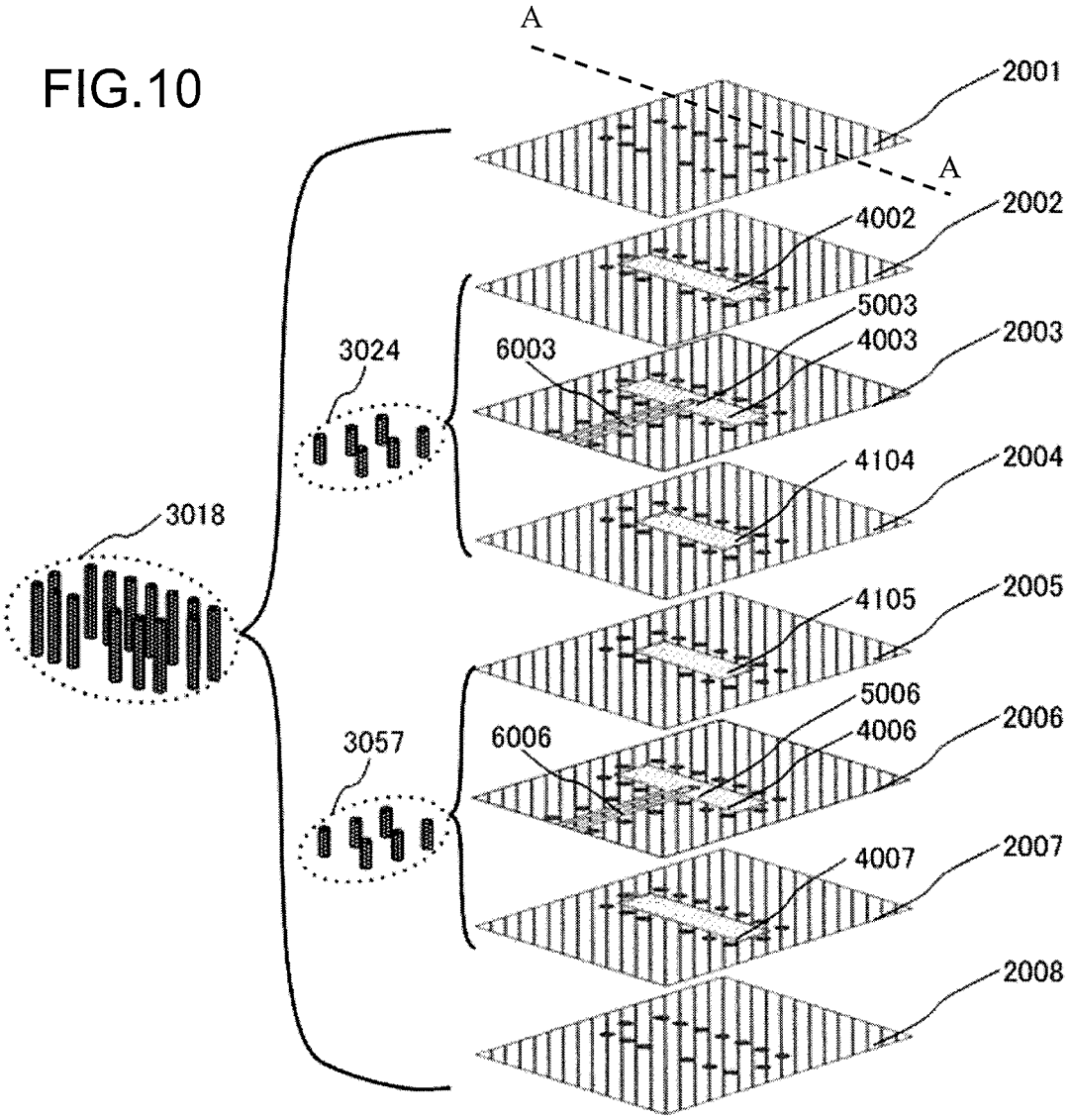
FIG. 10 is an exploded perspective view for illustrating an array of portions of a dielectric filter according to Example 5 of the first embodiment of the present invention.
Figure 11:
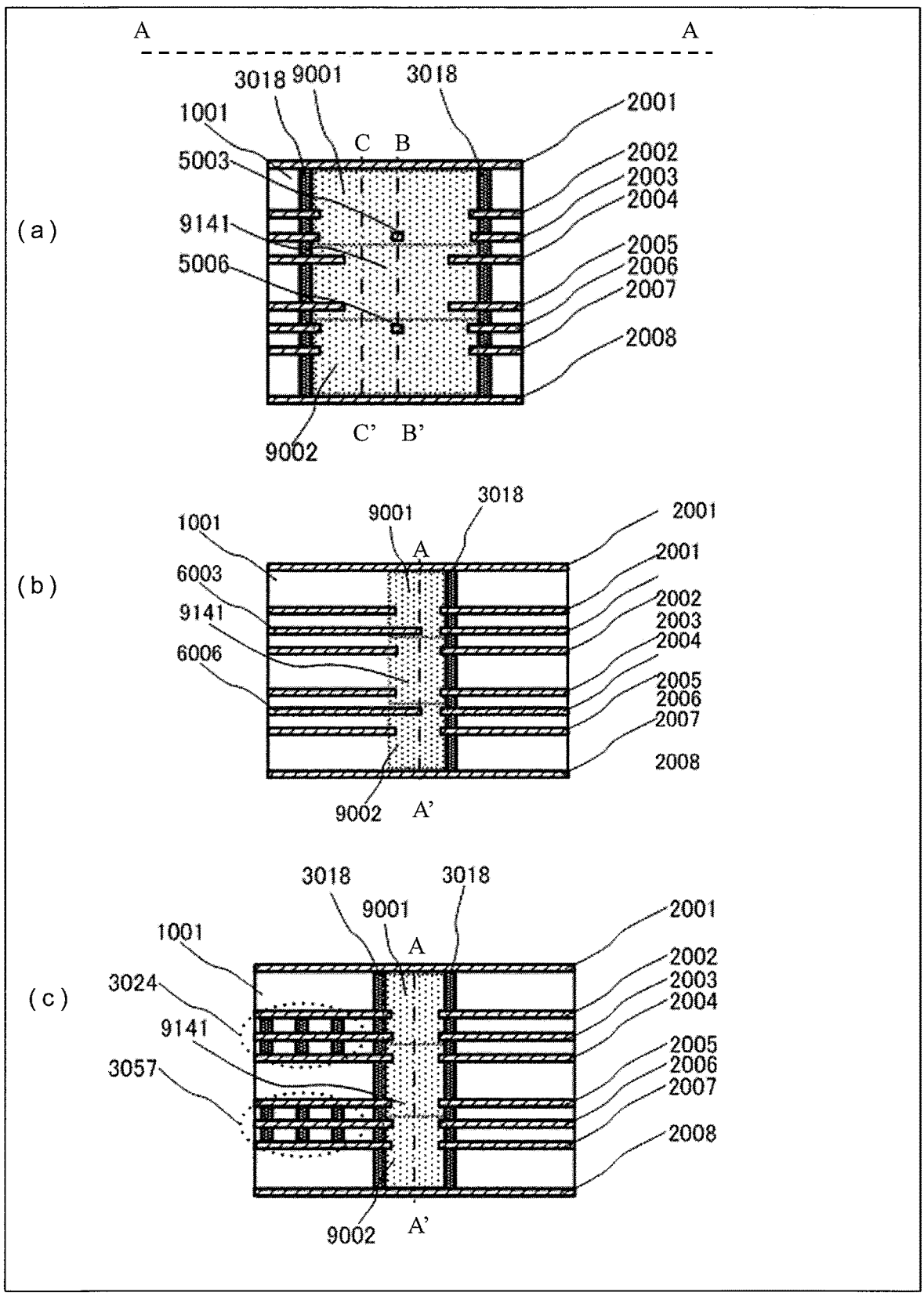
FIG. 11 is a vertical sectional view for illustrating the dielectric filter according to Example 5 of the first embodiment of the present invention.

FIG. 10 and FIG. 11 are views for illustrating a dielectric filter according to the first embodiment of the present invention in which the aperture diameter of the dielectric waveguide is smaller than the aperture diameter of the dielectric waveguide part from the probe to the short-circuit surface, that is, the back-short waveguide in the strip line-waveguide converter.

FIG. 10 is an exploded perspective view for illustrating an array of conductor layers, strip lines, probes, vias, apertures, and the like.

Part (a) of FIG. 11 is a vertical sectional view taken along the line A-A of FIG. 10.

Part (b) of FIG. 11 is a vertical sectional view taken along the line B-B' of part (a) of FIG. 11.

Part (c) of FIG. 11 is a vertical sectional view taken along the line C-C' of part (a) of FIG. 11.

In the example of FIG. 10 and FIG. 11, an aperture 4104 is formed by eliminating a part of the conductor layer 2004 in a dimension that is smaller than those of the aperture 4002, the aperture 4003, the aperture 4006, and the aperture 4007.

Further, in the example of FIG. 10 and FIG. 11, an aperture 4105 is formed by eliminating a part of the conductor layer 2005 in a dimension that is smaller than those of the aperture 4002, the aperture 4003, the aperture 4006, and the aperture 4007.

In the laminating direction of the multilayer dielectric substrate 1001, a dielectric waveguide 9141 is formed of the conductor layer 2004, the conductor layer 2005, the vias 3018, the aperture 4104, and the aperture 4105.

The strip line-waveguide converter 9001 and the strip line-waveguide converter 9002 are electromagnetically connected to each other via the dielectric waveguide 9141.

In the example of FIG. 10 and FIG. 11 according to Example 5 of the first embodiment, the aperture diameters of the aperture 4104 and the aperture 4105 are smaller than the aperture diameters of the aperture 4002, the aperture 4003, the aperture 4006, and the aperture 4007. In this manner, the dielectric waveguide 9141 has a comb-teeth (corrugated) structure that is greatly narrowed by the conductor layer 2004 and the conductor layer 2005. When the interval between the conductor layer 2004 and the conductor layer 2005 and the comb-teeth length in the corrugated part are selected, a transmission phase in a passband for a high-frequency signal to be propagated through the dielectric waveguide 9141 can be adjusted, and a passband width for a high-frequency signal to be propagated through the dielectric waveguide 9141 can be adjusted. Further, an effect similar to that in the example of FIG. 1 and FIG. 2 can be obtained.

Example 6

In the example of FIG. 1 and FIG. 2 according to Example 1 of the first embodiment, description has been given of the dielectric filter in which the aperture 4002 to the aperture 4007 have the same aperture shape. However, the present invention is not limited thereto, and there may be employed a dielectric filter in which the apertures have different aperture shapes.

Figure 12:
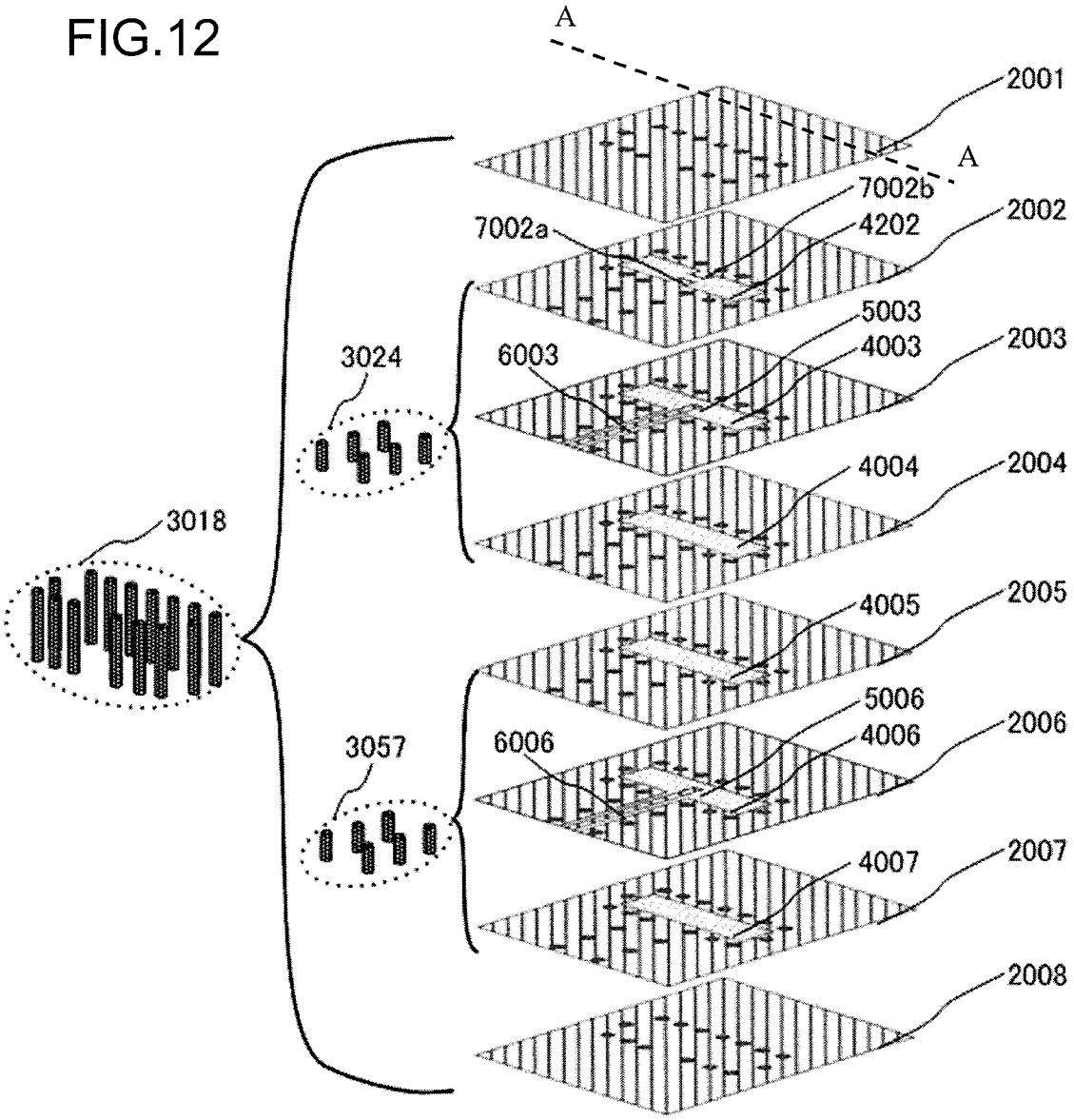
FIG. 12 is an exploded perspective view for illustrating an array of portions of a dielectric filter according to Example 6 of the first embodiment of the present invention.
Figure 13:
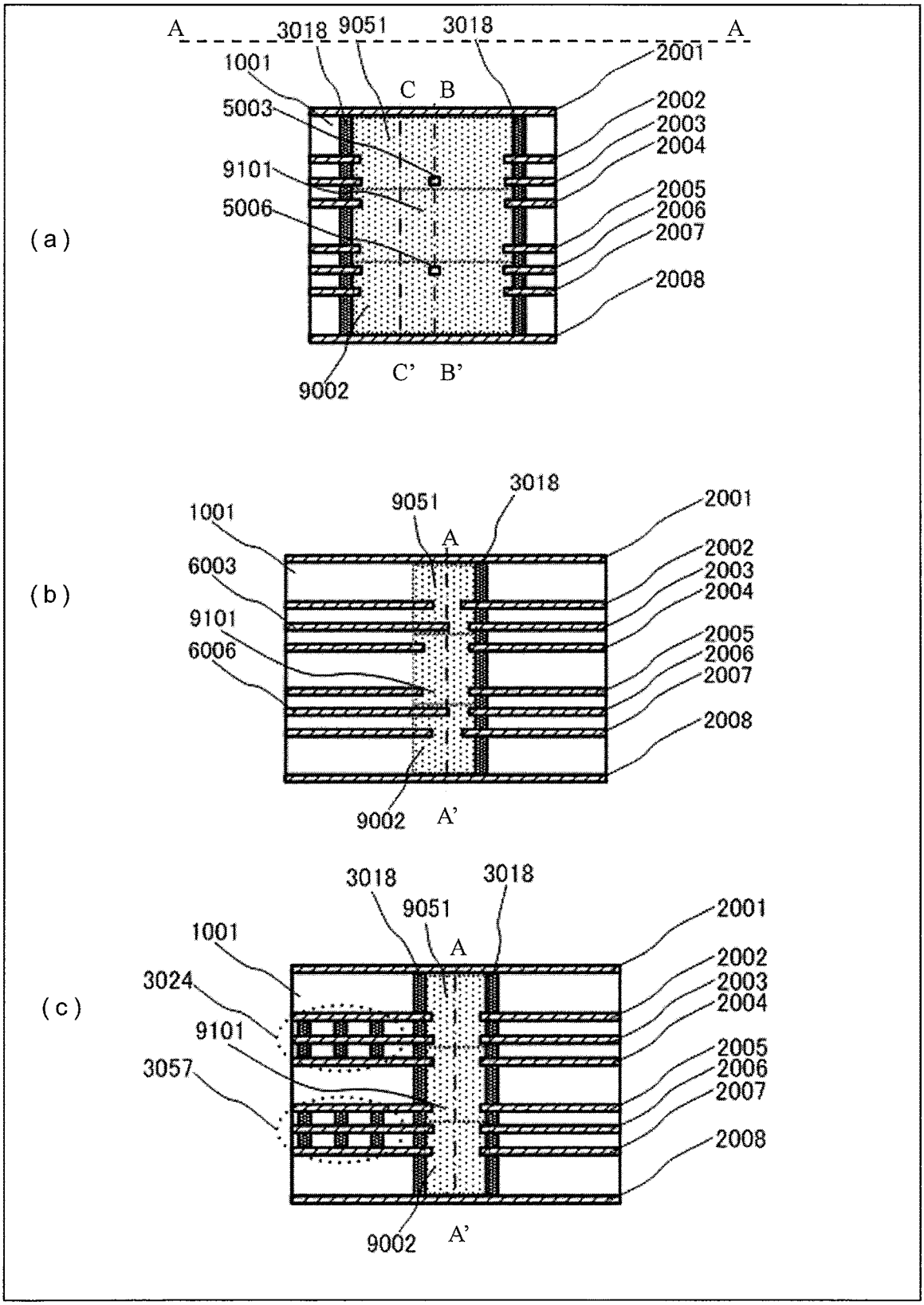
FIG. 13 is a vertical sectional view for illustrating the dielectric filter according to Example 6 of the first embodiment of the present invention.

FIG. 12 and FIG. 13 are views for illustrating a dielectric filter according to the first embodiment of the present invention in which the aperture of the conductor layer in the dielectric waveguide part (back-short) from the probe to the short-circuit surface in the strip line-waveguide converter is formed into a dumbbell shape.

FIG. 12 is an exploded perspective view for illustrating an array of conductor layers, strip lines, probes, vias, apertures, and the like.

Part (a) of FIG. 13 is a vertical sectional view taken along the line A-A of FIG. 12.

Part (b) of FIG. 13 is a vertical sectional view taken along the line B-B' of part (a) of FIG. 13.

Part (c) of FIG. 13 is a vertical sectional view taken along the line C-C' of part (a) of FIG. 13.

In the example of FIG. 12 and FIG. 13, an aperture 4202 is formed by eliminating a part of the conductor layer 2002 into a dumbbell shape.

In this case, the dumbbell shape refers to a shape in which, as illustrated in FIG. 12, a width of a center portion in a longitudinal direction of the elongated aperture 4202 is narrowed as parts represented by recessed portions 7002*a* and 7002*b*.

From the planar direction to the laminating direction of the multilayer dielectric substrate 1001, a strip line-waveguide converter 9051 is formed of the conductor layer 2001, the conductor layer 2002, the conductor layer 2003, the vias 3018, the probe 5003, the aperture 4202, and the aperture 4003.

The strip line-waveguide converter 9051 and the strip line-waveguide converter 9002 are electromagnetically connected to each other via the dielectric waveguide 9101.

In the example of FIG. 12 and FIG. 13 according to Example 6 of the first embodiment, the aperture 4202 is formed into a dumbbell aperture shape. In this manner, as compared to the example of FIG. 1 and FIG. 2 according to the first embodiment, a guide wavelength of the dielectric waveguide part from the probe 5003 to the conductor layer 2001 serving as the short-circuit surface in the strip line-waveguide converter 9051 can be decreased. Therefore, the degree of design freedom can be improved. Further, an effect similar to that in the example of FIG. 1 and FIG. 2 can be obtained.

Example 7

Figure 14:
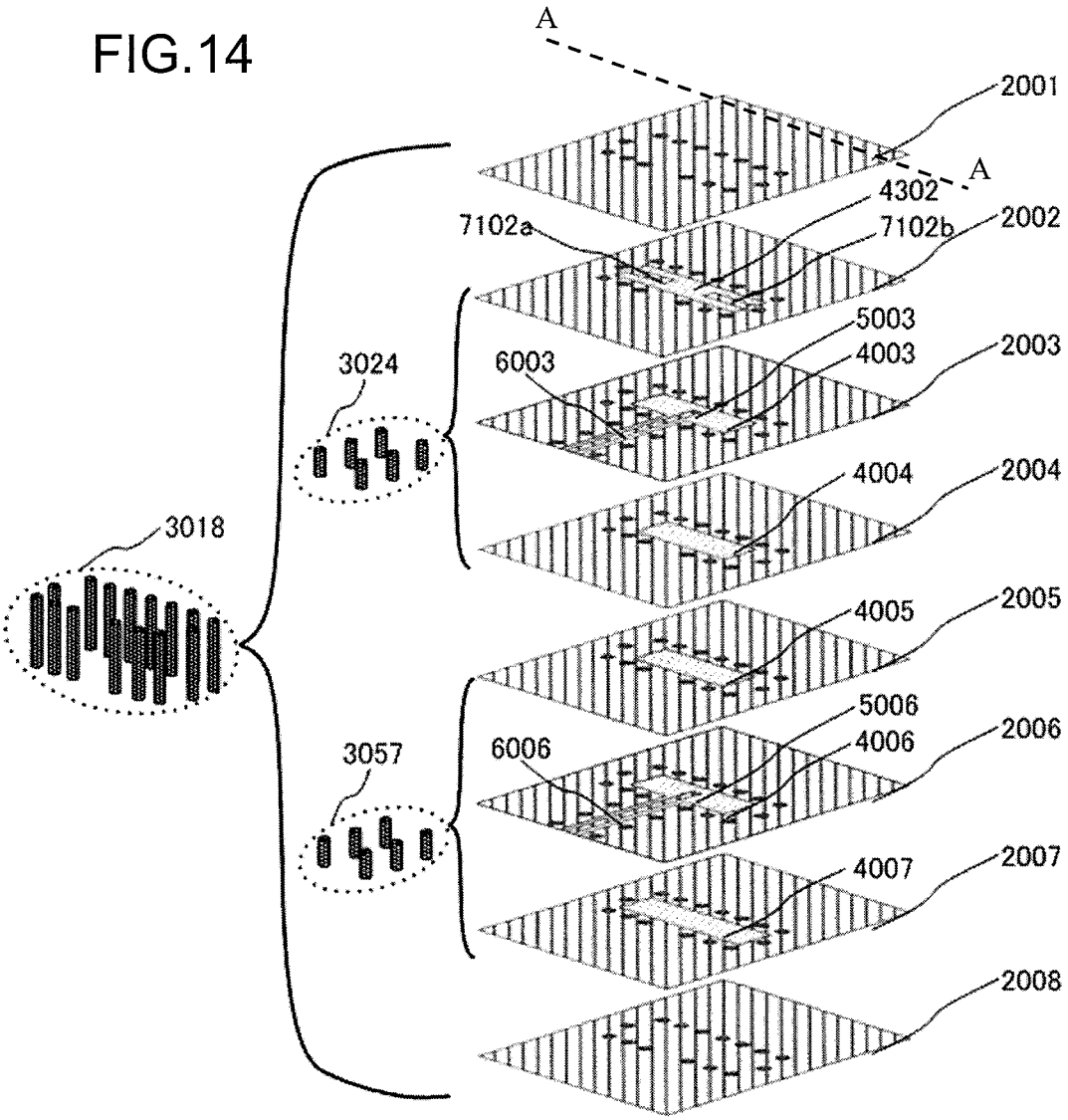
FIG. 14 is an exploded perspective view for illustrating an array of portions of a dielectric filter according to Example 7 of the first embodiment of the present invention.
Figure 15:
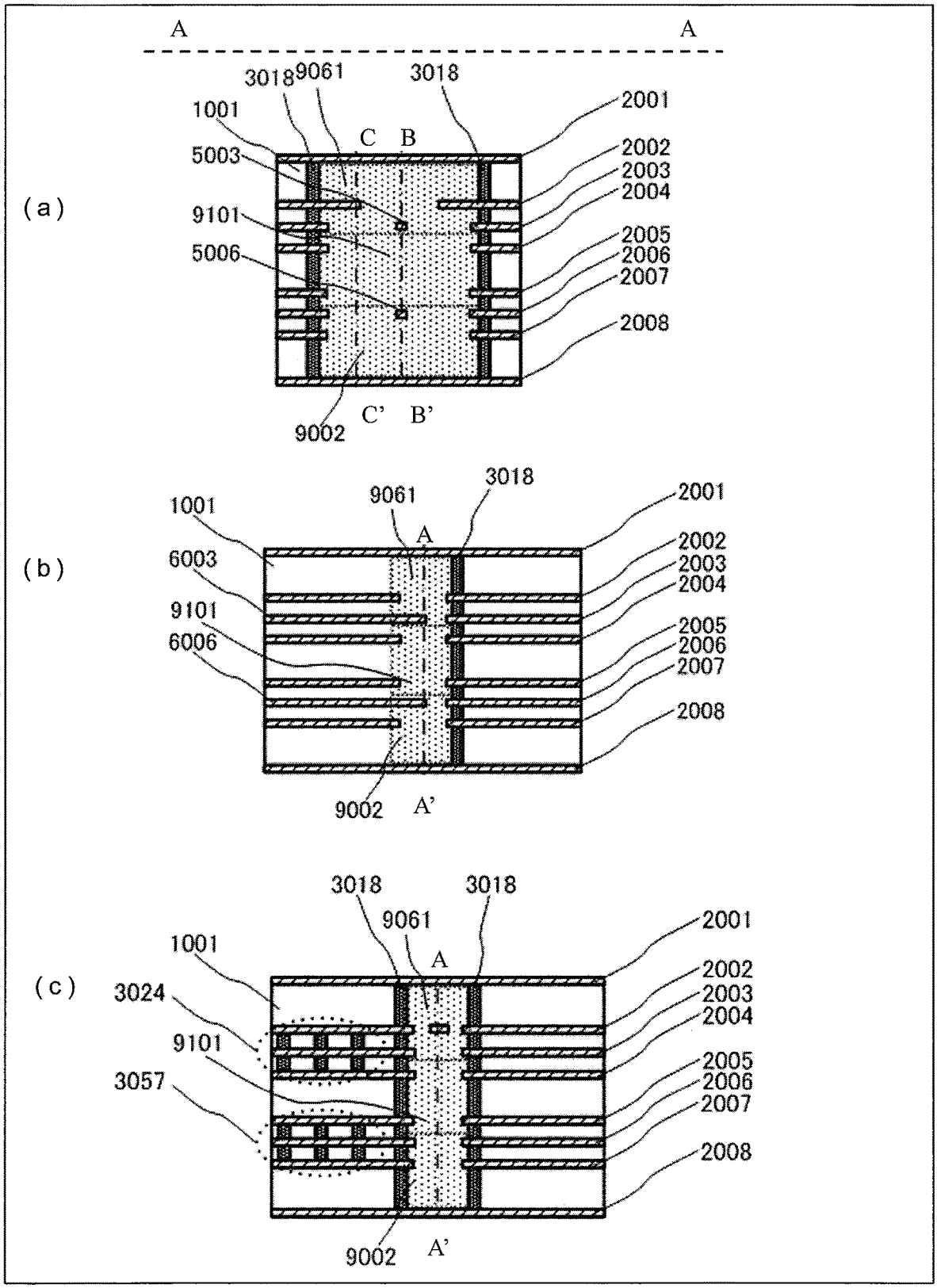
FIG. 15 is a vertical sectional view for illustrating the dielectric filter according to Example 7 of the first embodiment of the present invention.

FIG. 14 and FIG. 15 are views for illustrating a dielectric filter according to the first embodiment of the present invention in which the aperture of the conductor layer in the dielectric waveguide part (back-short) from the probe to the short-circuit surface in the strip line-waveguide converter has an H-shape.

FIG. 14 is an exploded perspective view for illustrating an array of conductor layers, strip lines, probes, vias, apertures, and the like.

Part (a) of FIG. 15 is a vertical sectional view taken along the line A-A of FIG. 14.

Part (b) of FIG. 15 is a vertical sectional view taken along the line B-B' of part (a) of FIG. 15.

Part (c) of FIG. 15 is a vertical sectional view taken along the line C-C' of part (a) of FIG. 15.

In the example of FIG. 14 and FIG. 15, an aperture 4302 is formed by eliminating a part of the conductor layer 2002 into an H shape.

In this case, the H shape refers to a shape in which, as illustrated in FIG. 14, a width of a center portion in a transverse direction of the elongated aperture 4302 is narrowed as parts represented by recessed portions 7102*a* and 7102*b*.

From the planar direction to the laminating direction of the multilayer dielectric substrate 1001, a strip line-waveguide converter 9061 is formed of the conductor layer 2001, the conductor layer 2002, the conductor layer 2003, the vias 3018, the probe 5003, the aperture 4302, and the aperture 4003.

The strip line-waveguide converter 9061 and the strip line-waveguide converter 9002 are electromagnetically connected to each other via the dielectric waveguide 9101.

In the example of FIG. 14 and FIG. 15 according to the first embodiment of the present invention, the aperture 4302 is formed into an H aperture shape. In this manner, as compared to the example of FIG. 1 and FIG. 2 according to the first embodiment, a guide wavelength of the dielectric waveguide part from the probe 5003 to the conductor layer 2001 serving as the short-circuit surface in the strip line-waveguide converter 9061 can be increased. Therefore, the degree of design freedom can be improved. Further, an effect similar to that in the example of FIG. 1 and FIG. 2 can be obtained.

Example 8

In the example of FIG. 1 and FIG. 2 according to Example 1 of the first embodiment, description has been given of the dielectric filter in which the aperture 4002 to the aperture 4007 have a rectangular aperture shape. However, the present invention is not limited thereto, and there may be employed a dielectric filter in which the aperture has any shape.

Figure 16:
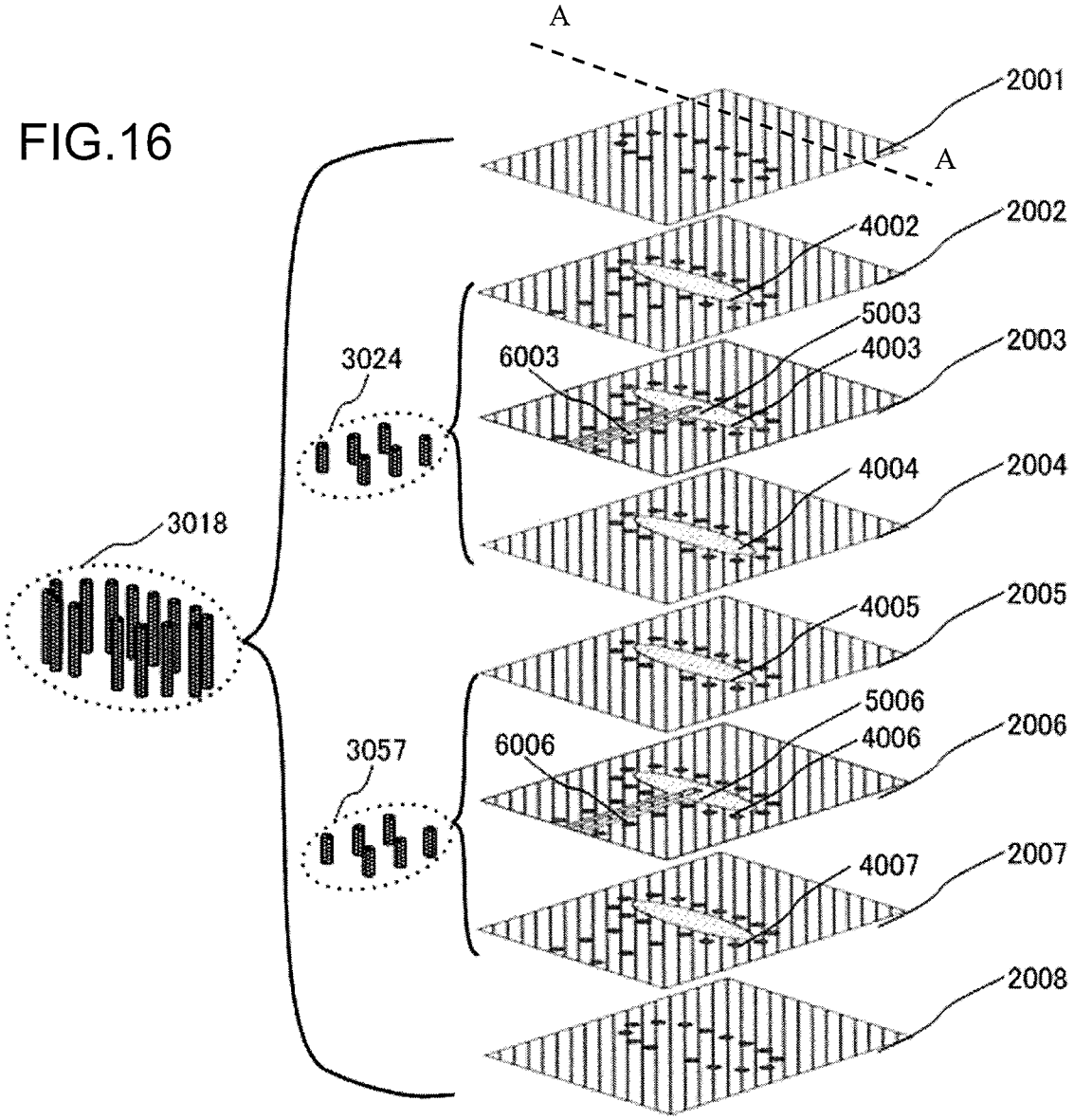
FIG. 16 is an exploded perspective view for illustrating an array of portions of a dielectric filter according to Example 8 of the first embodiment of the present invention.
Figure 17:
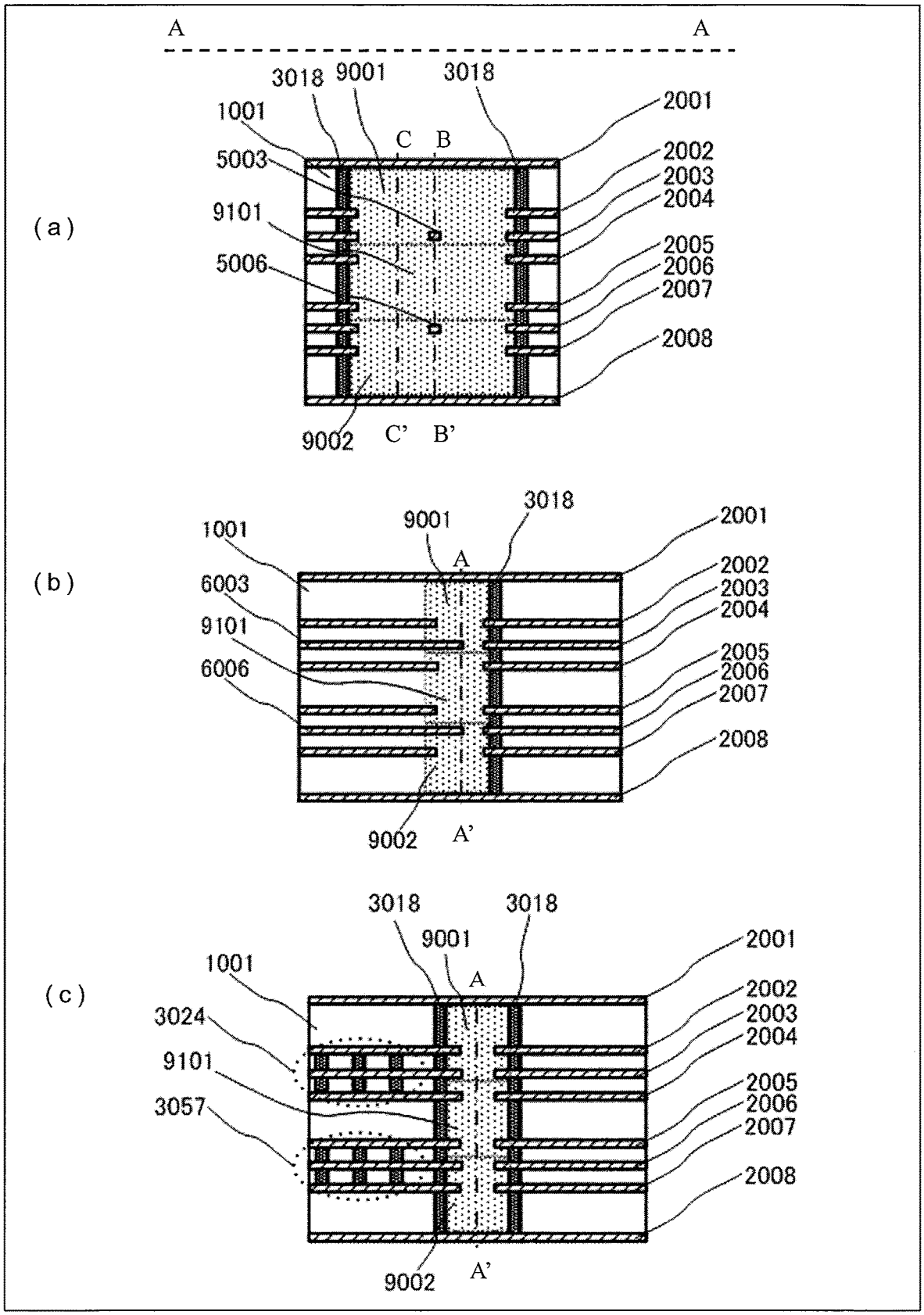
FIG. 17 is a vertical sectional view for illustrating the dielectric filter according to Example 8 of the first embodiment of the present invention.

FIG. 16 and FIG. 17 are views for illustrating a dielectric filter according to the first embodiment of the present invention in which each aperture is formed into an elliptical shape.

FIG. 16 is an exploded perspective view for illustrating an array of conductor layers, strip lines, probes, vias, apertures, and the like.

Part (a) of FIG. 17 is a vertical sectional view taken along the line A-A of FIG. 16.

Part (b) of FIG. 17 is a vertical sectional view taken along the line B-B' of part (a) of FIG. 17.

Part (c) of FIG. 17 is a vertical sectional view taken along the line C-C' of part (a) of FIG. 17.

In the example of FIG. 16 and FIG. 17 according to Example 8 of the first embodiment, the aperture 4002 to the aperture 4007 are formed into an elliptical shape. In this manner, the degree of design freedom can be improved, and an effect similar to that in the example of FIG. 1 and FIG. 2 can be obtained.

Second Embodiment

Example 1

In the above-mentioned first embodiment, description has been given of the dielectric filter including two strip line-waveguide converters and a dielectric waveguide. However, the present invention is not limited thereto, and there may be employed a dielectric filter having a structure in which a filter function is added to the strip line-waveguide converters or the dielectric waveguide.

Figure 18:
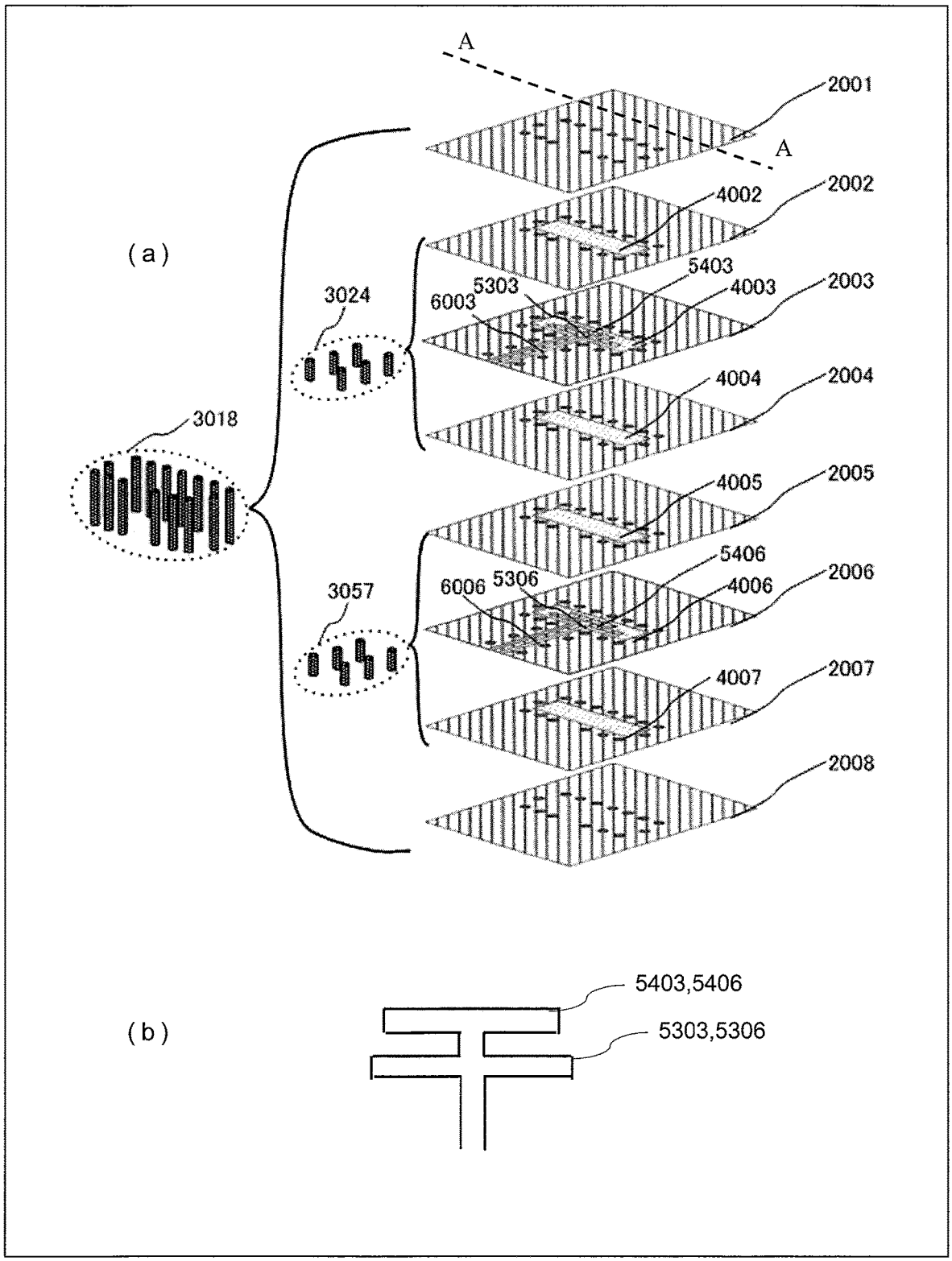
FIG. 18 is an exploded perspective view for illustrating an array of portions of a dielectric filter according to Example 1 of a second embodiment of the present invention.
Figure 19:
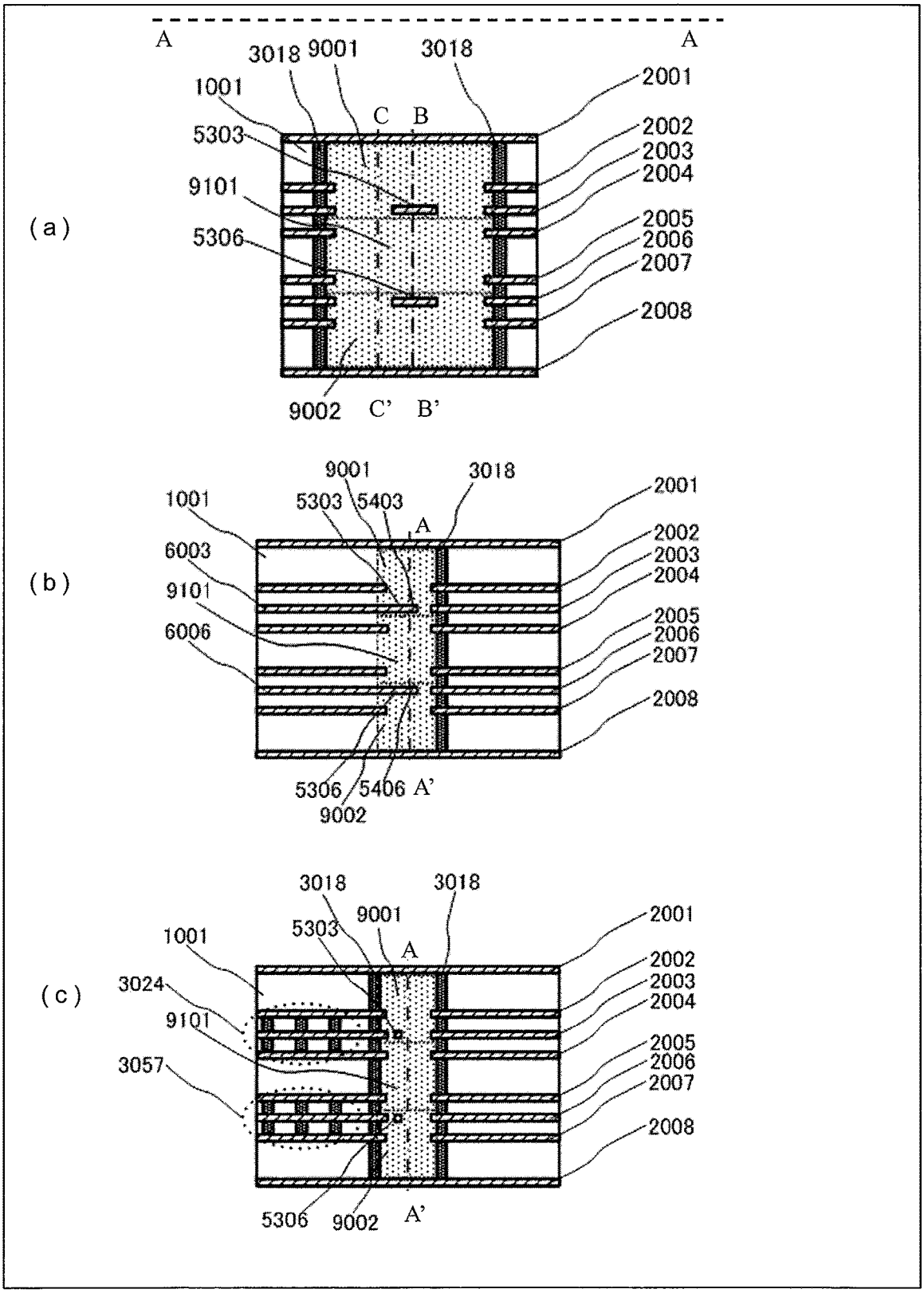
FIG. 19 is a vertical sectional view for illustrating the dielectric filter according to Example 1 of the second embodiment of the present invention.

FIG. 18 and FIG. 19 are views for illustrating a dielectric filter according to a second embodiment of the present invention in which, as a resonator, a resonance conductor is added to the probe of the strip line-waveguide converter.

Part (a) of FIG. 18 is an exploded perspective view for illustrating an array of conductor layers, strip lines, probes, resonance conductors, vias, apertures, and the like. Part (b) of FIG. 18 is an enlarged view of the probe.

Part (a) of FIG. 19 is a vertical sectional view taken along the line A-A of FIG. 18.

Part (b) of FIG. 19 is a vertical sectional view taken along the line B-B' of part (a) of FIG. 19.

Part (c) of FIG. 19 is a vertical sectional view taken along the line C-C' of part (a) of FIG. 19.

In FIG. 18 and FIG. 19, a probe 5303 has one end connected to the strip line 6003, and another end connected to a resonance conductor 5403 arranged in the aperture 4003 as illustrated in part (b) of FIG. 18.

A probe 5306 has one end connected to the strip line 6006, and another end connected to a resonance conductor 5406 arranged in the aperture 4006 as illustrated in part (b) of FIG. 18.

The resonance conductor 5403 is formed so that a length from one end connected to the probe 5303 to each open end as a destination of the branch corresponds to ¼ wavelength of a frequency at which propagation of a high-frequency signal is desired to be blocked.

The resonance conductor 5406 is formed so that a length from one end connected to the probe 5306 to each open end as a destination of the branch corresponds to ¼ wavelength of a frequency at which propagation of a high-frequency signal is desired to be blocked.

In the example of FIG. 18 and FIG. 19 according to Example 1 of the second embodiment, the resonance conductor 5403 is provided with respect to the probe 5303 in the strip line-waveguide converter 9001, and the resonance conductor 5406 is provided with respect to the probe 5306 in the strip line-waveguide converter 9002. In this manner, a bandstop-type filter function for blocking propagation of a high-frequency signal at a frequency corresponding to the lengths of the resonance conductor 5403 and the resonance conductor 5406 can be added. Further, an effect similar to that in the example of FIG. 1 and FIG. 2 of the above-mentioned first embodiment can be obtained.

Example 2

In the example of FIG. 18 and FIG. 19 according to Example 1 of the second embodiment, description has been given of the dielectric filter in which the resonator is added to the probe of the strip line-waveguide converter. However, the present invention is not limited thereto, and there may be employed a dielectric filter having a structure in which a resonator is added to the dielectric waveguide.

Figure 20:
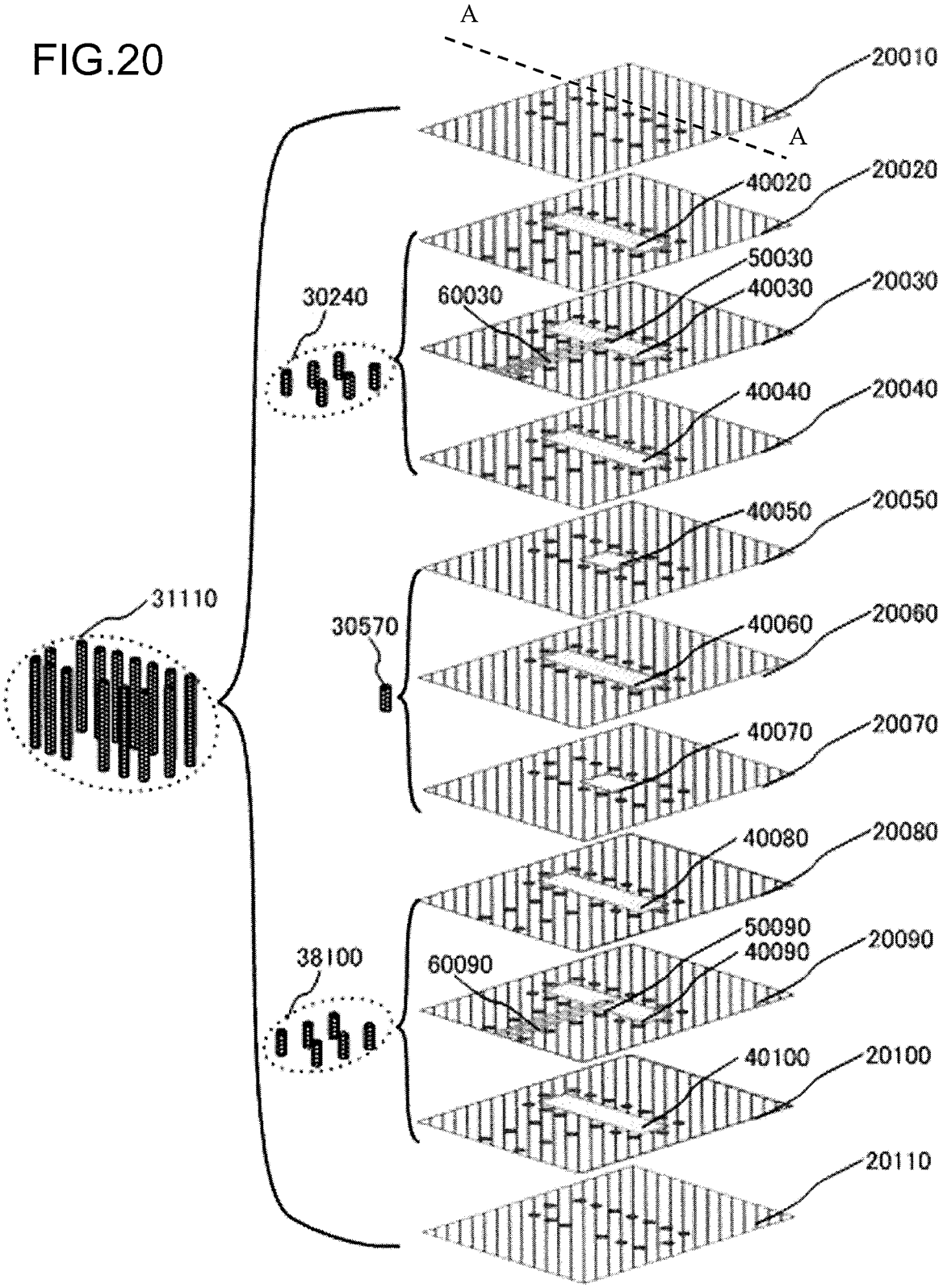
FIG. 20 is an exploded perspective view for illustrating an array of portions of a dielectric filter according to Example 2 of the second embodiment of the present invention.
Figure 21:
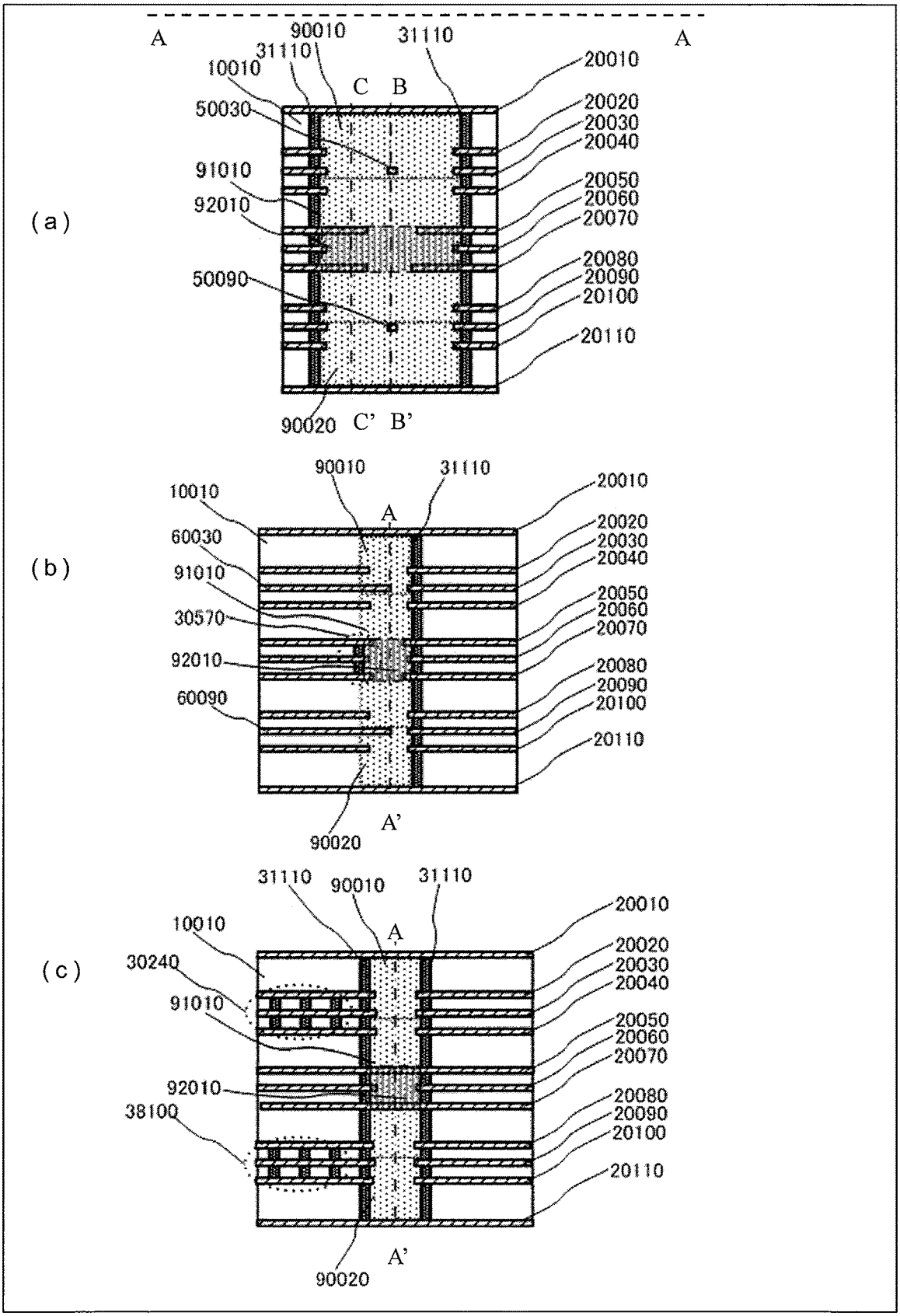
FIG. 21 is a vertical sectional view for illustrating the dielectric filter according to Example 2 of the second embodiment of the present invention.

FIG. 20 and FIG. 21 are views for illustrating a dielectric filter according to the second embodiment of the present invention in which a part of the dielectric waveguide is formed as a resonator (resonance space).

FIG. 20 is an exploded perspective view for illustrating an array of conductor layers, strip lines, probes, a resonator (resonance space), vias, apertures, and the like.

Part (a) of FIG. 21 is a vertical sectional view taken along the line A-A of FIG. 20.

Part (b) of FIG. 21 is a vertical sectional view taken along the line B-B' of part (a) of FIG. 21.

Part (c) of FIG. 21 is a vertical sectional view taken along the line C-C' of part (a) of FIG. 21.

In FIG. 20 and FIG. 21, in a multilayer dielectric substrate 10010, there are provided:

a conductor layer 20010, a conductor layer 20020, a conductor layer 20030, a conductor layer 20040, a conductor layer 20050, a conductor layer 20060, a conductor layer 20070, a conductor layer 20080, a conductor layer 20090, a conductor layer 20100, and a conductor layer 20110;

vias 31110, vias 30240, vias 38100, and vias 30570; and a strip line 60030, a strip line 60090, a probe 50030, and a probe 50090.

The conductor layer 20010 is arranged on a surface layer of the multilayer dielectric substrate 10010.

The conductor layer 20020 is arranged in an inner layer of the multilayer dielectric substrate 10010 so as to face the conductor layer 20010.

The conductor layer 20030 is arranged in the inner layer of the multilayer dielectric substrate 10010 so as to face the conductor layer 20020 facing the conductor layer 20010 on its back surface side.

The conductor layer 20040 is arranged in the inner layer of the multilayer dielectric substrate 10010 so as to face the conductor layer 20030 facing the conductor layer 20020 on its back surface side.

The conductor layer 20050 is arranged in the inner layer of the multilayer dielectric substrate 10010 so as to face the conductor layer 20040 facing the conductor layer 20030 on its back surface side.

The conductor layer 20060 is arranged in the inner layer of the multilayer dielectric substrate 10010 so as to face the conductor layer 20050 facing the conductor layer 20040 on its back surface side.

The conductor layer 20070 is arranged in the inner layer of the multilayer dielectric substrate 10010 so as to face the conductor layer 20060 facing the conductor layer 20050 on its back surface side.

The conductor layer 20080 is arranged in the inner layer of the multilayer dielectric substrate 10010 so as to face the conductor layer 20070 facing the conductor layer 20060 on its back surface side.

The conductor layer 20090 is arranged in the inner layer of the multilayer dielectric substrate 10010 so as to face the conductor layer 20080 facing the conductor layer 20070 on its back surface side.

The conductor layer 20100 is arranged in the inner layer of the multilayer dielectric substrate 10010 so as to face the conductor layer 20090 facing the conductor layer 20080 on its back surface side.

The conductor layer 20110 is arranged on a surface layer of the multilayer dielectric substrate 10010 on a side opposite to the side on which the conductor layer 20010 is arranged, so as to face the conductor layer 20100 facing the conductor layer 20090 on its back surface side.

The conductor layer 20020 to the conductor layer 20100 have an aperture 40020 to an aperture 40100, respectively, which are formed by eliminating parts of the conductor layer 20020 to the conductor layer 20100.

The aperture 40020 to the aperture 40100 are arranged so as to oppose each other. That is, the aperture 40020 to the aperture 40100 are positioned so as to overlap each other in the laminating direction.

The inner side of each of the aperture 40020 to the aperture 40100 is not a cavity. For example, the aperture 40020 to the aperture 40100 are filled with a dielectric body similarly to the multilayer dielectric substrate 10010 on the outer sides of the vias 31110 on both sides in part (a) of FIG. 21. This state is represented in a dot pattern.

The strip line 60030 is formed by eliminating a part of the conductor layer 20030.

The strip line 60090 is formed by eliminating a part of the conductor layer 20090.

The probe 50030 has one end connected to the strip line 60030, and another end arranged in the aperture 40030.

The probe 50090 has one end connected to the strip line 60090, and another end arranged in the aperture 40090.

A plurality of vias 31110 are arranged so as to surround the aperture 40020 to the aperture 40010 except for a part corresponding to the strip line 60030 and the strip line 60090, and to extend from the conductor layer 20010 to the conductor layer 20110 to pass through the multilayer dielectric substrate 10010 and the conductor layer 20020 to the conductor layer 20100.

A plurality of vias 30240 are arranged along both longitudinal side surfaces of the strip line 60030 along the laminating direction, and extend from the conductor layer 20020 to the conductor layer 20040 to pass through the multilayer dielectric substrate 10010 and the conductor layer 20030.

A plurality of vias 30570 are arranged in a part of an edge of each of the aperture 40050, the aperture 40060, and the aperture 40070 so as to extend from the conductor layer 20050 to the conductor layer 20070 to pass through the multilayer dielectric substrate 10010 and the conductor layer 20060.

A plurality of vias 38100 are arranged along both longitudinal side surfaces of the strip line 60090 along the laminating direction, and extend from the conductor layer 20080 to the conductor layer 20110 to pass through the multilayer dielectric substrate 10010 and the conductor layer 20090.

From the planar direction to the laminating direction of the multilayer dielectric substrate 10010, a strip line-waveguide converter 90010 is formed of the conductor layer 20010, the conductor layer 20020, the conductor layer 20030, the vias 31110, the probe 50030, the aperture 40020, and the aperture 40030.

From the planar direction to the laminating direction of the multilayer dielectric substrate 10010, a strip line-waveguide converter 90020 is formed of the conductor layer 20090, the conductor layer 20100, the conductor layer 20110, the vias 31110, the probe 50090, the aperture 40090, and the aperture 40100.

In the laminating direction of the multilayer dielectric substrate 10010, a dielectric waveguide 91010 is formed of the conductor layer 20040, the conductor layer 20050, the conductor layer 20060, the conductor layer 20070, the conductor layer 20080, the vias 31110, the vias 30570, the aperture 40040, the aperture 40050, the aperture 40060, the aperture 40070, and the aperture 40080.

The aperture diameters of the aperture 40050 and the aperture 40070 of the dielectric waveguide 91010 are smaller than the aperture diameter of the aperture 40060. Therefore, in a part of the dielectric waveguide 91010, a resonance space 92010 is formed of the conductor layer 20050, the conductor layer 20060, the conductor layer 20070, the vias 31110, the vias 30570, the aperture 40050, the aperture 40060, and the aperture 40070.

The strip line-waveguide converter 90010 and the strip line-waveguide converter 90020 are electromagnetically connected to each other via the dielectric waveguide 91010.

In the example of FIG. 20 and FIG. 21 according to the second embodiment, a part of the dielectric waveguide 91010 is formed as the resonance space 92010. In this manner, a bandpass-type filter function for propagating a high-frequency signal having a frequency corresponding to the size of the resonance space 92010 can be added to the dielectric waveguide 91010. Further, an effect similar to that in the example of FIG. 1 and FIG. 2 in the above-mentioned first embodiment can be obtained.

Example 3

In the example of FIG. 20 and FIG. 21 according to Example 2 of the second embodiment, description has been given of the dielectric filter in which a part of the dielectric waveguide 91010 is formed as the resonance space 92010. However, the present invention is not limited thereto, and there may be employed a dielectric filter in which a resonance conductor is added to the dielectric waveguide 91010.

Figure 22:
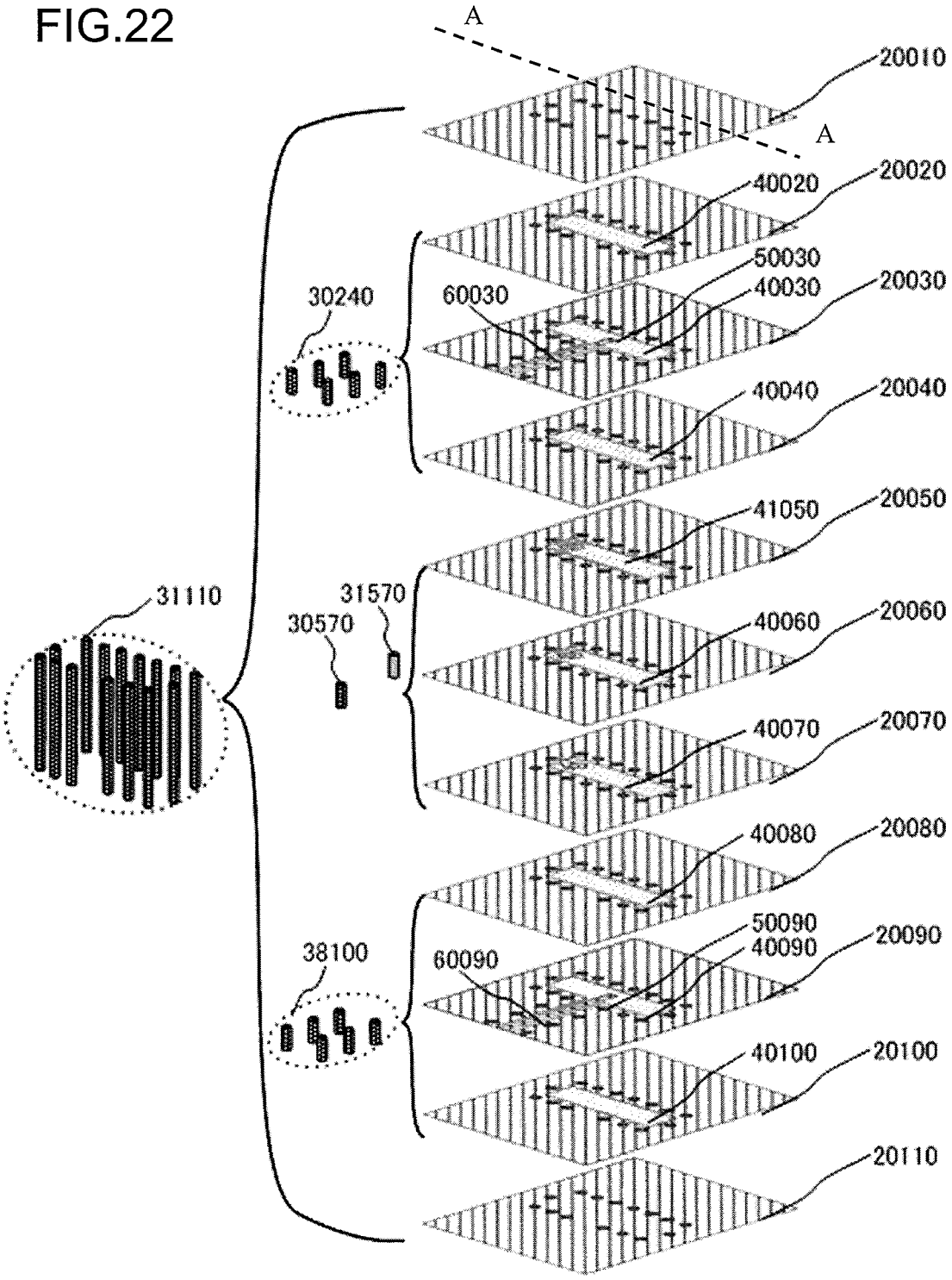
FIG. 22 is an exploded perspective view for illustrating an array of portions of a dielectric filter according to Example 3 of the second embodiment of the present invention.
Figure 23:
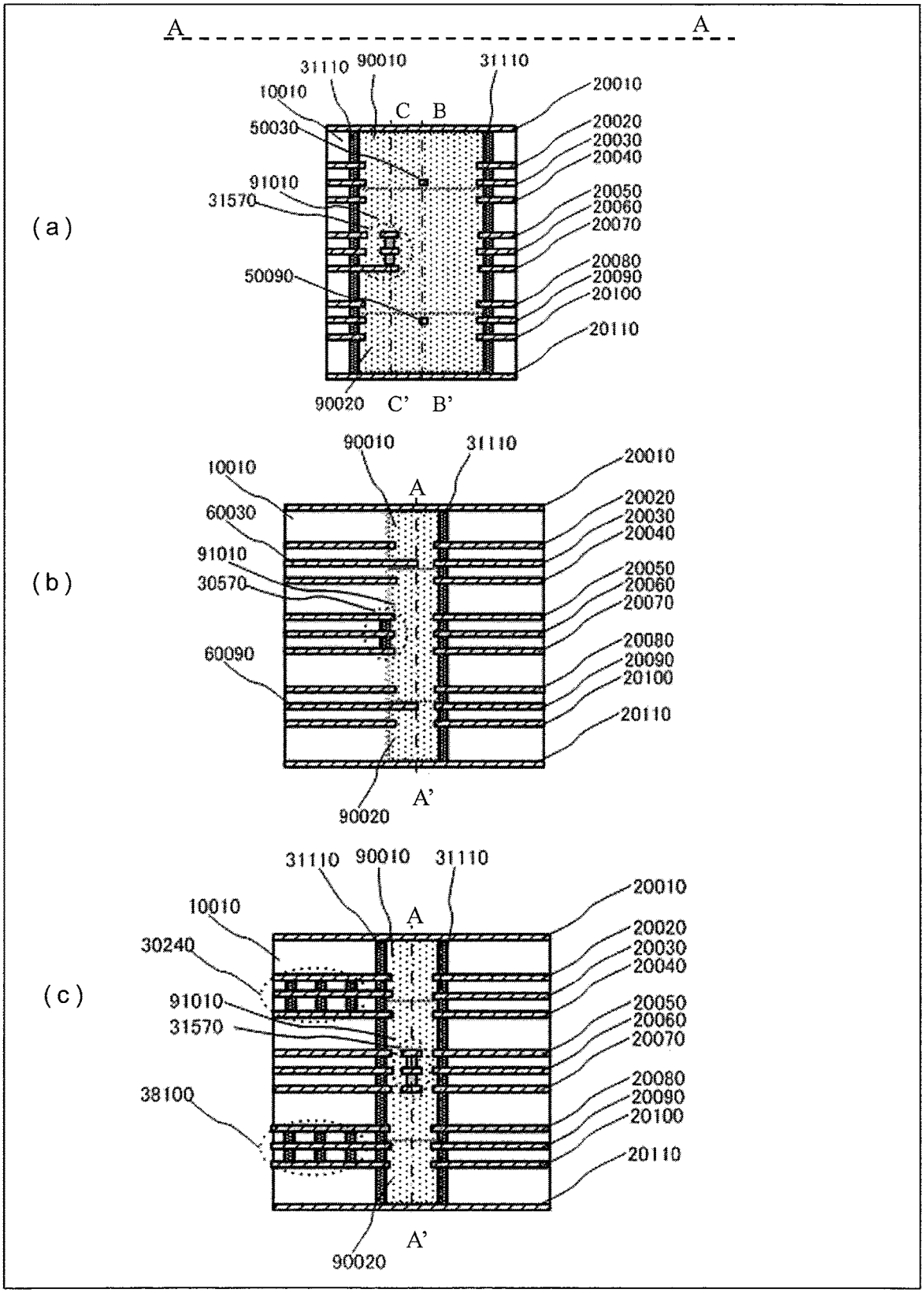
FIG. 23 is a vertical sectional view for illustrating the dielectric filter according to Example 3 of the second embodiment of the present invention.

FIG. 22 and FIG. 23 are views for illustrating a dielectric filter according to the second embodiment of the present invention including a conductor having one end that is short-circuited to the dielectric waveguide and also having a length corresponding to ¼ wavelength of a frequency at which propagation of a high-frequency signal is desired to be blocked.

FIG. 22 is an exploded perspective view for illustrating an array of conductor layers, strip lines, probes, vias, resonance conductors, apertures, and the like.

Part (a) of FIG. 23 is a vertical sectional view taken along the line A-A of FIG. 22.

Part (b) of FIG. 23 is a vertical sectional view taken along the line B-B' of part (a) of FIG. 23.

Part (c) of FIG. 23 is a vertical sectional view taken along the line C-C' of part (a) of FIG. 23.

The dielectric waveguide 91010 includes a resonance conductor 31570 having a length from the planar direction to the laminating direction of the multilayer dielectric substrate 10010, which corresponds to ¼ wavelength of a frequency at which propagation of a high-frequency signal is desired to be blocked. Further, the resonance conductor 31570 has one end connected to the conductor layer 20070, and another end arranged in the conductor layer 20050.

In the example of FIG. 22 and FIG. 23 according to Example 3 of the second embodiment, the dielectric waveguide 91010 includes the resonance conductor 31570. In this manner, a bandstop-type filter function for blocking propagation of a high-frequency signal at a frequency corresponding to the lengths of the resonance conductor 31570 can be added. Further, an effect similar to that in the example of FIG. 1 and FIG. 2 of the above-mentioned first embodiment can be obtained.

Example 4

In the example of FIG. 22 and FIG. 23 according to Example 3 of the second embodiment, description has been given of the dielectric filter in which the resonance conductor is provided in the laminating direction of the dielectric waveguide 91010. However, the present invention is not limited thereto, and there may be employed a dielectric filter in which a conductor pattern is provided only in the planar direction of the dielectric waveguide.

Figure 24:
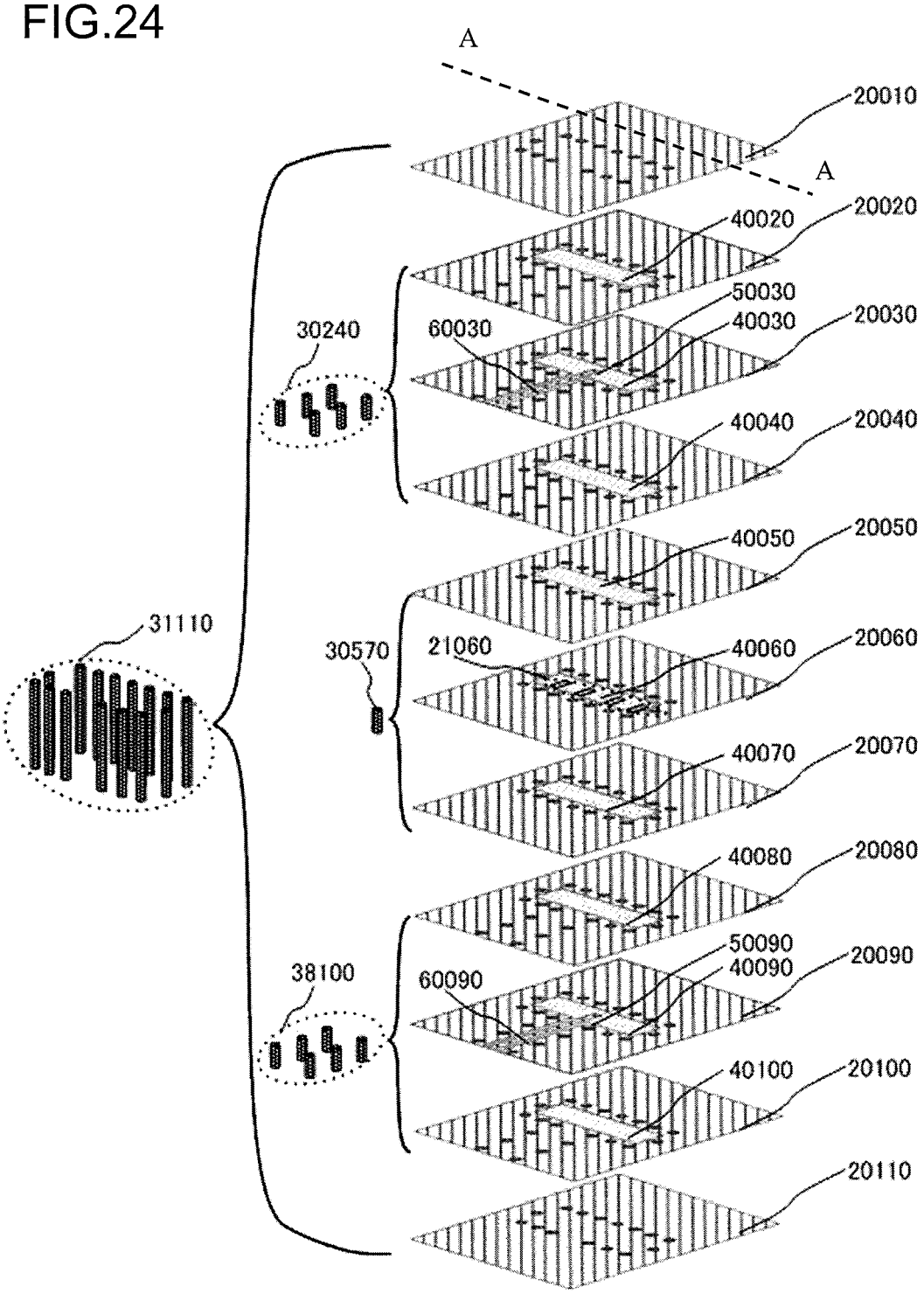
FIG. 24 is an exploded perspective view for illustrating an array of portions of a dielectric filter according to Example 4 of the second embodiment of the present invention.
Figure 25:
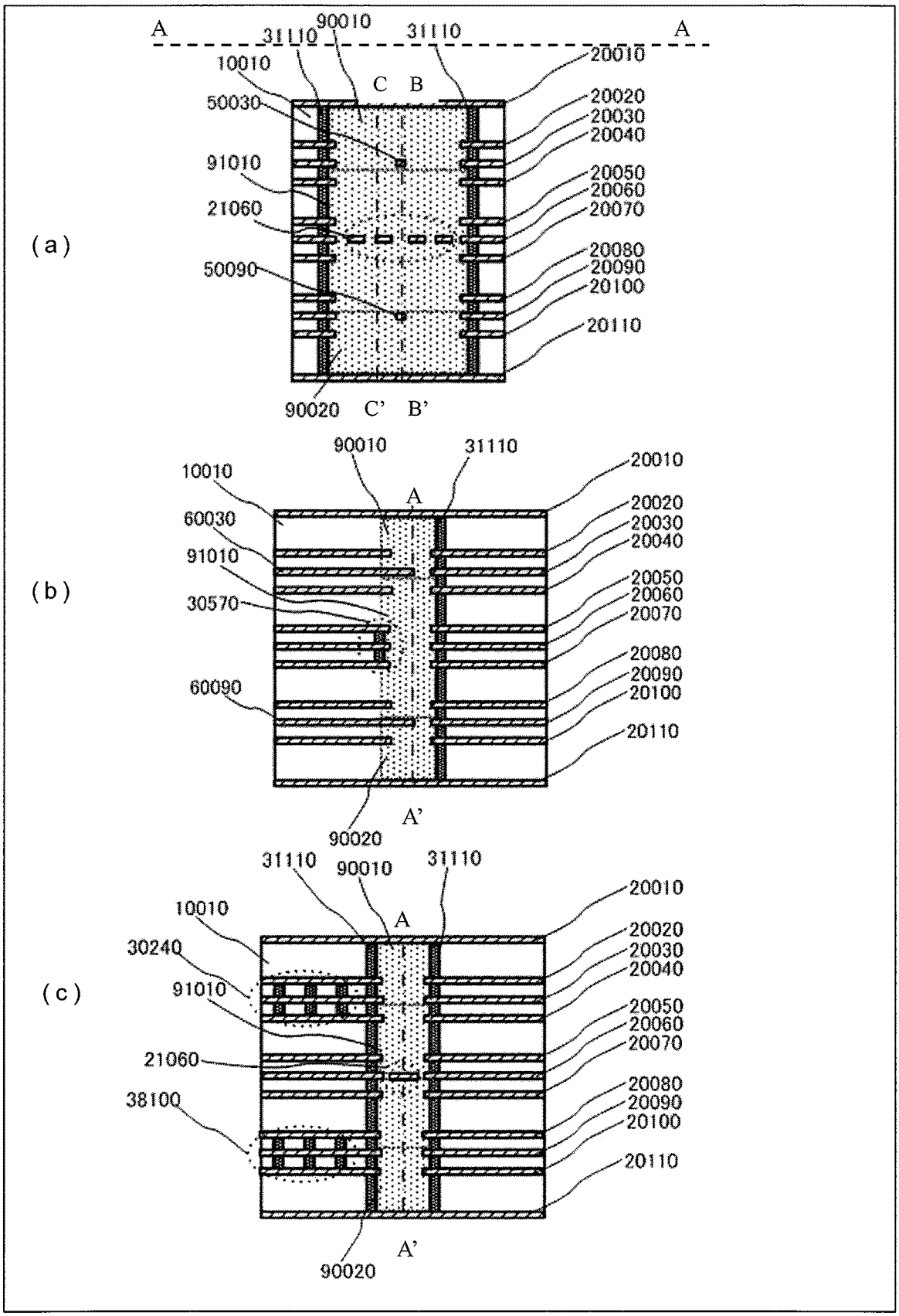
FIG. 25 is a vertical sectional view for illustrating the dielectric filter according to Example 4 of the second embodiment of the present invention.

FIG. 24 and FIG. 25 are views for illustrating a dielectric filter according to the second embodiment of the present invention in which the conductor pattern is provided only in the planar direction of the dielectric waveguide.

FIG. 24 is an exploded perspective view for illustrating an array of conductor layers, strip lines, probes, vias, conductor patterns, apertures, and the like.

Part (a) of FIG. 25 is a vertical sectional view taken along the line A-A of FIG. 24.

Part (b) of FIG. 25 is a vertical sectional view taken along the line B-B' of part (a) of FIG. 24.

Part (c) of FIG. 25 is a vertical sectional view taken along the line C-C' of part (a) of FIG. 24.

In the dielectric waveguide 91010, a conductor pattern 21060 is provided only in the planar direction of the dielectric waveguide. Other parts are the same as those in the example of FIG. 22 and FIG. 23.

In the example of FIG. 24 and FIG. 25 according to Example 4 of the second embodiment, the dielectric waveguide 91010 includes the conductor pattern 21060. In this manner, a bandstop-type filter function for blocking propagation of a high-frequency signal at a frequency corresponding to the conductor pattern 21060 can be added. Further, an effect similar to that in the example of FIG. 1 and FIG. 2 in the above-mentioned first embodiment can be obtained.

Example 5

In the example of FIG. 22 and FIG. 23 according to Example 3 of the second embodiment, description has been given of the dielectric filter including the resonance conductor 31570 having one end that is short-circuited to the dielectric waveguide 91010 and also having a length corresponding to ¼ wavelength of a frequency at which propagation of a high-frequency signal is desired to be blocked. However, the present invention is not limited thereto, and there may be employed a dielectric filter including a resonance conductor having both ends that are opened in the dielectric waveguide 91010 and also having a length corresponding to half wavelength of a frequency at which propagation of a high-frequency signal is desired to be blocked.

Figure 26:
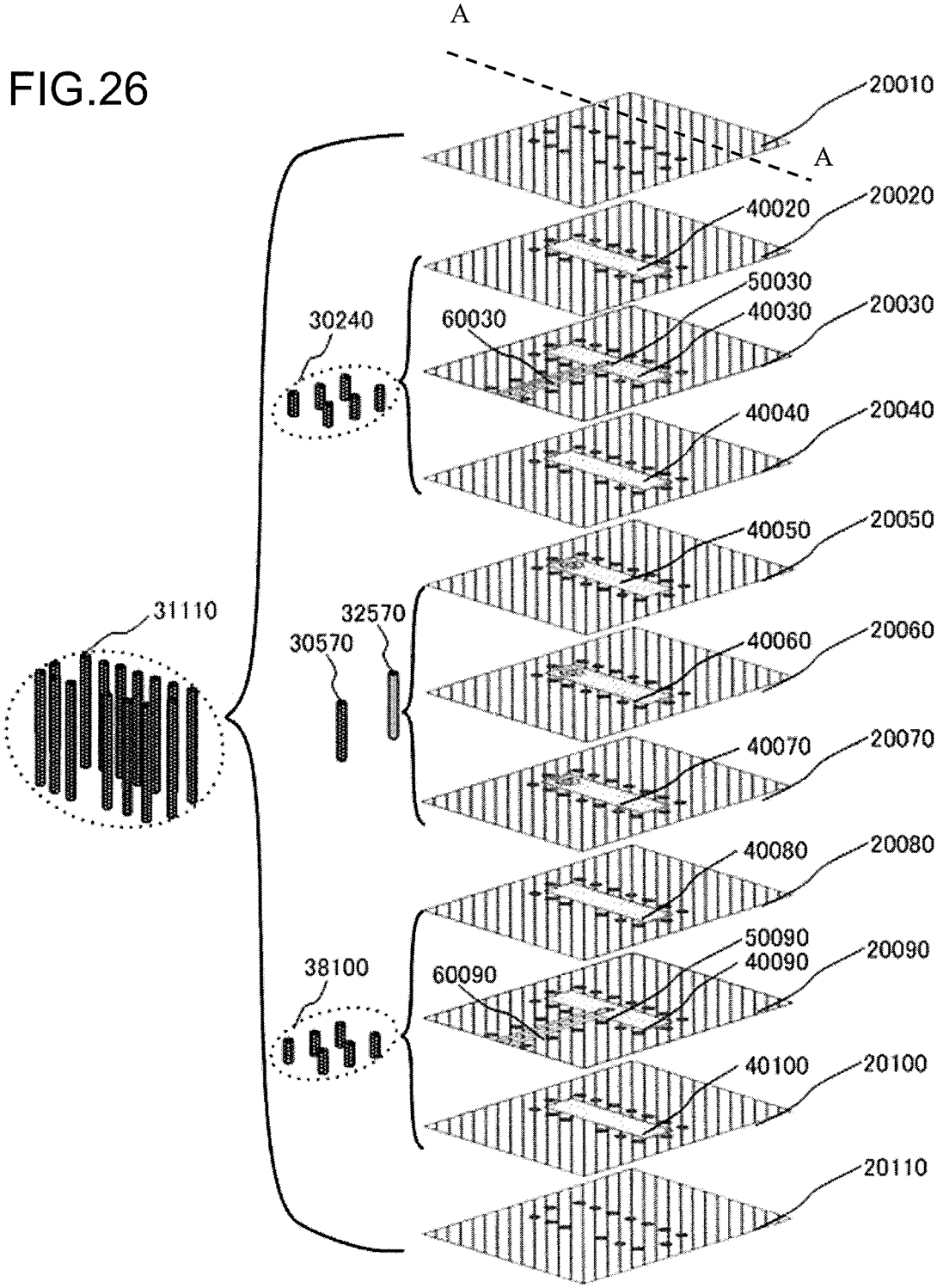
FIG. 26 is an exploded perspective view for illustrating an array of portions of a dielectric filter according to Example 5 of the second embodiment of the present invention.
Figure 27:
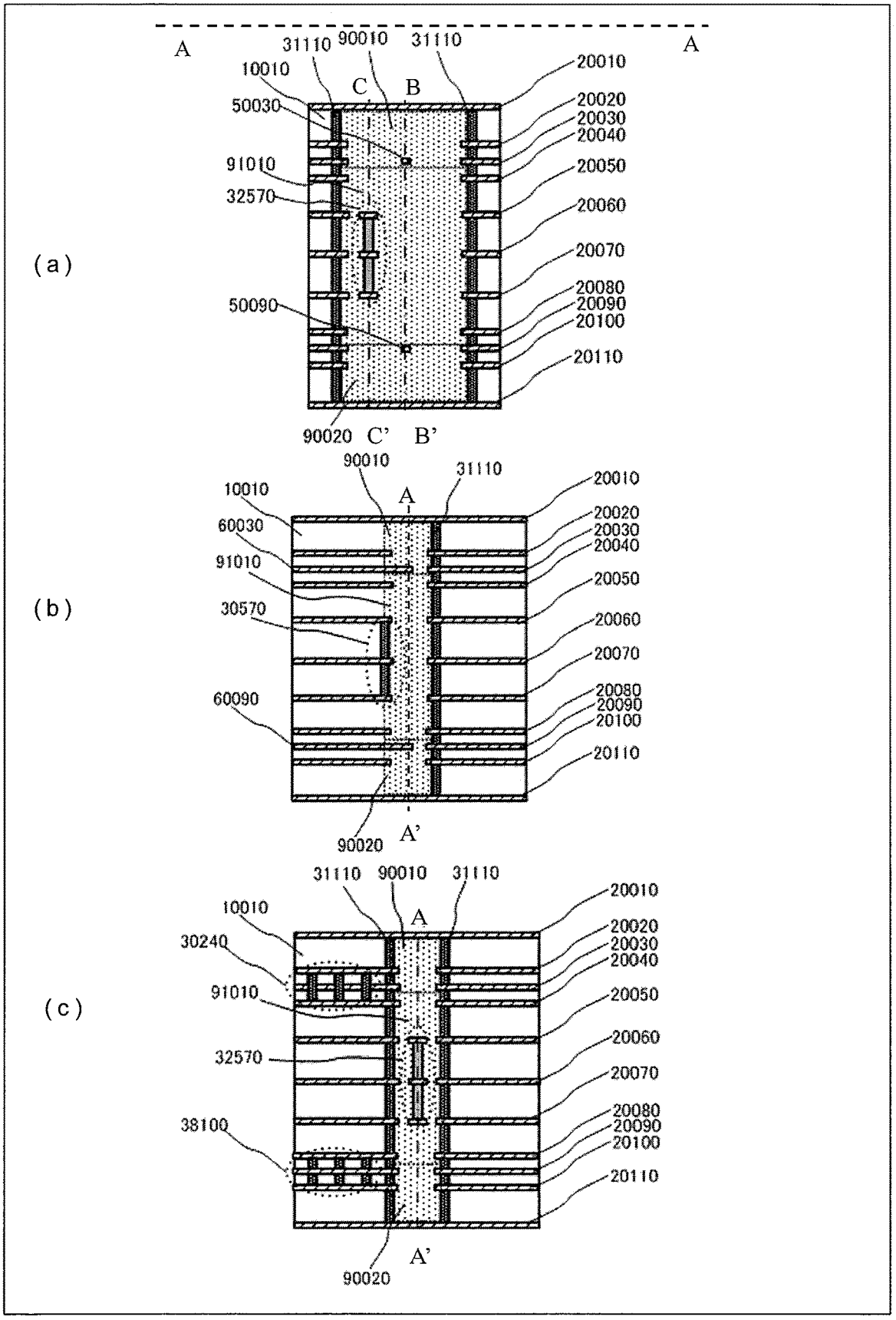
FIG. 27 is a vertical sectional view for illustrating the dielectric filter according to Example 5 of the second embodiment of the present invention.

FIG. 26 and FIG. 27 are views for illustrating a dielectric filter according to the second embodiment of the present invention including a ¼ wavelength conductor having both ends that are opened in the dielectric waveguide.

FIG. 26 is an exploded perspective view for illustrating an array of conductor layers, strip lines, probes, vias, resonance conductors, apertures, and the like.

Part (a) of FIG. 27 is a vertical sectional view taken along the line A-A of FIG. 26.

Part (b) of FIG. 27 is a vertical sectional view taken along the line B-B' of part (a) of FIG. 27.

Part (c) of FIG. 27 is a vertical sectional view taken along the line C-C' of part (a) of FIG. 27.

In the dielectric waveguide 91010, there is provided a resonance conductor 32570 that is a half wavelength conductor. The resonance conductor 32570 has a length corresponding to half wavelength of a frequency at which propagation of a high-frequency signal is desired to be blocked in the laminating direction of the multilayer dielectric substrate 10010. Further, the resonance conductor 32570 has one end arranged in the conductor layer 20070, and another end arranged in the conductor layer 20050.

In the example of FIG. 26 and FIG. 27 according to Example 5 of the second embodiment, the dielectric waveguide 91010 includes the resonance conductor 32570. In this manner, a bandstop-type filter function for blocking propagation of a high-frequency signal at a frequency corresponding to the lengths of the resonance conductor 32570 can be added. Further, an effect similar to that in the example of FIG. 1 and FIG. 2 in the above-mentioned first embodiment can be obtained.

Example 6

In the example of FIG. 20 and FIG. 21 according to Example 2 of the second embodiment, description has been given of the dielectric filter in which a part of the dielectric waveguide is formed as a resonance space. However, the present invention is not limited thereto, and there may be employed a dielectric filter in which choke structures are added to side portions of the dielectric waveguide.

Figure 28:
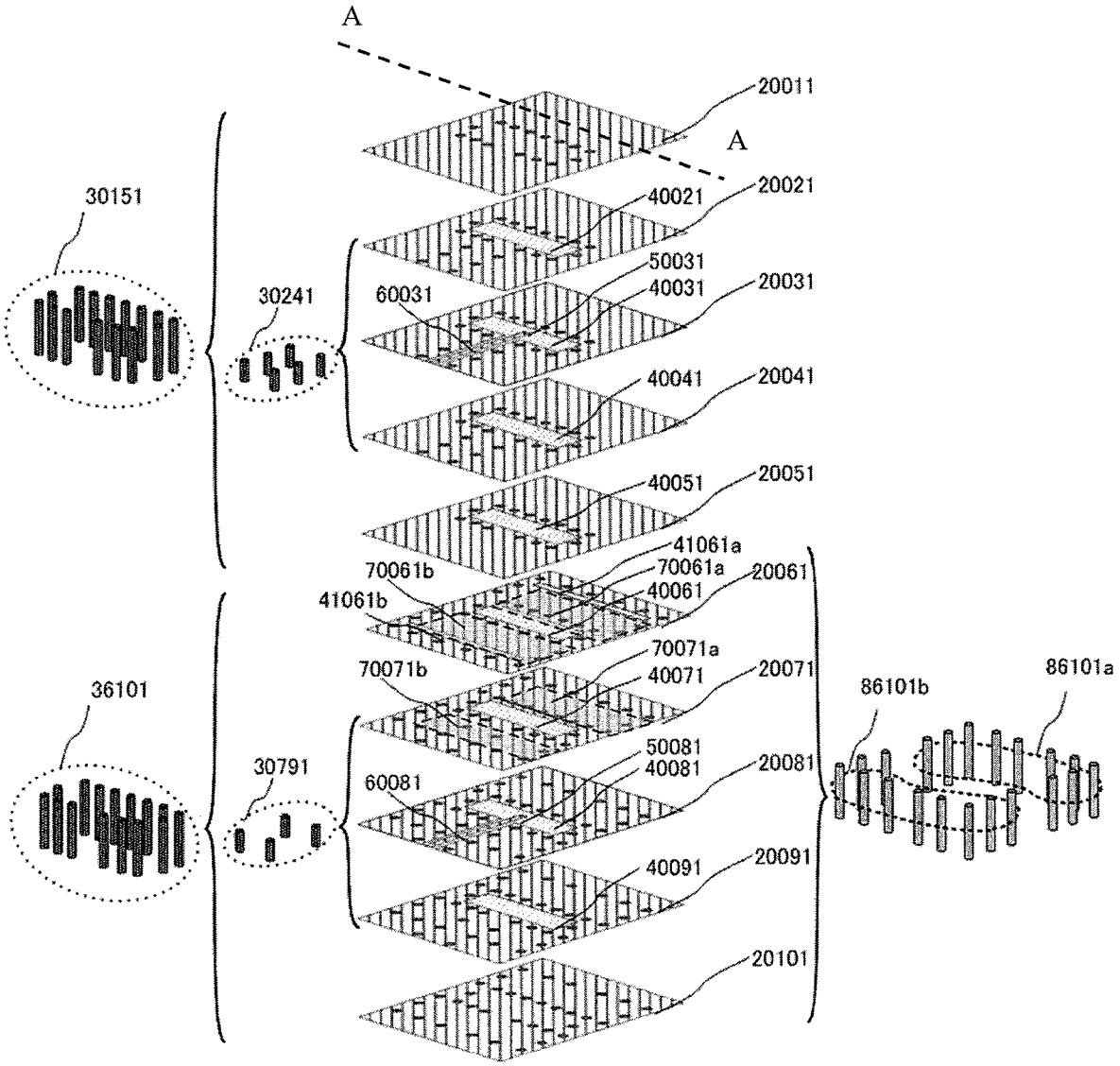
FIG. 28 is an exploded perspective view for illustrating an array of portions of a dielectric filter according to Example 6 of the second embodiment of the present invention.
Figure 29:
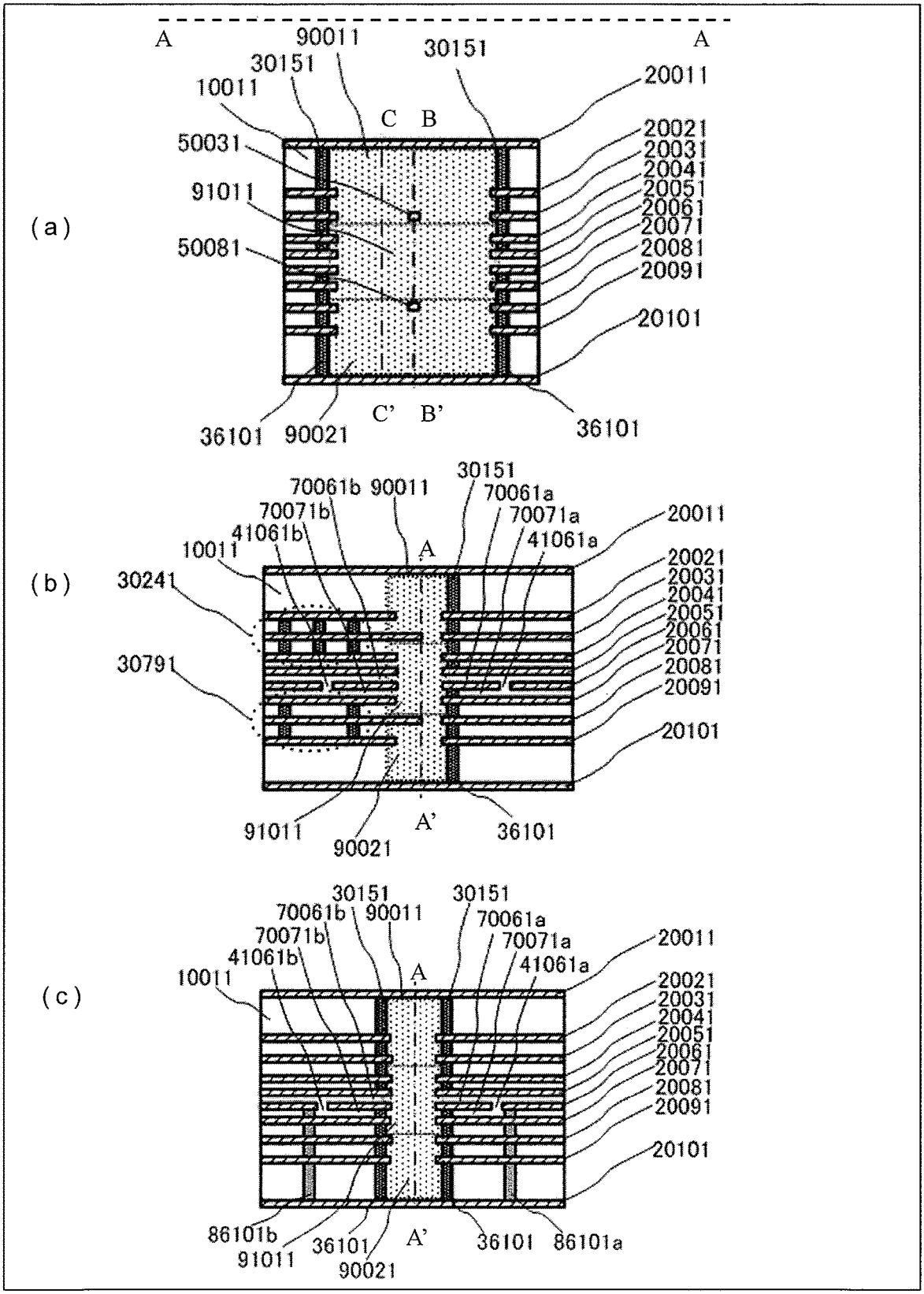
FIG. 29 is a vertical sectional view for illustrating the dielectric filter according to Example 6 of the second embodiment of the present invention.

FIG. 28 and FIG. 29 are views for illustrating a dielectric filter according to the second embodiment of the present invention including, at the side portions of the dielectric waveguide, as the choke structures, spaces each having a length corresponding to half wavelength of a frequency at which a high-frequency signal is to be propagated.

FIG. 28 is an exploded perspective view for illustrating an array of conductor layers, strip lines, probes, vias, choke structures, apertures, and the like.

Part (a) of FIG. 29 is a vertical sectional view taken along the line A-A of FIG. 28.

Part (b) of FIG. 29 is a vertical sectional view taken along the line B-B' of part (a) of FIG. 29.

Part (c) of FIG. 29 is a vertical sectional view taken along the line C-C' of part (a) of FIG. 29.

In FIG. 28 and FIG. 29, in a multilayer dielectric substrate 10011, there are provided:

a conductor layer 20011, a conductor layer 20021, a conductor layer 20031, a conductor layer 20041, a conductor layer 20051, a conductor layer 20061, a conductor layer 20071, a conductor layer 20081, a conductor layer 20091, and a conductor layer 20101;

vias 30151, vias 36101, vias 30241, vias 30791, vias 86101*a*, and vias 86101*b*; and a strip line 60031, a strip line 60081, a probe 50031, and a probe 50081.

The conductor layer 20011 is arranged on a surface layer of the multilayer dielectric substrate 10011.

The conductor layer 20021 is arranged in an inner layer of the multilayer dielectric substrate 10011 so as to face the conductor layer 20011.

The conductor layer 20031 is arranged in the inner layer of the multilayer dielectric substrate 10011 so as to face the conductor layer 20021 facing the conductor layer 20011 on its back surface side.

The conductor layer 20041 is arranged in the inner layer of the multilayer dielectric substrate 10011 so as to face the conductor layer 20031 facing the conductor layer 20021 on its back surface side.

The conductor layer 20051 is arranged in the inner layer of the multilayer dielectric substrate 10011 so as to face the conductor layer 20041 facing the conductor layer 20031 on its back surface side.

The conductor layer 20061 is arranged in the inner layer of the multilayer dielectric substrate 10011 so as to face the conductor layer 20051 facing the conductor layer 20041 on its back surface side.

The conductor layer 20071 is arranged in the inner layer of the multilayer dielectric substrate 10011 so as to face the conductor layer 20061 facing the conductor layer 20051 on its back surface side.

The conductor layer 20081 is arranged in the inner layer of the multilayer dielectric substrate 10011 so as to face the conductor layer 20071 facing the conductor layer 20061 on its back surface side.

The conductor layer 20091 is arranged in the inner layer of the multilayer dielectric substrate 10011 so as to face the conductor layer 20081 facing the conductor layer 20071 on its back surface side.

The conductor layer 20101 is arranged on a surface layer of the multilayer dielectric substrate 10011 on a side opposite to the side on which the conductor layer 20011 is arranged, so as to face the conductor layer 20091 facing the conductor layer 20081 on its back surface side.

The conductor layer 20021 to the conductor layer 20091 have an aperture 40021 to an aperture 40091, respectively, which are formed by eliminating parts of the conductor layer 20021 to the conductor layer 20091.

The aperture 40021 to the aperture 40091 are arranged so as to oppose each other. That is, the aperture 40021 to the aperture 40091 are positioned so as to overlap each other in the laminating direction.

The strip line 60031 is formed by eliminating a part of the conductor layer 20031.

The strip line 60081 is formed by eliminating a part of the conductor layer 20081.

The probe 50031 has one end connected to the strip line 60031, and another end arranged in the aperture 40031.

The probe 50081 has one end connected to the strip line 60081, and another end arranged in the aperture 40081.

A plurality of vias 30151 are arranged so as to surround the aperture 40021, the aperture 40031, the aperture 40041, and the aperture 40051 except for a part corresponding to the strip line 60031, and to extend from the conductor layer 20011 to the conductor layer 20051 to pass through the multilayer dielectric substrate 10011, the conductor layer 20021, the conductor layer 20031, and the conductor layer 20041.

A plurality of vias 36101 are arranged so as to surround the aperture 40061, the aperture 40071, the aperture 40081, and the aperture 40091 except for a part corresponding to the strip line 60081, and to extend from the conductor layer 20061 to the conductor layer 20101 to pass through the multilayer dielectric substrate 10011, the conductor layer 20071, the conductor layer 20081, and the conductor layer 20091.

A plurality of vias 30241 are arranged along both longitudinal side surfaces of the strip line 60031 along the laminating direction, and extend from the conductor layer 20021 to the conductor layer 20041 to pass through the multilayer dielectric substrate 10011 and the conductor layer 20031.

A plurality of vias 30791 are arranged along both longitudinal side surfaces of the strip line 60081 along the laminating direction, and extend from the conductor layer 20071 to the conductor layer 20091 to pass through the multilayer dielectric substrate 10011 and the conductor layer 20081.

From the planar direction to the laminating direction of the multilayer dielectric substrate 10011, a strip line-waveguide converter 90011 is formed of the conductor layer 20011, the conductor layer 20021, the conductor layer 20031, the vias 30151, the probe 50031, the aperture 40021, and the aperture 40031.

From the planar direction to the laminating direction of the multilayer dielectric substrate 10011, a strip line-waveguide converter 90021 is formed of the conductor layer

20081, the conductor layer 20091, the conductor layer 20101, the vias 36101, the probe 50081, the aperture 40081, and the aperture 40091.

In the laminating direction of the multilayer dielectric substrate 10011, a dielectric waveguide 91011 is formed of the conductor layer 20041, the conductor layer 20051, the conductor layer 20061, the conductor layer 20071, the vias 30151, the vias 36101, the aperture 40041, the aperture 40051, the aperture 40061, and the aperture 40071.

A cutout 41061*a* and a cutout 41061*b* are each formed by eliminating a part of the conductor layer 20061 at a position separated away from an end portion of a long side of the aperture 40061 by about λe/4 (λe: effective wavelength of a signal wave propagating in a plane direction in a space filled with a dielectric on the multilayer dielectric substrate). The cutout 41061*a* and the cutout 41061*b* oppose each other across the aperture 40061.

A plurality of vias 86101*a* formed of conductors are arranged along an edge of the cutout 41061*a* on the opposite side of the side on which the dielectric waveguide 91011 is positioned to the vicinity of the vias 36101, so as to connect the conductor layer 20061 and the conductor layer 20101 to each other.

A plurality of vias 86101*b* formed of conductors are arranged along an edge of the cutout 41061*b* on the opposite side of the side on which the dielectric waveguide 91011 is positioned to the vicinity of the vias 36101, so as to connect the conductor layer 20061 and the conductor layer 20101 to each other.

A choke path 70061*a* is a space extending from the end portion of the aperture 40061 to the cutout 41061*a* in a space sandwiched between the conductor layer 20051 and the conductor layer 20061.

A choke path 70061*b* is a space extending from the end portion of the aperture 40061 to the cutout 41061*b* in a space sandwiched between the conductor layer 20051 and the conductor layer 20061.

A choke path 70071*a* is a space surrounded by the vias 86101*a* and the vias 36101 in a space sandwiched between the conductor layer 20061 and the conductor layer 20071.

A choke path 70071*b* is a space surrounded by the vias 86101*b* and the vias 36101 in a space sandwiched between the conductor layer 20061 and the conductor layer 20071.

Those spaces are not hollow cavities but filled with dielectric bodies.

Further, the above-mentioned vias 86101*a* are formed so as to surround a part including the cutout 41061*a*, the choke path 70061*a*, and the choke path 70071*a* from the outer side in a C-shape. Further, the above-mentioned vias 86101*b* are formed so as to surround a part including the cutout 41061*b*, the choke path 70061*b*, and the choke path 70071*b* from the outer side in a C-shape.

At side portions of the dielectric waveguide 91011, as choke structures formed of the choke path 70061*a* and the choke path 70071*a* and of the choke path 70061*b* and the choke path 70071*b*, there are added spaces each having a length corresponding to half wavelength of a frequency at which a high-frequency signal is to be propagated.

The strip line-waveguide converter 90011 and the strip line-waveguide converter 90021 are electromagnetically connected to each other via the dielectric waveguide 91011.

In the example of FIG. 28 and FIG. 29 according to Example 6 of the second embodiment, at the side portions of the dielectric waveguide 91011, as the choke structures formed of the choke path 70061*a* and the choke path 70071*a* and of the choke path 70061*b* and the choke path 70071*b*, there are formed spaces each having a length corresponding to half wavelength of a frequency at which a high-frequency signal is to be propagated. In this manner, a bandpass-type filter function for propagating a high-frequency signal having a frequency corresponding to the length of the choke structure can be added to the dielectric waveguide 91010. Further, an effect similar to that in the example of FIG. 1 and FIG. 2 in the above-mentioned first embodiment can be obtained.

Third Embodiment

In the above-mentioned first embodiment and second embodiment, description has been given of the dielectric filter including one multilayer dielectric substrate. However, there may be employed a dielectric filter including two or more multilayer dielectric substrates.

Figure 30:
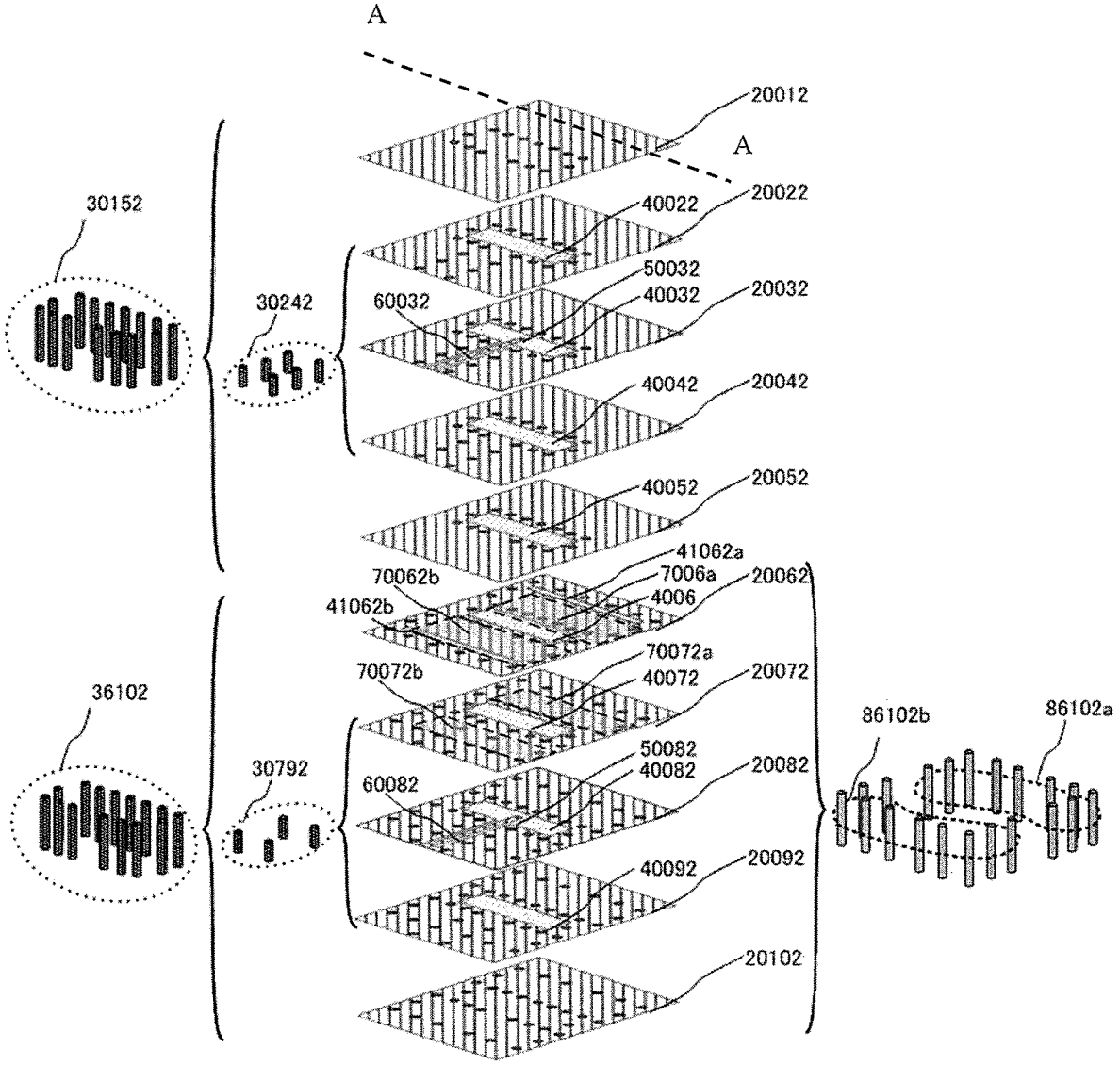
FIG. 30 is an exploded perspective view for illustrating an array of portions of a dielectric filter according to a third embodiment of the present invention.
Figure 31:
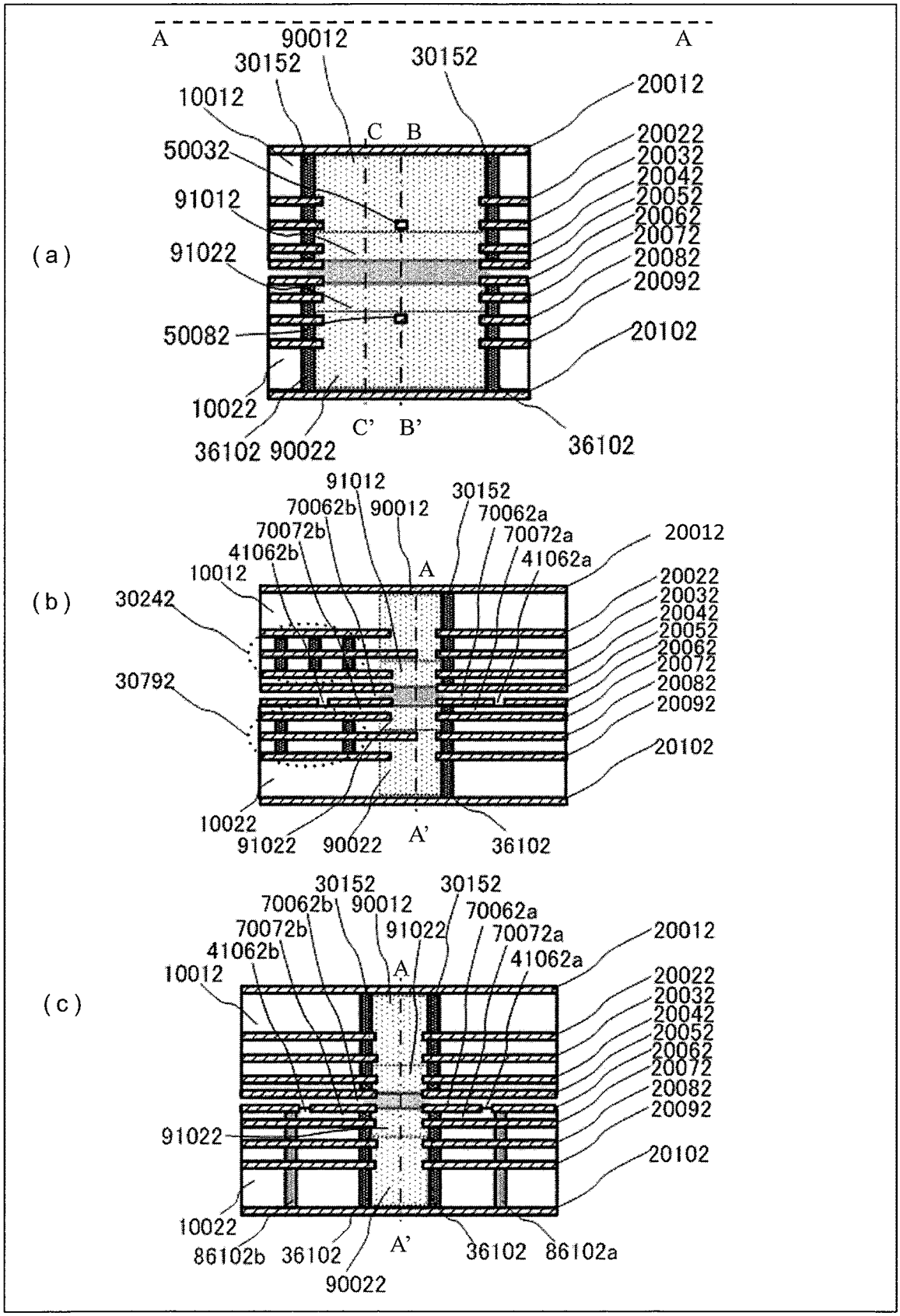
FIG. 31 is a vertical sectional view for illustrating the dielectric filter according to the third embodiment of the present invention.

FIG. 30 and FIG. 31 are views for illustrating a dielectric filter according to a third embodiment of the present invention, which includes two multilayer dielectric substrates, and in which a choke structure is formed in one of the substrates.

FIG. 30 is an exploded perspective view for illustrating an array of conductor layers, strip lines, probes, vias, choke structures, apertures, and the like.

Part (a) of FIG. 31 is a vertical sectional view taken along the line A-A of FIG. 30.

Part (b) of FIG. 31 is a vertical sectional view taken along the line B-B' of part (a) of FIG. 31.

Part (c) of FIG. 31 is a vertical sectional view taken along the line C-C' of part (a) of FIG. 31.

In FIG. 30 and FIG. 31, in a multilayer dielectric substrate 10012, there are provided:

a conductor layer 20012, a conductor layer 20022, a conductor layer 20032, a conductor layer 20042, and a conductor layer 20052;

vias 30152 and vias 30242; and a strip line 60032, and a probe 50032.

In a multilayer dielectric substrate 10022, there are provided:

a conductor layer 20062, a conductor layer 20072, a conductor layer 20082, a conductor layer 20092, and a conductor layer 20102;

vias 36102, vias 30792, vias 86102*a*, and vias 86102*b*; and a strip line 60082, and a probe 50082.

The conductor layer 20012 is arranged on a surface layer of the multilayer dielectric substrate 10012.

The conductor layer 20022 is arranged in an inner layer of the multilayer dielectric substrate 10012 so as to face the conductor layer 20012.

The conductor layer 20032 is arranged in the inner layer of the multilayer dielectric substrate 10012 so as to face the conductor layer 20022 facing the conductor layer 20012 on its back surface side.

The conductor layer 20042 is arranged in the inner layer of the multilayer dielectric substrate 10012 so as to face the conductor layer 20032 facing the conductor layer 20022 on its back surface side.

The conductor layer 20052 is arranged on a surface layer of the multilayer dielectric substrate 10012 on a side opposite to the side on which the conductor layer 20012 is arranged, so as to face the conductor layer 20042 facing the conductor layer 20032 on its back surface side.

The conductor layer 20062 is arranged on a surface layer of the multilayer dielectric substrate 10022 so as to face the conductor layer 20052 of the multilayer dielectric substrate 10012.

The conductor layer 20072 is arranged in an inner layer of the multilayer dielectric substrate 10022 so as to face the conductor layer 20062.

The conductor layer 20082 is arranged in an inner layer of the multilayer dielectric substrate 10022 so as to face the conductor layer 20072 facing the conductor layer 20062 on its back surface side.

The conductor layer 20092 is arranged in the inner layer of the multilayer dielectric substrate 10022 so as to face the conductor layer 20082 facing the conductor layer 20072 on its back surface side.

The conductor layer 20102 is arranged on a surface layer of the multilayer dielectric substrate 10022 on a side opposite to the side on which the conductor layer 20062 is arranged, so as to face the conductor layer 20092 facing the conductor layer 20082 on its back surface side.

The conductor layer 20022 to the conductor layer 20092 have an aperture 40022 to an aperture 40092, respectively, which are formed by eliminating parts of the conductor layer 20022 to the conductor layer 20092.

The aperture 40022 to the aperture 40092 are arranged so as to oppose each other. That is, the aperture 40022 to the aperture 40092 are positioned so as to overlap each other in the laminating direction.

The strip line 60032 is formed by eliminating a part of the conductor layer 20032.

The strip line 60082 is formed by eliminating a part of the conductor layer 20082.

The probe 50032 has one end connected to the strip line 60032, and another end arranged in the aperture 40032.

The probe 50082 has one end connected to the strip line 60082, and another end arranged in the aperture 40082.

A plurality of vias 30152 are arranged so as to surround the aperture 40022 to the aperture 40052 except for a part corresponding to the strip line 60032, and to extend from the conductor layer 20012 to the conductor layer 20052 to pass through the multilayer dielectric substrate 10012 and the conductor layer 20022 to the conductor layer 20042.

A plurality of vias 36102 are arranged so as to surround the aperture 40062 to the aperture 40092 except for a part corresponding to the strip line 60082, and to extend from the conductor layer 20062 to the conductor layer 20102 to pass through the multilayer dielectric substrate 10022 and the conductor layer 20072 to the conductor layer 20092.

A plurality of vias 30242 are arranged along both longitudinal side surfaces of the strip line 60032 along the laminating direction, and extend from the conductor layer 20022 to the conductor layer 20042 to pass through the multilayer dielectric substrate 10012 and the conductor layer 20032.

A plurality of vias 30792 are arranged along both longitudinal side surfaces of the strip line 60082 along the laminating direction, and extend from the conductor layer 20072 to the conductor layer 20092 to pass through the multilayer dielectric substrate 10022 and the conductor layer 20082.

From the planar direction to the laminating direction of the multilayer dielectric substrate 10012, a strip line-waveguide converter 90012 is formed of the conductor layer 20012, the conductor layer 20022, the conductor layer 20032, the vias 30152, the probe 50032, the aperture 40022, and the aperture 40032.

From the planar direction to the laminating direction of the multilayer dielectric substrate 10022, a strip line-waveguide converter 90022 is formed of the conductor layer 20082, the conductor layer 20092, the conductor layer 20102, the vias 36102, the probe 50082, the aperture 40082, and the aperture 40092.

In the laminating direction of the multilayer dielectric substrate 10012, a dielectric waveguide 91012 is formed of the conductor layer 20042, the conductor layer 20052, the vias 30152, the aperture 40042, and the aperture 40052.

In the laminating direction of the multilayer dielectric substrate 10022, a dielectric waveguide 91022 is formed of the conductor layer 20062, the conductor layer 20072, the vias 36102, the aperture 40062, and the aperture 40072.

A cutout 41062*a* and a cutout 41062*b* are each formed by eliminating a part of the conductor layer 20062 at a position separated away from an end portion of a long side of the aperture 40062 by $\lambda/4$ ($\lambda$: free space wavelength of the signal wave). The cutout 41062*a* and the cutout 41062*b* oppose each other across the aperture 40062.

A plurality of vias 86102*a* formed of conductors are arranged along an edge of the cutout 41062*a* on the opposite side of the side on which the dielectric waveguide 91012 is positioned to the vicinity of the vias 36102, so as to connect the conductor layer 20062 and the conductor layer 20102 to each other.

A plurality of vias 86102*b* formed of conductors are arranged along an edge of the cutout 41062*b* on the opposite side of the side on which the dielectric waveguide 91012 is positioned to the vicinity of the vias 36102, so as to connect the conductor layer 20062 and the conductor layer 20102 to each other.

A choke path 70062*a* is a space extending from the end portion of the aperture 40062 to the cutout 41062*a* in a space sandwiched between the conductor layer 20052 and the conductor layer 20062.

A choke path 70062*b* is a space extending from the end portion of the aperture 40062 to the cutout 41062*b* in a space sandwiched between the conductor layer 20052 and the conductor layer 20062.

A choke path 70072*a* is a space surrounded by the vias 86102*a* and the vias 36102 in a space sandwiched between the conductor layer 20062 and the conductor layer 20072.

A choke path 70072*b* is a space surrounded by the vias 86102*b* and the vias 36102 in a space sandwiched between the conductor layer 20062 and the conductor layer 20072.

Those spaces are not hollow cavities but filled with dielectric bodies.

Further, the above-mentioned vias 86102*a* are formed so as to surround a part including the cutout 41062*a*, the choke path 70062*a*, and the choke path 70072*a* from the outer side in a C-shape. Further, the above-mentioned vias 86102*b* are formed so as to surround a part including the cutout 41062*b*, the choke path 70062*b*, and the choke path 70072*b* from the outer side in a C-shape.

The dielectric waveguide 91012 and the dielectric waveguide 91022 are electromagnetically connected to each other by, as choke structures formed of the choke path 70061*a* and the choke path 70071*a* and of the choke path 70061*b* and the choke path 70071*b*, spaces each having a length corresponding to half wavelength of a frequency at which a high-frequency signal is to be propagated.

The strip line-waveguide converter 90012 and the strip line-waveguide converter 90022 are electromagnetically connected to each other via the dielectric waveguide 91012 and the dielectric waveguide 91022.

In the example of FIG. 30 and FIG. 31 according to the third embodiment, the dielectric waveguide 91012 in the multilayer dielectric substrate 10012 and the dielectric waveguide 91022 in the multilayer dielectric substrate

10022 are electrically connected to each other via, as the choke structures formed of the choke path 70062*a* and the choke path 70072*a* and of the choke path 70062*b* and the choke path 70072*b*, spaces each having a length corresponding to half wavelength of a frequency at which a high-frequency signal is to be propagated. In this manner, a bandpass-type filter function for propagating a high-frequency signal having a frequency corresponding to the length of the choke structure can be added. Further, an effect similar to that in the example of FIG. 1 and FIG. 2 of the above-mentioned first embodiment can be obtained.

Fourth Embodiment

Example 1

In the above-mentioned first embodiment, second embodiment, and third embodiment, description has been given of the dielectric filter in which the back-short waveguide in the strip line-waveguide converter is formed in the laminating direction of the multilayer dielectric substrate. However, there may be employed a dielectric filter in which the back-short waveguide in the strip line-waveguide converter is formed in the planar direction of the multilayer dielectric substrate.

Figure 32:
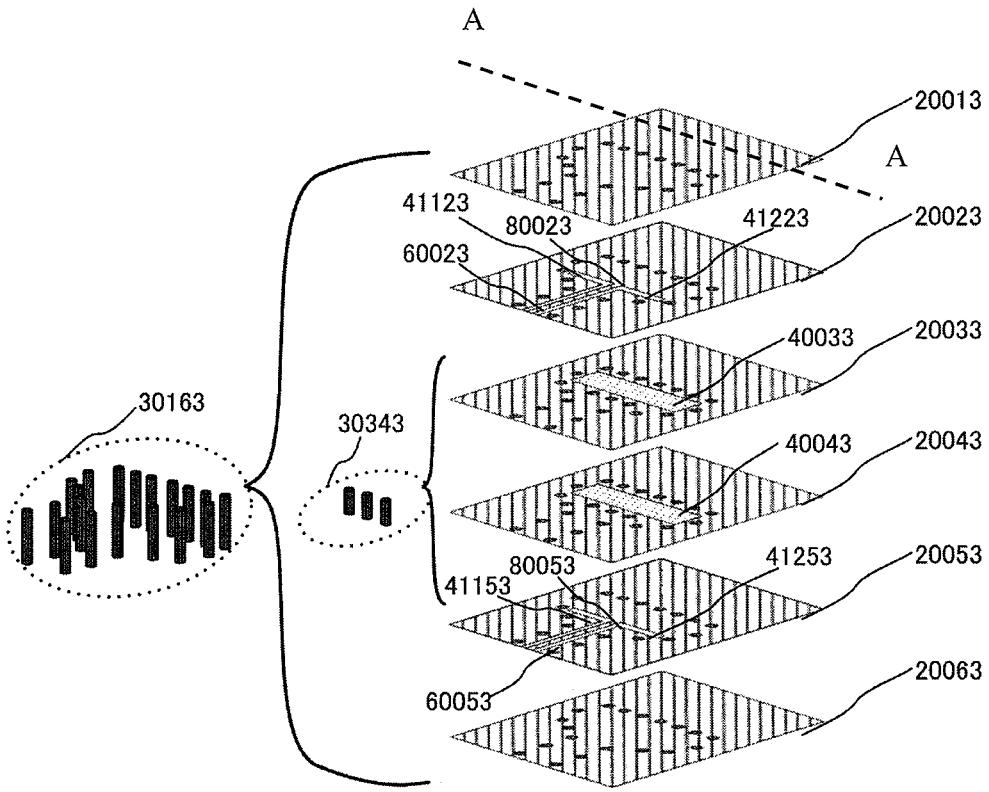
FIG. 32 is an exploded perspective view for illustrating an array of portions of a dielectric filter according to Example 1 of a fourth embodiment of the present invention.
Figure 33:
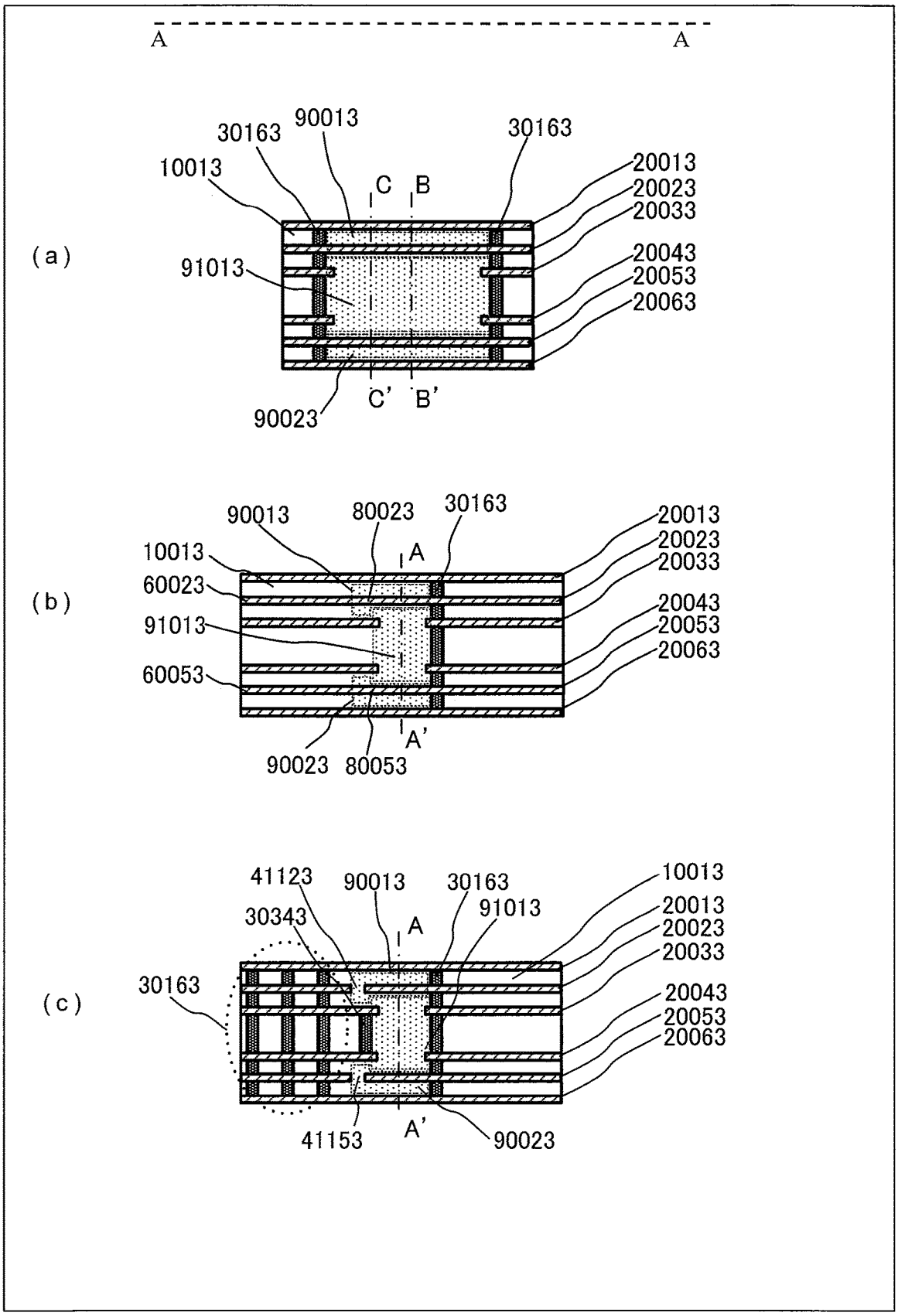
FIG. 33 is a vertical sectional view for illustrating the dielectric filter according to Example 1 of the fourth embodiment of the present invention.

FIG. 32 and FIG. 33 are views for illustrating a dielectric filter according to a fourth embodiment of the present invention in which the back-short waveguide in the strip line-waveguide converter is formed in the planar direction of the multilayer dielectric substrate.

FIG. 32 is an exploded perspective view for illustrating an array of conductor layers, strip lines, cutouts, connecting portions, vias, apertures, and the like.

Part (a) of FIG. 33 is a vertical sectional view taken along the line A-A of FIG. 32.

Part (b) of FIG. 33 is a vertical sectional view taken along the line B-B' of part (a) of FIG. 33.

Part (c) of FIG. 33 is a vertical sectional view taken along the line C-C' of part (a) of FIG. 33.

In FIG. 32 and FIG. 33, in a multilayer dielectric substrate 10013, there are provided a conductor layer 20013, a conductor layer 20023, a conductor layer 20033, a conductor layer 20043, a conductor layer 20053, a conductor layer 20063, vias 30163, vias 30343, a strip line 60023, a strip line 60053, a connecting portion 80023, and a connecting portion 80053.

The conductor layer 20013 is arranged on a surface layer of the multilayer dielectric substrate 10013.

The conductor layer 20023 is arranged in an inner layer of the multilayer dielectric substrate 10013 so as to face the conductor layer 20013.

The conductor layer 20033 is arranged in the inner layer of the multilayer dielectric substrate 10013 so as to face the conductor layer 20023 facing the conductor layer 20013 on its back surface side.

The conductor layer 20043 is arranged in the inner layer of the multilayer dielectric substrate 10013 so as to face the conductor layer 20033 facing the conductor layer 20023 on its back surface side.

The conductor layer 20053 is arranged in the inner layer of the multilayer dielectric substrate 10013 so as to face the conductor layer 20043 facing the conductor layer 20033 on its back surface side.

The conductor layer 20063 is arranged on a surface layer of the multilayer dielectric substrate 10013 on a side opposite to the side on which the conductor layer 20013 is arranged, so as to face the conductor layer 20053 facing the conductor layer 20043 on its back surface side.

The conductor layer 20033 and the conductor layer 20043 have an aperture 40033 and an aperture 40043, respectively.

The aperture 40033 to the aperture 40043 are arranged so as to oppose each other. That is, the aperture 40033 and the aperture 40043 are positioned so as to overlap each other in the laminating direction.

The strip line 60023 is formed by eliminating a part of the conductor layer 20023.

The strip line 60053 is formed by eliminating a part of the conductor layer 20053.

The conductor layer 20023 has a cutout 41123 and a cutout 41223, which are connected to one end of the strip line 60023 at the connecting portion 80023.

The conductor layer 20053 has a cutout 41153 and a cutout 41253, which are connected to one end of the strip line 60053 at the connecting portion 80053.

That is, the cutouts are structures formed by bending and extending the cutouts on both sides of the strip line at the connecting portion at a right angle to opposite directions on both sides.

A plurality of vias 30163 are arranged so as to surround the aperture 40033 to the aperture 40043 except for a part corresponding to the strip line 60023 and the strip line 60053, and are further arranged along both longitudinal side surfaces of the strip line 60023 and the strip line 60053. Further, the vias 30163 extend from the conductor layer 20013 to the conductor layer 20063 to pass through the multilayer dielectric substrate 10013 and the conductor layer 20023 to the conductor layer 20053.

A plurality of vias 30343 are arranged to extend from the conductor layer 20033 to the conductor layer 20043 to pass through the multilayer dielectric substrate 10013.

In the planar direction of the multilayer dielectric substrate 10013, a strip line-waveguide converter 90013 is formed of the conductor layer 20013, the conductor layer 20023, the conductor layer 20033, the vias 30163, the connecting portion 80023, the cutout 41123, and the cutout 41223. In the strip line-waveguide converter 90013, a dielectric waveguide part, which is formed of the vias 30163, the conductor layer 20013, and the conductor layer 20023 in the planar direction of the multilayer dielectric substrate 10013 to form the back-short waveguide, is formed so that a part from a part of the via 30163, which is positioned on the opposite side of the strip line 60023 across the connecting portion 80023 to serve as a short-circuit portion, to the connecting portion 80023 has a length corresponding to ¼ wavelength of a guide wavelength of the back-short waveguide.

In the planar direction of the multilayer dielectric substrate 10013, a strip line-waveguide converter 90023 is formed of the conductor layer 20043, the conductor layer 20053, the conductor layer 20063, the vias 30163, the connecting portion 80053, the cutout 41153, and the cutout 41253. In the strip line-waveguide converter 90023, a dielectric waveguide part, which is formed of the vias 30163, the conductor layer 20053, and the conductor layer 20063 in the planar direction of the multilayer dielectric substrate 10013 to form the back-short waveguide, is formed so that a part from a part of the via 30163, which is positioned on the opposite side of the strip line 60053 across the connecting portion 80053 to serve as a short-circuit portion, to the connecting portion 80053 has a length corresponding to ¼ wavelength of a guide wavelength of the back-short waveguide.

In the laminating direction of the multilayer dielectric substrate 10013, a dielectric waveguide 91013 is formed of the conductor layer 20023, the conductor layer 20033, the conductor layer 20043, the conductor layer 20053, the vias 30163, the vias 30343, the aperture 40033, and the aperture 40043.

The above-mentioned dielectric waveguide formed in the planar direction of the multilayer dielectric substrate 10013 forms a planar dielectric waveguide, and the dielectric waveguide formed in the laminating direction of the multilayer dielectric substrate 10013 forms a vertical dielectric waveguide.

The strip line-waveguide converter 90013 and the strip line-waveguide converter 90023 are electromagnetically connected to each other via the dielectric waveguide 91013.

In the example of FIG. 32 and FIG. 33 according to Example 1 of the fourth embodiment, only the back-short waveguides of the strip line-waveguide converter 90013 and the strip line-waveguide converter 90023 are formed in the planar direction of the multilayer dielectric substrate 10013. In this manner, the number of layers laminated in the multilayer dielectric substrate can be reduced, and the substrate thickness can be reduced. Further, an effect similar to that in the example of FIG. 1 and FIG. 2 in the above-mentioned first embodiment can be obtained.

Example 2

In the above-mentioned first embodiment, second embodiment, third embodiment, and Example 1 of the fourth embodiment, description has been given of the dielectric filter in which the strip line-waveguide converters have the same configuration. However, there may be employed a dielectric filter using strip line-waveguide converters having different configurations.

Figure 34:
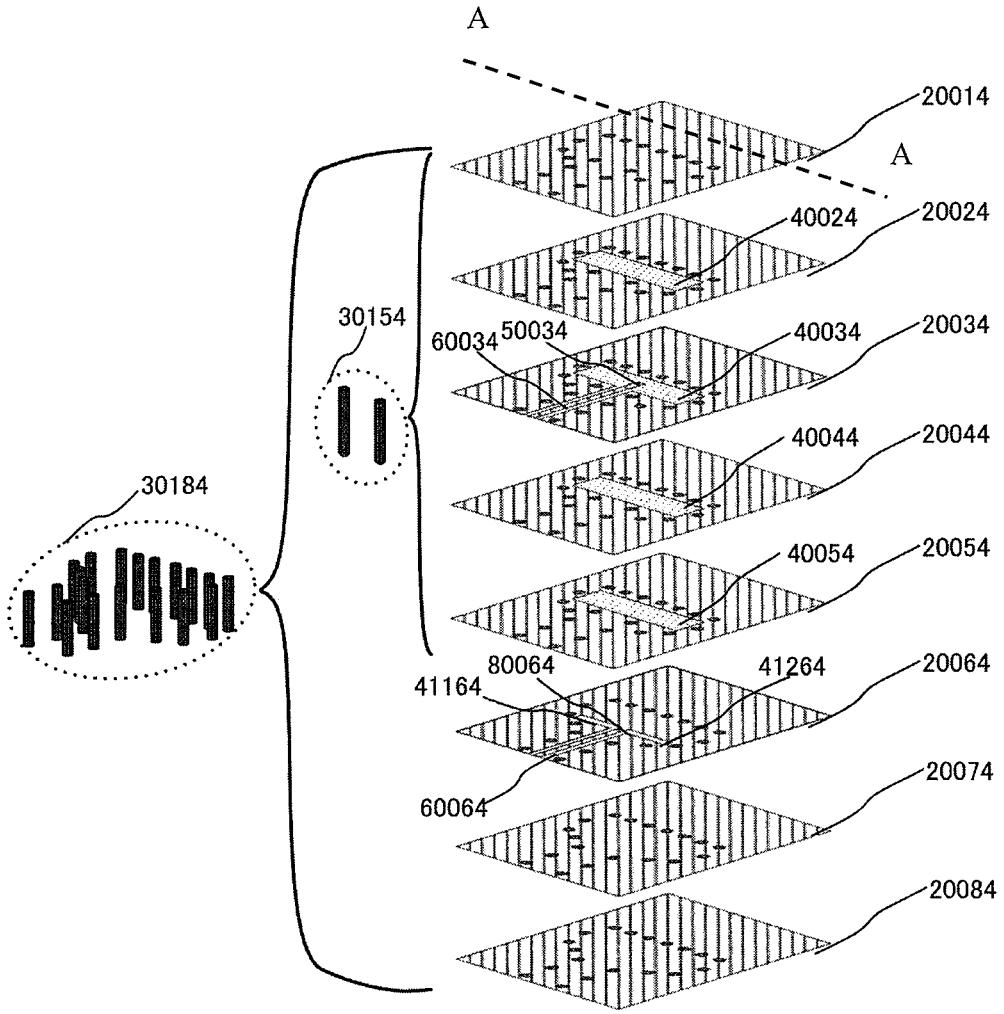
FIG. 34 is an exploded perspective view for illustrating an array of portions of a dielectric filter according to Example 2 of the fourth embodiment of the present invention.
Figure 35:
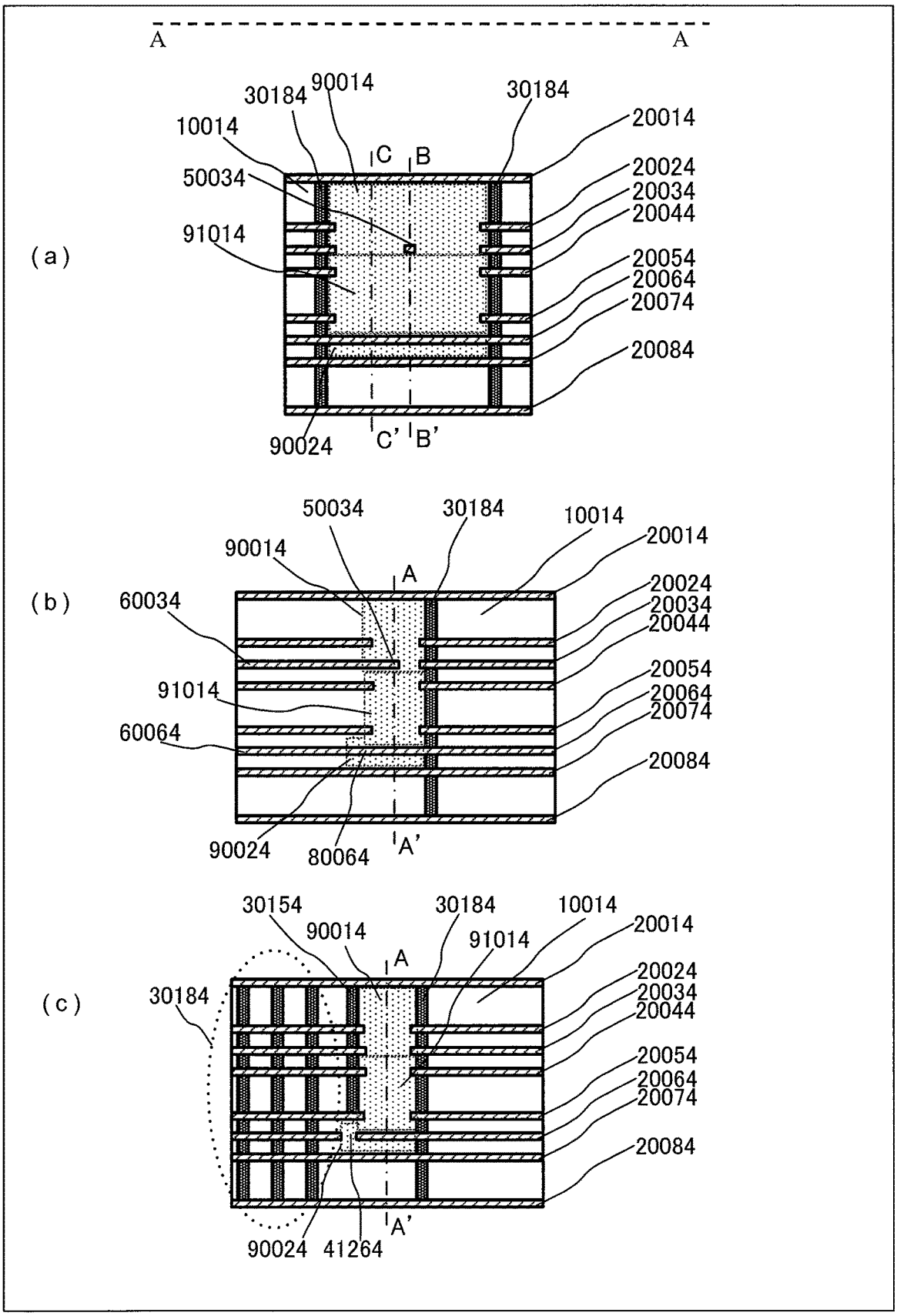
FIG. 35 is a vertical sectional view for illustrating the dielectric filter according to Example 2 of the fourth embodiment of the present invention.

FIG. 34 and FIG. 35 are views for illustrating a dielectric filter according to the fourth embodiment of the present invention including a strip line-waveguide converter having a back-short waveguide formed in the laminating direction of the multilayer dielectric substrate, and a strip line-waveguide converter having a back-short waveguide formed in the planar direction of the multilayer dielectric substrate.

FIG. 34 is an exploded perspective view for illustrating an array of conductor layers, strip lines, cutouts, probes, a connecting portion, vias, apertures, and the like.

Part (a) of FIG. 35 is a vertical sectional view taken along the line A-A of FIG. 34.

Part (b) of FIG. 35 is a vertical sectional view taken along the line B-B' of part (a) of FIG. 35.

Part (c) of FIG. 35 is a vertical sectional view taken along the line C-C' of part (a) of FIG. 35.

In FIG. 34 and FIG. 35, in a multilayer dielectric substrate 10014, there are provided:

a conductor layer 20014, a conductor layer 20024, a conductor layer 20034, a conductor layer 20044, a conductor layer 20054, a conductor layer 20064, a conductor layer 20074, and a conductor layer 20084;

vias 30184 and vias 30154; and a strip line 60034, a strip line 60064, a probe 50034, and a connecting portion 80064.

The conductor layer 20014 is arranged on a surface layer of the multilayer dielectric substrate 10014.

The conductor layer 20024 is arranged in an inner layer of the multilayer dielectric substrate 10014 so as to face the conductor layer 20014.

The conductor layer 20034 is arranged in the inner layer of the multilayer dielectric substrate 10014 so as to face the conductor layer 20024 facing the conductor layer 20014 on its back surface side.

The conductor layer 20044 is arranged in the inner layer of the multilayer dielectric substrate 10014 so as to face the conductor layer 20034 facing the conductor layer 20024 on its back surface side.

The conductor layer 20054 is arranged in the inner layer of the multilayer dielectric substrate 10014 so as to face the conductor layer 20044 facing the conductor layer 20034 on its back surface side.

The conductor layer 20064 is arranged in the inner layer of the multilayer dielectric substrate 10014 so as to face the conductor layer 20054 facing the conductor layer 20044 on its back surface side.

The conductor layer 20074 is arranged in the inner layer of the multilayer dielectric substrate 10014 so as to face the conductor layer 20064 facing the conductor layer 20054 on its back surface side.

The conductor layer 20084 is arranged on a surface layer of the multilayer dielectric substrate 10014 on a side opposite to the side on which the conductor layer 20014 is arranged, so as to face the conductor layer 20074 facing the conductor layer 20064 on its back surface side.

The conductor layer 20024 to the conductor layer 20054 have an aperture 40024 to an aperture 40054, respectively, which are formed by eliminating parts of the conductor layer 20024 to the conductor layer 20054.

The aperture 40024 to the aperture 40054 are arranged so as to oppose each other. That is, the aperture 40024 to the aperture 40054 are positioned so as to overlap each other in the laminating direction.

The strip line 60034 is formed by eliminating a part of the conductor layer 20034.

The strip line 60064 is formed by eliminating a part of the conductor layer 20064.

The probe 50034 has one end connected to the strip line 60034, and another end arranged in the aperture 40034.

The conductor layer 20064 has a cutout 41164 and a cutout 41264, which are connected to one end of the strip line 60064 at the connecting portion 80064.

A plurality of vias 30184 are arranged so as to surround the aperture 40024 to the aperture 40054 except for a part corresponding to the strip line 60034 and the strip line 60064, and are arranged along both longitudinal side surfaces of the strip line 60034 and the strip line 60064. Further, the vias 30184 extend from the conductor layer 20014 to the conductor layer 20084 to pass through the multilayer dielectric substrate 10014 and the conductor layer 20024 to the conductor layer 20074.

A plurality of vias 30154 are arranged so as to extend from the conductor layer 20014 to the conductor layer 20054 to pass through the multilayer dielectric substrate 10014.

From the planar direction to the laminating direction of the multilayer dielectric substrate 10014, a strip line-waveguide converter 90014 is formed of the conductor layer 20014, the conductor layer 20024, the conductor layer 20034, the vias 30184, the probe 50034, the aperture 40024, and the aperture 40034. In the strip line-waveguide converter 90014, a dielectric waveguide part, which is formed of the conductor layer 20014, the conductor layer 20024, the conductor layer 20034, and the vias 30184 in the laminating direction of the multilayer dielectric substrate 10014 to form the back-short waveguide, is formed so that a part from the conductor layer 20014 serving as the short-circuit surface to the probe 50034 has a length corresponding to ¼ wavelength of a guide wavelength of the back-short waveguide.

In the planar direction of the multilayer dielectric substrate 10014, a strip line-waveguide converter 90024 is formed of the conductor layer 20054, the conductor layer 20064, the conductor layer 20074, the vias 30184, the connecting portion 80064, the cutout 41164, and the cutout 41264. In the strip line-waveguide converter 90024, a dielectric waveguide part, which is formed of the vias 30184, the conductor layer 20064, and the conductor layer 20074 in the planar direction of the multilayer dielectric substrate 10014 to form the back-short waveguide, is formed so that a part from a part of the vias 30184, which is positioned on the opposite side of the strip line 60064 across the connecting portion 80064 to serve as the short-circuit portion, to the connecting portion 80064 has a length corresponding to ¼ wavelength of a guide wavelength of the back-short waveguide.

In the laminating direction of the multilayer dielectric substrate 10014, a dielectric waveguide 91014 is formed of the conductor layer 20044, the conductor layer 20054, the vias 30184, the vias 30154, the aperture 40044, and the aperture 40054.

The strip line-waveguide converter 90014 and the strip line-waveguide converter 90024 are electromagnetically connected to each other via the dielectric waveguide 91014.

In the example of FIG. 34 and FIG. 35 according to Example 2 of the fourth embodiment, the back-short waveguide of the strip line-waveguide converter 90014 is formed in the laminating direction of the multilayer dielectric substrate, and the back-short waveguide of the strip line-waveguide converter 90024 is formed in the planar direction of the multilayer dielectric substrate. In this manner, the degree of design freedom can be improved, and an effect similar to that in the example of FIG. 1 and FIG. 2 of the above-mentioned first embodiment can be obtained.

Example 3

In the above-mentioned first embodiment, second embodiment, third embodiment, and Example 1 and Example 2 of the fourth embodiment, description has been given of the dielectric filter using a single-input and single-output strip line-waveguide converter. However, there may be employed a dielectric filter using a multi-input and multi-output strip line-waveguide converter.

Figure 36:
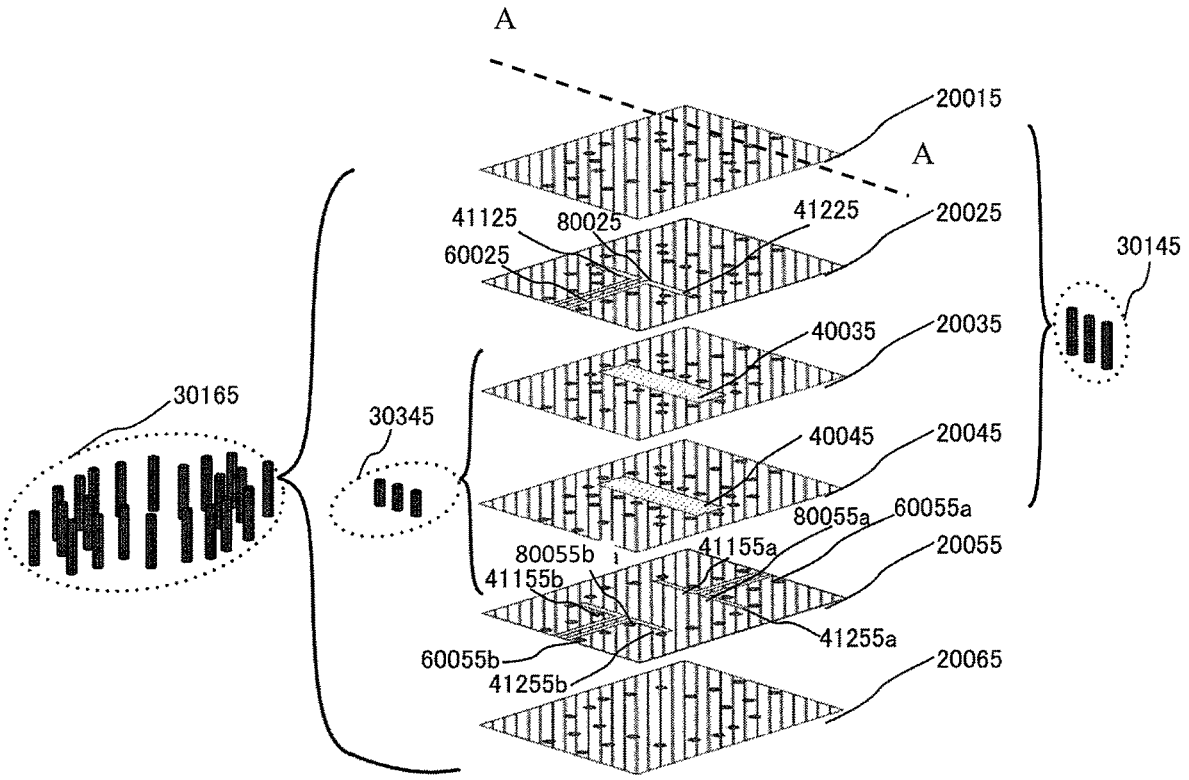
FIG. 36 is an exploded perspective view for illustrating an array of portions of a dielectric filter according to Example 3 of the fourth embodiment of the present invention.
Figure 37:
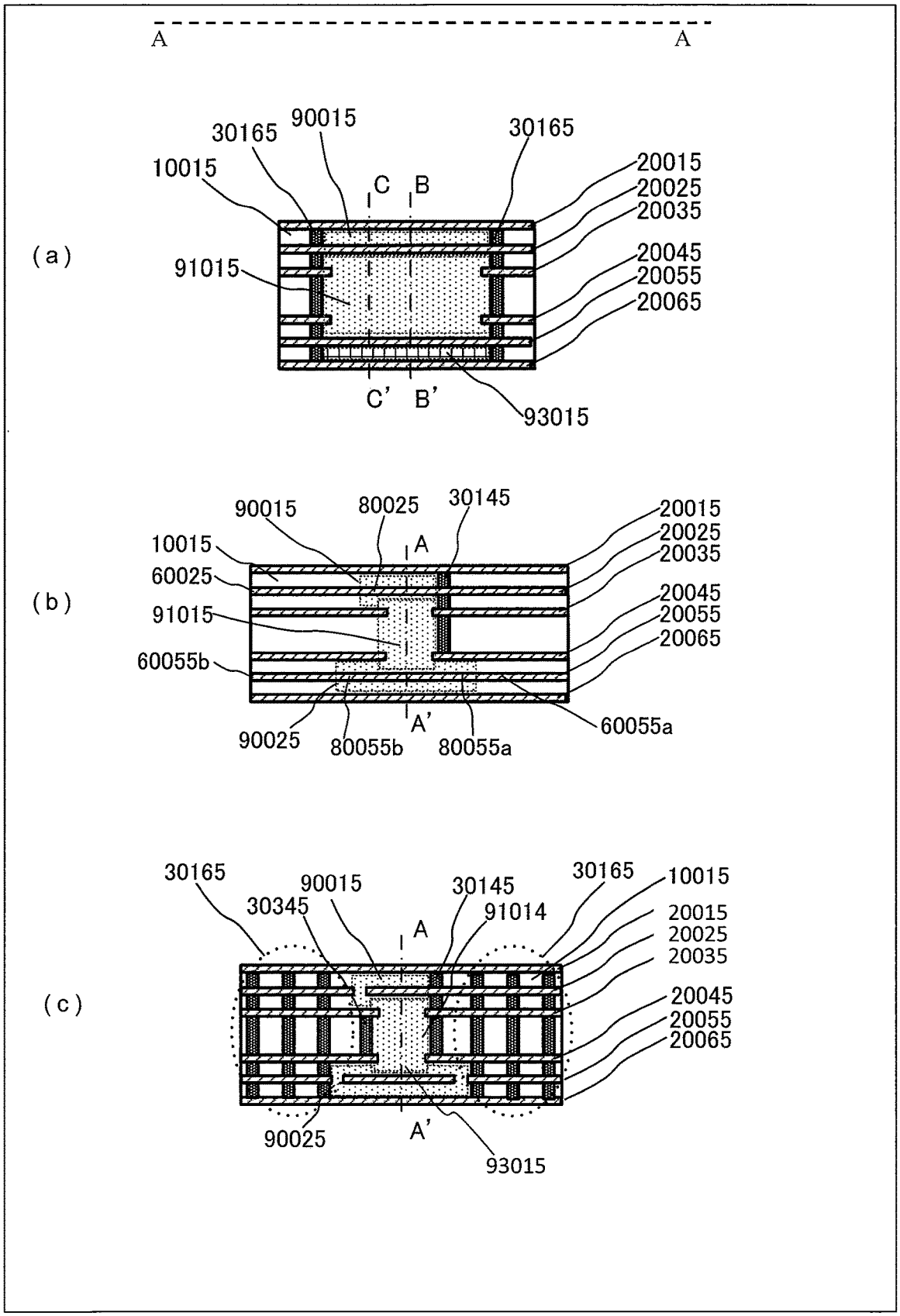
FIG. 37 is a vertical sectional view for illustrating the dielectric filter according to Example 3 of the fourth embodiment of the present invention.

FIG. 36 and FIG. 37 are views for illustrating a dielectric filter according to the fourth embodiment of the present invention in which one of the two strip line-waveguide converters has one input and two outputs.

FIG. 36 is an exploded perspective view for illustrating an array of conductor layers, strip lines, cutouts, connecting portions, vias, apertures, and the like.

Part (a) of FIG. 37 is a vertical sectional view taken along the line A-A of FIG. 36.

Part (b) of FIG. 37 is a vertical sectional view taken along the line B-B' of part (a) of FIG. 37.

Part (c) of FIG. 37 is a vertical sectional view taken along the line C-C' of part (a) of FIG. 37.

In FIG. 36 and FIG. 37, in a multilayer dielectric substrate 10015, there are provided:

a conductor layer 20015, a conductor layer 20025, a conductor layer 20035, a conductor layer 20045, a conductor layer 20055, and a conductor layer 20065;

vias 30165, vias 30345, and vias 30145; and a strip line 60025, a strip line 60055*a*, a strip line 60055*b*, a connecting portion 80025, a connecting portion 80055*a*, and a connecting portion 80055*b*.

The conductor layer 20015 is arranged on a surface layer of the multilayer dielectric substrate 10015.

The conductor layer 20025 is arranged in an inner layer of the multilayer dielectric substrate 10015 so as to face the conductor layer 20015.

The conductor layer 20035 is arranged in the inner layer of the multilayer dielectric substrate 10015 so as to face the conductor layer 20025 facing the conductor layer 20015 on its back surface side.

The conductor layer 20045 is arranged in the inner layer of the multilayer dielectric substrate 10015 so as to face the conductor layer 20035 facing the conductor layer 20025 on its back surface side.

The conductor layer 20055 is arranged in the inner layer of the multilayer dielectric substrate 10015 so as to face the conductor layer 20045 facing the conductor layer 20035 on its back surface side.

The conductor layer 20065 is arranged on a surface layer of the multilayer dielectric substrate 10015 on a side opposite to the side on which the conductor layer 20015 is arranged, so as to face the conductor layer 20055 facing the conductor layer 20045 on its back surface side.

The conductor layer 20035 and the conductor layer 20045 have an aperture 40035 and an aperture 40045, respectively.

The aperture 40035 and the aperture 40045 are arranged so as to oppose each other. That is, the aperture 40035 and the aperture 40045 are positioned so as to overlap each other in the laminating direction.

The strip line 60025 is formed by eliminating a part of the conductor layer 20025.

The strip line 60055*a* is formed by eliminating a part of the conductor layer 20055.

The strip line 60055*b* is formed by eliminating a part of the conductor layer 20055 on the opposite side of the strip line 60055*a* across the connecting portion 80055*a* and the connecting portion 80055*b*.

The conductor layer 20025 has a cutout 41125 and a cutout 41225, which are connected to one end of the strip line 60025 at the connecting portion 80025.

The conductor layer 20055 has a cutout 41155*a*, a cutout 41255*a*, a cutout 41155*b*, and a cutout 41255*b*. The cutout 41155*a* and the cutout 41255*a* are connected to one end of the strip line 60055*a* at the connecting portion 80055*a*, and the cutout 41155*b* and the cutout 41255*b* are connected to one end of the strip line 60055*b* at the connecting portion 80055*b*.

A plurality of vias 30165 are arranged so as to surround the aperture 40035 to the aperture 40045 except for parts corresponding to the strip line 60025, the strip line 60055*a*, and the strip line 60055*b*, and are arranged along the both longitudinal side surfaces of the strip line 60025, the strip line 60055*a*, and the strip line 60055*b*. Further, the vias 30165 extend from the conductor layer 20015 to the conductor layer 20065 to pass through the multilayer dielectric substrate 10015 and the conductor layer 20025 to the conductor layer 20055.

A plurality of vias 30345 are arranged so as to extend from the conductor layer 20035 to the conductor layer 20045 to pass through the multilayer dielectric substrate 10015.

A plurality of vias 30145 are arranged so as to extend from the conductor layer 20015 to the conductor layer 20045 to pass through the multilayer dielectric substrate 10015.

In the planar direction of the multilayer dielectric substrate 10015, a strip line-waveguide converter 90015 is formed of the conductor layer 20015, the conductor layer 20025, the conductor layer 20035, the vias 30165, the vias 30145, the connecting portion 80025, the cutout 41125, and the cutout 41225. In the strip line-waveguide converter 90015, a dielectric waveguide part, which is formed of the vias 30165, the vias 30145, the conductor layer 20015, and the conductor layer 20025 in the planar direction of the multilayer dielectric substrate 10015 to form the back-short waveguide, is formed so that a part from a part of the vias 30145, which is positioned on the opposite side of the strip line 60025 across the connecting portion 80025 to serve as the short-circuit portion, to the connecting portion 80025 has a length corresponding to ¼ wavelength of a guide wavelength of the back-short waveguide.

In the planar direction of the multilayer dielectric substrate 10015, a strip line-waveguide converter 90025 is formed of the conductor layer 20045, the conductor layer 20055, the conductor layer 20065, the vias 30165, the connecting portion 80055*a*, the connecting portion 80055*b*, the cutout 41155*a*, the cutout 41255*a*, the cutout 41155*b*, and the cutout 41255*b*. In the strip line-waveguide converter 90025, a dielectric waveguide part, which is formed of the vias 30165, the conductor layer 20055, and the conductor layer 20065 in the planar direction of the multilayer dielectric substrate 10015 to form the back-short waveguide, is formed so that a part from the connecting portion 80055*a* to the connecting portion 80055*b* has a length corresponding to half wavelength of a guide wavelength of the back-short waveguide. The center of the back-short waveguide corresponds to ¼ wavelength from the connecting portion 80055*a* and the connecting portion 80055*b*. When equal-amplitude and reverse-phase signals are propagated from both sides of the back-short waveguide, a virtual short-circuit surface 93015 is obtained.

In the laminating direction of the multilayer dielectric substrate 10015, a dielectric waveguide 91015 is formed of the conductor layer 20025, the conductor layer 20035, the conductor layer 20045, the conductor layer 20055, the vias 30165, the vias 30145, the vias 30345, the aperture 40035, and the aperture 40045.

The strip line-waveguide converter 90015 and the strip line-waveguide converter 90025 are electromagnetically connected to each other via the dielectric waveguide 91015.

In the example of FIG. 36 and FIG. 37 according to Example 3 of the fourth embodiment, the strip line-waveguide converter 90025 is formed so as to have one input and two outputs. In this manner, the dielectric filter can have a signal distribution function, and an effect similar to that in the example of FIG. 1 and FIG. 2 of the above-mentioned first embodiment can be obtained.

Figure 38:
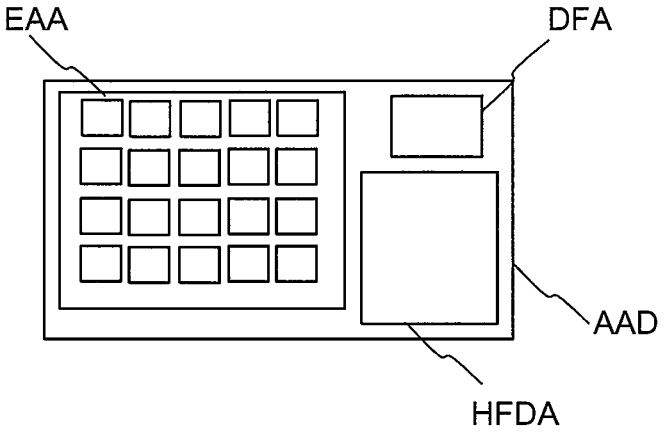
FIG. 38 is an image for illustrating an example of a configuration of an array antenna device according to the present invention.

The present invention includes an array antenna device including the dielectric filters according to each embodiment described above. FIG. 38 is an image of the array antenna device according to the present invention. In an array antenna device AAD, a plurality of element antennas are mounted in an element antenna region EAA. In a high-frequency device mounting region HFDA, a plurality of high-frequency circuits or a plurality of high-frequency components are mounted. In a dielectric filter mounting region DFA, a plurality of dielectric filters described in each of the above-mentioned embodiments are mounted. The dielectric filters mounted in the dielectric filter mounting region DFA may be the dielectric filters according to one Example described above, or may be a combination of the dielectric filters according to a plurality of different Examples.

In a path connecting between one element antenna and one high-frequency component or one high-frequency circuit, a dielectric filter is required to be provided for each path. In view of this, when each element antenna in the element antenna region EAA is connected to the high-frequency circuit or the high-frequency component in the high-frequency device mounting region HFDA, the element antenna is connected via the dielectric filter in the dielectric filter mounting region DFA. In the array antenna device according to the present invention, an area to be occupied by each dielectric filter is decreased as described above, and hence an area to be occupied by the dielectric filter mounting region DFA can be decreased. As a result, the entire array antenna device can be downsized. Further, each dielectric filter can perform signal conversion with low loss, and hence a high-performance array antenna device can be provided.

The present invention is not limited to the above-mentioned embodiments, and includes a possible combination of the embodiments, a possible modification of any components of the embodiments, and possible omission of any components in the embodiments.

Further, as the conductor layers, the dielectric filter according to the present invention is only required to include at least four conductor layers, specifically, two conductor layers serving as short-circuit surfaces on both sides, and two conductor layers having the strip lines.

For example, the modification in each of the two strip line-waveguide converters and the two probes in the embodiments described above may be made in at least one of the two strip line-waveguide converters or at least one of the two probes.

REFERENCE SIGNS LIST

1001, 10010, 10011, 10012, 10022, 10013, 10014, 10015 multilayer dielectric substrate; 2001, 2002, 2003, 2004, 2005, 2006, 2007, 2008, 20010, 20020, 30030, 20040, 20050, 20060, 20070, 20080, 20090, 20100, 20110, 20011, 20021, 20031, 20041, 20051, 20061, 20071, 20081, 20091, 20101, 20012, 20022, 20032, 20042, 20052, 20062, 20072, 20082, 20092, 20102, 20013, 20023, 20033, 20043, 20053, 20063, 20014, 20024, 20034, 20044, 20054, 20064, 20074, 20084, 20015, 20025, 20035, 20045, 30055, 20065 conductor layer; 21060 conductor pattern; 3018, 3024, 3057, 3118, 3124, 3157, 31110, 30240, 30570, 38100, 30151, 30241, 36101, 30791, 86101*a*, 86101*b*, 30152, 30242, 36102, 30792, 30163, 30343, 30154, 30184, 30145, 30165, 30345, 86102*a*, 86102*b* via, 4002, 4003, 4004, 4005, 4006, 4007, 4102, 4107, 4104, 4105, 4202, 4302, 40020, 40030, 40040, 40050, 40060, 40070, 40080, 40090, 40100, 40021, 40031, 40041, 40051, 40061, 40071, 40081, 40091, 40022, 40032, 40042, 40052, 40062, 40072, 40082, 40092, 40033, 40043, 40024, 40034, 40044, 40054, 40035, 40045 aperture; 41061*a*, 41061*b*, 41062*a*, 41062*b*, 41123, 41223, 41153, 41253, 41164, 41264, 41125, 41225, 41155*a*, 41155*b*, 41255*a*, 41255*b* cutout; 5003, 5006, 5103, 5106, 5206, 5303, 5306, 50030, 50090, 50031, 50081, 50032, 50082 probe; 6003, 6006, 60030, 60090, 60031, 60081, 60032, 60082, 60023, 60053, 60034, 60064, 60025, 60055*a*, 60055*b* strip line; 70061*a*, 70061*b*, 70071*a*, 70071*b*, 70062*a*, 70062*b*, 70072*a*, 70072*b* choke path; 80023, 80053, 80064, 80025, 80055*a*, 80055*b* connecting portion; 9001, 9002, 9011, 9012, 9021, 9022, 9031, 9032, 9051, 9061, 90010, 90020, 90011, 90021, 90012, 90022, 90013, 90023, 90014, 90024, 90015, 90025 strip line-waveguide converter; 9101, 9111, 9121, 9141, 91010, 91011, 91012, 91022, 91013, 91014, 91015 dielectric waveguide; 5403,

5406, 31570, 32570 resonance conductor; 92010 resonance space; 93015 virtual short-circuit surface; AAD array antenna device; EAA element antenna region; HFDA high-frequency device mounting region; DFA dielectric filter mounting region

The invention claimed is:

1. A dielectric filter, comprising:

a multilayer dielectric substrate, which includes a plurality of conductor layers formed so as to be separated apart from each other in a laminating direction, and is configured to propagate a high-frequency signal;

a first strip line and a second strip line, which are formed so as to extend in a planar direction in conductor layers that are separated away from each other in the laminating direction;

a dielectric waveguide formed of the conductor layers extending in the planar direction and conductor posts extending in the laminating direction, between the first strip line and the second strip line in the laminating direction of the multilayer dielectric substrate;

a first strip line-waveguide converter, which is formed on an upper side of the first strip line in the laminating direction, and is configured to perform transmission line conversion between the dielectric waveguide and the first strip line; and a second strip line-waveguide converter, which is formed on a lower side of the second strip line in the laminating direction, and is configured to perform transmission line conversion between the dielectric waveguide and the second strip line.

2. The dielectric filter according to claim 1, wherein the first strip line-waveguide converter includes:

a first probe having one end connected to the first strip line, and another end arranged so as to oppose the dielectric waveguide; and a first back-short waveguide having one end that is short-circuited, and another end connected to the dielectric waveguide so as to oppose the dielectric waveguide, and wherein the second strip line-waveguide converter includes:

a second probe having one end connected to the second strip line, and another end arranged so as to oppose the dielectric waveguide; and a second back-short waveguide having one end that is short-circuited, and another end connected to the dielectric waveguide so as to oppose the dielectric waveguide.

3. The dielectric filter according to claim 2, wherein the first probe has an end portion arranged so as to oppose the dielectric waveguide, the end portion having a width that is larger than a width of the first strip line.

4. The dielectric filter according to claim 2, wherein the second probe has an end portion arranged so as to oppose the dielectric waveguide, the end portion having a width that is larger than a width of the second strip line.

5. The dielectric filter according to claim 2, wherein at least one of the first back-short waveguide or the second back-short waveguide differs from the dielectric waveguide in a waveguide inside shape in a cross section orthogonal to a waveguide axis.

6. The dielectric filter according to claim 2, wherein at least one of the first back-short waveguide or the second back-short waveguide has a shape in which a width at a center portion in a longitudinal direction is narrowed as a waveguide inside shape in a cross section orthogonal to a waveguide axis.

7. The dielectric filter according to claim 2, wherein at least one of the first probe or the second probe has an end portion arranged so as to oppose the dielectric waveguide, the end portion having connected thereto a first ¼ wavelength conductor, which has an opened leading end, and which corresponds to ¼ wavelength of a frequency at which propagation of a high-frequency signal is to be blocked.

8. The dielectric filter according to claim 2, further comprising a resonance space including a choke formed in a part of a waveguide wall in the dielectric waveguide so as to have a small aperture diameter.

9. The dielectric filter according to claim 2, wherein the dielectric waveguide includes a second ¼ wavelength conductor having one end connected to a waveguide wall and another end arranged in the dielectric waveguide, the second ¼ wavelength conductor corresponding to ¼ wavelength of a frequency at which propagation of a high-frequency signal is to be blocked.

10. The dielectric filter according to claim 2, wherein the dielectric waveguide includes a first half wavelength conductor having both ends opened in the dielectric waveguide, the first half wavelength conductor corresponding to half wavelength of a frequency at which propagation of a high-frequency signal is to be blocked.

11. The dielectric filter according to claim 2, further comprising a choke structure arranged in a side portion of the dielectric waveguide, wherein the choke structure includes a first choke path and a second choke path, which are formed in the multilayer dielectric substrate, wherein the first choke path is formed of a space extending from a waveguide wall of the dielectric waveguide to a cutout formed at a position separated away from the waveguide wall by $\lambda e/4$, where $\lambda e$ represents an effective wavelength in the multilayer dielectric substrate of a signal wave, and wherein the second choke path is formed of a space extending from the cutout to a conductor post provided at a position separated away from the cutout by $\lambda e/4$.

12. The dielectric filter according to claim 1, wherein the first strip line-waveguide converter includes:

a first planar dielectric waveguide, which is formed in the planar direction, and which has one end connected to the first strip line, and another end connected to the dielectric waveguide extending in a vertical direction; and a first back-short waveguide having one end connected to the first strip line, and another end that is short-circuited, and wherein the second strip line-waveguide converter includes:

a second planar dielectric waveguide, which is formed in the planar direction, and has one end connected to the second strip line, and another end connected to the dielectric waveguide extending in the vertical direction; and a second back-short waveguide having one end connected to the second strip line, and another end that is short-circuited.

13. The dielectric filter according to claim 1, wherein the first strip line-waveguide converter includes:

a first planar dielectric waveguide, which is formed in the planar direction, and has one end connected to the first strip line, and another end connected to the dielectric waveguide extending in a vertical direction; and a first back-short waveguide having one end connected to the first strip line, and another end that is short-circuited, and wherein the second strip line-waveguide converter includes:

a probe having one end connected to the second strip line, and another end arranged so as to oppose the dielectric waveguide; and a second back-short waveguide having one end that is short-circuited, and another end connected to the dielectric waveguide so as to oppose the dielectric waveguide.

14. An array antenna device, comprising:

a plurality of element antennas;

a plurality of high-frequency devices to be connected to the plurality of element antennas; and a plurality of dielectric filters each inserted into a connection path between each of the plurality of element antennas and each of the plurality of high-frequency devices, the plurality of dielectric filters each comprising the dielectric filter of claim 1.

15. A dielectric filter, comprising:

a first multilayer dielectric substrate, which includes a plurality of conductor layers formed so as to be separated apart from each other in a laminating direction, and is configured to propagate a high-frequency signal; and a second multilayer dielectric substrate, which includes a plurality of conductor layers formed so as to be separated apart from each other in the laminating direction, and is configured to propagate a high-frequency signal, the second multilayer dielectric substrate being formed so as to overlap the first multilayer dielectric substrate in the laminating direction of the first multilayer dielectric substrate, wherein, in a connection structure for propagating the high-frequency signal, the first multilayer dielectric substrate includes:

a first strip line formed in a planar direction of the first multilayer dielectric substrate;

a first dielectric waveguide formed in the laminating direction of the first multilayer dielectric substrate; and a first strip line-waveguide converter configured to perform transmission line conversion between the first strip line and the first dielectric waveguide, wherein the second multilayer dielectric substrate includes:

a second strip line formed in a planar direction of the second multilayer dielectric substrate;

a second dielectric waveguide formed in a laminating direction of the second multilayer dielectric substrate; and a second strip line-waveguide converter configured to perform transmission line conversion between the second strip line and the second dielectric waveguide, wherein the first dielectric waveguide is connected to the second dielectric waveguide from a first aperture of the first multilayer dielectric substrate formed on a side opposing the second multilayer dielectric substrate, via a first space secured between the first multilayer dielectric substrate and the second multilayer dielectric substrate and a second aperture of the second multilayer dielectric substrate formed on a side opposing the first multilayer dielectric substrate, wherein the dielectric filter further comprises a choke structure arranged around the first aperture and the second aperture of at least one multilayer dielectric substrate of the first multilayer dielectric substrate and the second multilayer dielectric substrate sandwiching the first space, wherein the choke structure includes the first space and a second space secured in the at least one multilayer dielectric substrate, wherein the second space has a cutout in a surface layer of the at least one multilayer dielectric substrate, and wherein a part from an end of each of the first aperture and the second aperture to an end portion of the second space including the first space corresponds to $\lambda/2$, where $\lambda$ represents a free space wavelength of a signal wave.

16. A dielectric filter, comprising:

a multilayer dielectric substrate, which includes a plurality of conductor layers formed so as to be separated apart from each other in a laminating direction, and is configured to propagate a high-frequency signal;

a first strip line and a second strip line, which are formed so as to extend in a planar direction in conductor layers that are arranged so as to be separated away from each other in the laminating direction;

a third strip line formed so as to extend in the planar direction in one of the conductor layers in which the second strip line is formed;

a vertical dielectric waveguide, which is arranged between the first strip line and each of the second strip line and the third strip line of the multilayer dielectric substrate, and is formed in the laminating direction of the multilayer dielectric substrate and formed of a plurality of conductor layers extending in the planar direction and conductor posts extending in the laminating direction;

a first strip line-waveguide converter, which is formed in the planar direction in another of the conductor layers in which the first strip line is formed, and is configured to perform transmission line conversion between the vertical dielectric waveguide and the first strip line;

a second strip line-waveguide converter, which is formed in the planar direction in the one of the conductor layers in which the second strip line is formed, and is configured to perform transmission line conversion between the vertical dielectric waveguide and the second strip line; and a third strip line-waveguide converter, which is formed in the planar direction in the one of the conductor layers in which the third strip line is formed, and is configured to perform transmission line conversion between the vertical dielectric waveguide and the third strip line, the first strip line-waveguide converter including:

a first planar dielectric waveguide formed in the planar direction, the first planar dielectric waveguide having one end connected to the first strip line, and another end connected to the vertical dielectric waveguide; and a first back-short waveguide having one end connected to the first strip line, and another end that is short-circuited, the second strip line-waveguide converter including:

a second planar dielectric waveguide formed in the planar direction, the second planar dielectric waveguide having one end connected to the second strip line, and another end connected to a part of the vertical dielectric waveguide and a part of the third strip line-waveguide converter; and a second back-short waveguide having one end connected to the second strip line, and another end connected to a part of the third strip line-waveguide converter, the third strip line-waveguide converter including:

the second planar dielectric waveguide formed in the planar direction, the second planar dielectric waveguide having one end connected to the third strip line, and another end connected to a part of the vertical dielectric waveguide and a part of the second strip line-waveguide converter; and a third back-short waveguide having one end connected to the third strip line, and another end connected to a part of the second strip line-waveguide converter.

* * * * *